United States Patent [19]

Jones et al.

[11] 4,292,874

[45] Oct. 6, 1981

[54] AUTOMATIC CONTROL APPARATUS FOR CHORDS AND SEQUENCES

[75] Inventors: Edward M. Jones, Cincinnati, Ohio; Carlton J. Simmons, Jr., Florence, Ky.

[73] Assignee: Baldwin Piano & Organ Company, Cincinnati, Ohio

[21] Appl. No.: 40,107

[22] Filed: May 18, 1979

[51] Int. Cl.[3] ..... G10H 1/38; G10H 1/42

[52] U.S. Cl. ..... 84/1.03; 84/DIG. 12; 84/DIG. 22; 84/DIG. 25

[58] Field of Search ..... 84/1.01, 1.03, 1.13, 84/1.24, 1.26, DIG. 2, DIG.12, DIG. 22, DIG. 25

[56] References Cited

U.S. PATENT DOCUMENTS

| | | | |
|---|---|---|---|
| Re. 26,521 | 2/1969 | Park | 84/1.03 |
| Re. 29,144 | 3/1977 | Bunger | 84/1.01 |
| 3,140,336 | 7/1964 | Campbell | 84/1.03 |
| 3,243,494 | 3/1966 | Park | 84/1.03 |
| 3,247,307 | 4/1966 | Campbell, Jr. | 84/1.03 |
| 3,247,309 | 4/1966 | Campbell | 84/1.03 X |
| 3,358,068 | 12/1967 | Campbell, Jr. | 84/1.01 |
| 3,383,452 | 5/1968 | Park et al. | 84/1.03 |
| 3,478,633 | 11/1969 | Mallett | 84/1.03 |
| 3,493,667 | 2/1970 | Campbell | 84/1.03 |
| 3,499,091 | 3/1970 | Bunger | 84/1.03 |
| 3,522,358 | 7/1970 | Campbell | 84/1.03 |
| 3,549,774 | 12/1970 | Bunger | 84/1.03 |
| 3,590,129 | 6/1971 | Freeman | 84/1.01 |
| 3,629,480 | 12/1971 | Harris | 84/1.03 |
| 3,629,481 | 12/1971 | Bunger | 84/1.03 |
| 3,665,090 | 5/1972 | Wangard et al. | 84/1.03 |
| 3,681,508 | 8/1972 | Bohm | 84/1.03 |
| 3,688,009 | 8/1972 | Wangard | 84/1.03 |
| 3,708,604 | 1/1973 | Hebeisen et al. | 84/1.03 |
| 3,711,618 | 1/1973 | Freeman | 84/1.03 |
| 3,740,449 | 6/1973 | Southard | 84/1.01 |
| 3,787,601 | 1/1974 | Campbell | 84/1.03 |
| 3,789,718 | 2/1974 | Bunger | 84/1.01 |
| 3,811,003 | 5/1974 | Harris | 84/1.03 |
| 3,918,341 | 11/1975 | Bunger | 84/1.01 |
| 4,000,674 | 1/1977 | Schreier | 84/1.01 |
| 4,010,667 | 3/1977 | Kniepkamp | 84/1.03 |
| 4,058,043 | 11/1977 | Shibahara | 84/1.03 |
| 4,188,848 | 2/1980 | Roberts | 84/1.01 |

*Primary Examiner*—S. J. Witkowski

*Attorney, Agent, or Firm*—Kirkland & Ellis

[57] ABSTRACT

Electronic and logic circuitry for an automatic tonal bass rhythm accompaniment feature and an automatic chord feature in an electronic organ. Automatic bass rhythm accompaniment produces a pattern of notes based upon a tonic note selected by the instrumentalist such that the desired musical effect is produced when the pattern of notes is combined with the notes being played by the instrumentalist. The electronic organ has stored in a memory various rhythm patterns which can be selected by the instrumentalist by closing rhythm switches. Electronic circuitry then causes notes for the selected rhythm pattern or patterns to be played automatically in response to the actuation of a pedal switch or keyswitch. The automatic chord feature of the present invention provides selectively major triad and dominant seventh chords or minor triad and diminished seventh chords automatically in response to the selection of a root note by the instrumentalist.

40 Claims, 24 Drawing Figures

+27V
820
SWING
TEEN BEAT
SHUFFLE
3/4 WALTZ
POP ROCK
6/8 MARCH
SOUL ROCK
RHUMBA BEGUINE
TANGO
FOX TROT
BOSSA NOVA
POLKA MARCH
BOLERO
SAMBA
MERENGUE
CHA-CHA
68K
100K
MULTIPLEXER
+15V
DECODER
SB SA
+15V
220K
47K
27K
1.5K
1K
15K
33K
+27V
82
80
78
76

8' GATE
TONE MULTIPLEXER
2' GATE
4' GATE
LATCH #4
TONE MULTIPLEXER
+15V
4.7K
150μf

MINOR TOUCH STRIP CIRCUIT
528
530
408

MULTIPLEXER
PEDAL & ACCOMPANIMENT FILTER BOARD ASS'Y &
RHYTHM GUITAR CIRCUIT
+27V
+15V
417
489
626
490
426
550
C25
C#26
D27
D#28
E29
F30
F#31
G32
G#33
A34
A#35
B36
C37

| INPUT | | | OUTPUT | | | |
|---|---|---|---|---|---|---|
| E | $A_0$ | $A_1$ | $Q_0$ | $O_1$ | $O_2$ | $O_3$ |
| L | L | L | H | L | L | L |
| L | H | L | L | H | L | L |
| L | L | H | L | L | H | L |
| L | H | H | L | L | L | H |
| H | X | X | L | L | L | L |

FIG-7

| INPUTS | | | | OUTPUT |
|---|---|---|---|---|
| SA | SB | AN | BN | ZN |
| L | L | X | X | L |
| H | L | L | X | L |
| H | L | H | X | H |
| L | H | X | L | L |
| L | H | X | H | H |

FIG-8

EASY PLAY CHORDS

| KEY | ROOT | THIRD MAJOR | THIRD MINOR | FIFTH | SEVENTH | 7th AVAILABLE WITH *KEY SELECTORS C-G♭ | D-A♭ | E-B♭ | F-B | G-D♭ | A-E♭ |
|---|---|---|---|---|---|---|---|---|---|---|---|
| C | C37 | E41 | D#40 | G32 | A#35 | | * | * | * | | * |
| C# | C#38 | F42 | E41 | G#33 | B36 | * | | * | * | | * |
| D | D39 | F#31 | F30 | A34 | C37 | * | | * | * | * | |
| D# | D#40 | G32 | F#31 | A#35 | C#38 | * | * | | * | * | |
| E | E41 | G#33 | G32 | B36 | D39 | * | * | | | * | * |
| F | F42 | A34 | G#33 | C37 | D#40 | | * | * | | * | * |
| F# | F#31 | A#35 | A34 | C#38 | E41 | | * | * | * | | * |
| G | G32 | B36 | A#35 | D39 | F42 | * | | * | * | | * |
| G# | G#33 | C37 | B36 | D#40 | F#31 | * | | * | * | * | |
| A | A34 | C#38 | C37 | E41 | G32 | * | * | | * | * | |
| A# | A#35 | D39 | C#38 | F42 | G#33 | * | * | | | * | * |
| B | B36 | D#40 | D39 | F#31 | A34 | | * | * | | * | * |
| C | C37 | E41 | D#40 | G32 | A#35 | | * | * | * | | * |

FIG-12

PEDAL SIGNAL GENERATION

| PEDAL KEYBOARD NOTE | EASY-PLAY RANGE NOTE | SIGNAL ADDRESS R5 (1f) $Q_0$ ⎍ | $Q_1$ ⎍ | $Q_2$ ⎍ | CHIP SELECT $Q_3$ ⎍ | | MX CHIP | SIGNAL INPUT | PITCH SELECT R5 (1f) $R_0$ ⎍ | $R_1$ ⎍ | OUTPUT GATE | OUTPUT SIGNAL |
|---|---|---|---|---|---|---|---|---|---|---|---|---|
| | | $Q_2$ | $Q_3$ | $Q_4$ | $Q_5$ | $\bar{Q}_5$ | | | $Q_0$ | $Q_1$ | | |
| C13 | C25 | L | L | L | L | H | TONE MULTI-PLEXER 890 | C37 | L | L | 8' GATE 982 | C13 |
| C#14 | C#26 | H | L | L | L | H | | C#38 | | | | C#14 |
| D15 | D27 | L | H | L | L | H | | D39 | | | | D15 |
| D#16 | D#28 | H | H | L | L | H | | D#40 | | | | D#16 |
| E17 | E29 | L | H | H | L | H | | E41 | | | | E17 |
| F18 | F30 | H | H | H | L | H | | F42 | | | | F18 |
| F#19 | F#31 | L | H | H | H | L | TONE MULTI-PLEXER 862 | F#43 | | | | F#19 |
| G20 | G32 | H | H | H | H | L | | G44 | | | | G20 |
| G#21 | G#33 | L | L | H | H | L | | G#45 | | | | G#21 |
| A22 | A34 | H | L | H | H | L | | A46 | | | | A22 |
| A#23 | A#35 | L | L | L | H | L | | A#47 | | | | A#23 |
| B24 | B36 | H | L | L | H | L | | B48 | | | | B24 |
| NOTES GENERATED IN AUTOMATIC MODE | | L | L | L | L | H | TONE MULTI-PLEXER 890 | C37 | H | L | 4' GATE 956 | C25 |
| | | H | L | L | L | H | | C#38 | | | | C#26 |
| | | L | H | L | L | H | | D39 | | | | D27 |
| | | H | H | L | L | H | | D#40 | | | | D#28 |
| | | L | H | H | L | H | | E41 | | | | E29 |
| | | H | H | H | L | H | | F42 | | | | F30 |
| | | L | H | H | H | L | TONE MULTI-PLEXER 862 | F#43 | | | | F#31 |
| | | H | H | H | H | L | | G44 | | | | G32 |
| | | L | L | H | H | L | | G#45 | | | | G#33 |
| | | H | L | H | H | L | | A46 | | | | A34 |
| | | L | L | L | H | L | | A#47 | | | | A#35 |
| | | H | L | L | H | L | | B48 | | | | B36 |
| | | L | L | L | L | H | TONE MULTI-PLEXER 890 | C37 | L | H | 2' GATE 954 | C37 |
| | | H | L | L | L | H | | C#38 | | | | C#38 |
| | | L | H | L | L | H | | D39 | | | | D39 |
| | | H | H | L | L | H | | D#40 | | | | D#40 |
| | | L | H | H | L | H | | E41 | | | | E41 |
| | | H | H | H | L | H | | F42 | | | | F42 |
| | | L | H | H | H | L | TONE MULTI-PLEXER 862 | F#43 | | | | F#43 |
| | | H | H | H | H | L | | G44 | | | | G44 |
| | | L | L | H | H | L | | G#45 | | | | G#45 |
| | | H | L | H | H | L | | A46 | | | | A46 |
| | | L | L | L | H | L | | A#47 | | | | A#47 |
| | | H | L | L | H | L | | B48 | | | | B48 |

CONTROL ROUTINE

INITIALIZER
1000
PATH N
SET CN=0
1002
PATH O
SET RB=AR
SET NR
1004
S (NEW NOTE)
1006
1
0
PATH D
PATH A
PATH K

SET: PT=0; LATCH #1
1140
READ RHYTHM START/STOP KICK SWITCH
1142
MY=0 EP=1
1144
NO
YES
1150
PP
0
1
1156
1152
AR
1
0
SET AR=0
OFF-TO-ON TRANSITION OF KICK SWITCH
YES
1146
CHANGE AR
1148
PATH N
SET AR=1 CN=0
1154
PATH O

SET U=0
1045
START 5ms DELAY
1046
PATH E
PATH A
READ RHYTHM COUNTER
1008
NO
YES
$\bar{A}_3\bar{A}_2\bar{A}_1\bar{A}_0=0$
DOWNBEAT
1010
1022
1012
YES
$C_0=\bar{A}_0$
YES
CN =1
NO
NO
1024
$\bar{A}_1\bar{A}_0=1+C_1C_0$
NO
SET CN, MN D, PD and T
1014
1016
S
O
YES
1026
YES
$\bar{A}_3\bar{A}_2\bar{A}_1\bar{A}_0=1$
$C_1C_0=0$
I
1018
5ms DELAY UP
NO
NO
1028
SET U=1
YES
1020
SET S=0 T=0 D=0
1030
INCREMENT CN by 1
PATH C
PATH B PATH C
1032
NR
1
0
SET QB=1
IF ALLOWED
SET S=0
1040
SET PT=S
SET LATCH
#1
1034
PATH D
1036
PP
0
1
1038
SET DO,
PT, LATCH#1,
LATCH#4
1042
SET LATCH
#4 TO 6-BIT
CODE FOR PR
1044
S
0
1
1048
CN=0
NO
YES
1050
CN=1
YES
NO
1052
MN=1
YES
NO
1054
CN=5
YES
NO
1053
LOAD PLAIN
ACTIVITY
NEXT & FANCY
ACTIVITY NEXT
TRANSFER
ACTIVITY NEXT
TO ACTIVITY
NOW
1055
1056
SET T=0,
D=0,
DELAY
PATH G
1058
FANCY
NO
YES
TRANSFER
CONTENTS
OF PLAIN
NEXT TO
FANCY NEXT
1060
PATH E
PATH F
PATH H

PATH F
SET D (AUTOMATIC DAMP)
1074

PATH B
READ PLAIN AND FANCY SWITCHES
1076
READ RHYTHM SWITCHES AND LOAD RYTHM REGISTERS
1078
SET PT=0, LATCH#1
1080
PATH E
I
U
1082
O
READ: E.P. SW., MEMORY SW., MINOR TOUCH S., KEY SW. C3-C4
1084
EASY PLAY
1086
YES
NO
1088
SET: E3-C4 LATCH#2 LATCH#3
READ LOWEST PEDAL NOTE PLAYED. SET PRN AND PPN
1092
READ LOWEST NOTE WITHIN E.P. RANGE; SET PRN AND PPN
1090
PATH I

AUTOMATIC CONTROL APPARATUS FOR CHORDS AND SEQUENCES

BACKGROUND OF THE INVENTION

1. Field of the Invention

The present invention relates to apparatus for automatically providing bass rhythm accompaniment and chords in electronic musical instruments and, more particularly, to apparatus for storing the rhythm patterns as binary data and for retrieving the data and using it to drive a programmable pedal signal generator in response to the playing of a pedal in a first mode of operation, or in response to the playing of a key in a second mode of operation, and for providing in the second mode of operation automatic chord generator means.

2. Description of the Prior Art

Various types of automatic chord and automatic rhythm accompaniment devices for electronic organs are known in the prior art. One example is the automatic chord and rhythm system described in U.S. Pat. No. Re.29,144, reissued Mar. 1, 1977 to Bunger. The system described in '144—Bunger is capable of producing automatic rhythm patterns in both percussive and accompaniment voices, as well as automatic chords in accompaniment voices. In that system, a rhythm pulse generator and enable-disable logic controlled by sixteen rhythm select switches provides trigger pulses to enable accompaniment voices and percussive voices. The rhythm percussive voices are generated by gating on an oscillator or noise generator whenever a trigger pulse is received. Thus, the rhythm percussive voices are merely pulsed on by the rhythm pulse generator and the enable-disable logic with no provision being made for controlling the frequency of the rhythm percussive voices. The accompaniment voices in '144—Bunger are developed by chord selector logic so that when a key is depressed, note frequencies from a generator cause a chord signal to be applied to the inputs of accompaniment voide signal gates. The accompaniment voice signal gates are turned on whenever a trigger pulse is received from the enable-disable logic. Thus, rhythmic chords can be provided from the accompaniment voices.

Another patent describing an automatic chord and rhythm system for an electronic organ is U.S. Pat. No. 3,629,481, issued Dec. 21, 1971, also to Bunger. In that system, bass percussive voices are triggered simultaneously with bass notes (root or fifth) and other percussive voices are sounded concurrently with the chords. The chord attachment operates to provide rhythmic sounding of both the pedal and manual frequencies, and the rhythm feature provides five basic rhythms, which employ pedal tones alternating between the root and fifth notes. In an automatic chord mode of operation, the system described in '481 Bunger triggers percussive sounds by actuation of a keyswitch, whereas in an automatic rhythm mode of operation the percussive sounds are sounded repetitively irrespective of and independently of the operation of a keyswitch. The system described in '481—Bunger plays both rhythmic chords and continuous chords.

Unlike these prior art devices, which provided simple pedal alternations between the root and fifth, the present invention provides harmonically appropriate automatic bass rhythm sequences and chords which are more complex, less monotonous, and which differ audibly depending upon which rhythm is selected. U.S. Pat. No. 3,665,090, issued May 23, 1972 to Wangard, et al., also describes a device for automatically producing bass tone patterns based on a tonic note. The system in '090—Wangard, et al. includes a switching network actuated by electronically produced pulse patterns and by pedal switches actuated by the instrumentalist. The switching network involves a plurality of pedal gate circuits with each circuit having a plurality of individual pedal gates equal to the number of semitones in a musical octave. The switching network also includes a plurality of audio gates actuated by pulses from the pedal gates to pass tone generator signals to an output audio circuit. However, unlike '090—Wangard, et al. the present invention stores rhythm pattern information in registers in a memory and uses a logic circuit to manipulate the rhythm pattern information, thereby eliminating any switching arrangement such as that utilized in the '090—Wangard, et al. patent.

U.S. Pat. No. 3,688,009, issued Aug. 29, 1972, to Wangard is similar to '090—Wangard, et al., except that the former does not include a switching network having pedal gates, audio gates and the associated diode circuitry. Instead, the device described in '009—Wangard uses pulses to actuate a plurality of tone signal generator means such as oscillators which are set by associated circuitry and voltages to generate different frequencies to produce the desired pattern of tone signals which operate audio means for production of the tone pattern; in some other instances the pulses actuate multiple voltage means for a single tone signal generator to provide different voltages in a pattern which determines the tone signals fed to the audio means. Thus, in that device distinctive voltage magnitudes represent corresponding tonic notes and a related group of notes having a predetermined interval relationship.

Another patent that describes an automatic bass rhythm device for electronic organs is U.S. Pat. No. 3,708,604, entitled "Electronic Organ With Rhythmic Accompaniment and Bass," issued Jan. 2, 1973, to Hebeisen, et al. As in U.S. Pat. No. 3,629,481—Bunger, the pedal tones played by that automatic bass device consist of a first pedal tone, usually the key signature, and a second pedal tone, usually the fifth of the scale. The present invention is not limited to two bass tones or to the root and fifth pattern in the automatic bass rhythm patterns generated and is much more versatile and efficient, as will be described.

SUMMARY OF THE INVENTION

The present invention provides means for generating an automatic bass rhythm accompaniment in any of sixteen rhythm patterns which can be selected by the organist. In a first mode of operation, the Normal Organ mode, an automatic bass rhythm pattern can be generated when at least one rhythm pattern is selected by actuation of a rhythm switch and either "plain" or "fancy" variations of the pedal patterns are selected by actuation of the plain pattern switch or the fancy pattern switch. In the Normal Organ mode, the selected rhythm pattern will be provided when a pedal is held down by the organist. In a second mode of operation, the Easy Play mode, a bass rhythm pattern also can be generated automatically when at least one rhythm pattern has been selected by actuation of a rhythm switch. In the Easy Play mode, the selected rhythm pattern is provided when a keyswitch within an octave range (designated herein as the "Easy Play" range) on the accompaniment manual keyboard is closed. Plain or fancy rhythm patterns can be selected in the Easy Play mode; however, when neither plain nor fancy rhythms are selected, the apparatus produces plain rhythm patterns when in the Easy Play mode. The bass rhythm patterns are each two measures long and are repeated thereafter.

The automatic bass rhythm accompaniment provided by the present invention produces notes that are tonically related to the root note (the root note is the note being played on the pedalboard by the organist when in the Normal Organ mode or on the accompaniment manual keyboard within the Easy Play range when in the Easy Play mode). During each sixteenth beat, the present invention determines the note to be played by reading from a register in a memory a frequency deviation value relating the frequency of the tone to be generated by the automatic rhythm device to the frequency of the pedal or key played, with the frequency deviation values being determined by the selected rhythm pattern. When more than one rhythm pattern has been selected simultaneously, one rhythm pattern is selected by the present invention as the priority rhythm pattern, and the frequency deviation values stored in registers in memory for the priority rhythm pattern are used by the apparatus to determine the notes to be played during each sixteenth beat.

Also provided by the present invention is a memory mode, which can be selected when in either the Normal Organ or Easy Play mode. When the memory mode is selected and when no automatic rhythm is selected while in the Normal Organ mode, a pedal tone continues to sound even after the pedal is no longer depressed, until another pedal is depressed or the memory mode is defeated by actuation of a memory defeat switch. Whether or not the memory mode is selected while in the Normal Organ mode, the automatic bass rhythm is initiated when a rhythm switch is actuated, plain or fancy pedal patterns are selected, a rhythm start/stop kick switch is actuated and a pedal is played. The automatic rhythm continues whether or not the pedal is held down, until defeated by actuation of the kick switch. When the memory mode is selected while in the Easy Play mode, the automatic bass rhythm is initiated when a key within the Easy Play range on the accompaniment manual keyboard is played and continues whether or not the key is held down until defeated by the kick switch. When the memory mode is not selected while in the Easy Play mode, the automatic bass rhythm is initiated by playing a key within the Easy Play range and continues for as long as the key is depressed (i.e., the organ operates in a "Touch Rhythm" mode).

When the Easy Play mode of the present invention is selected by actuation of the Easy Play switch, an automatic chord generation feature is also provided. The automatic chord generator feature provides a predetermined distribution of root, third, fifth and seventh parts of a chord when one keyswitch within the Easy Play range is actuated. Seventh chords are available by actuation of six key select switches corresponding to C-G$^b$, D-A$^b$, E-B$^b$, F-B, G-D$^b$ and A-E$^b$. When one of these six key select switches has been actuated, seventh chords are produced except when one of the keys specified on the selector switch is the same as, or is one semitone higher than, the key being played. The present invention generates the desired chord in response to the actuation of a playing key by setting latches which control gates which in turn control tone sources for the various notes. The playing key actuated corresponds to the chord root, and the present invention determines the rest of the notes in the chord by performing a sequence of logical operations on a binary number corresponding to the root. In addition, the present invention provides a minor touch strip by which the organist can select minor chords, thereby affecting the musical third of each chord. When in the memory mode, a chord continues to sound after the key which initiated the chord is released until another key within the Easy Play range is played or the memory mode is defeated by actuation of a memory defeat switch.

More specifically, in the Normal Organ mode of operation when the automatic rhythm device of the present invention is actuated by selecting a rhythm pattern, selecting plain or fancy pattern variations, depressing a pedal, and actuating the rhythm start/stop kick switch, the system of the present invention generates a trigger signal during each sixteenth beat in which a pedal tone is required by a selected rhythm pattern. A damp signal is also generated during each sixteenth beat in which damping of a pedal tone is required by a selected rhythm pattern. In addition, the system generates a binary code corresponding to the frequency (note and octave) of the pedal tone to be sounded, if any, during each sixteenth beat. The binary code is generated from a frequency deviation value corresponding to each particular beat of a selected rhythm pattern. The frequency deviation value is obtained from a table stored in a memory, which contains the frequency deviation value for each beat of each rhythm pattern. The binary code is supplied to a programmable pedal signal generator which generates the appropriate pedal tone signal. The pedal tone signal in turn is supplied to an audio output system via two gates. One gate is controlled by trigger signals such that the gate passes the pedal tone signal to the audio output system in response to the receipt of a trigger signal. The other gate is controlled by a signal on a "note played" bus such that the pedal tone is passed to the audio output system as long as the signal on the "note played" bus is high. Thus, the first gate produces tones that immediately decay, since the trigger signals are only ten milliseconds long, and the second gate produces tones that are sustained. Damp signals also are applied to the first gate to provide more rapid decaying of tones prior to changes in the frequency of the pedal tone being sounded according to a selected rhythm pattern, or at other times specified by a selected rhythm pattern.

In the Easy Play mode, the present invention functions in a similar manner except that the pedalboard is de-activated and automatic rhythm patterns of pedal tones are produced in response to the playing of a key within the Easy Play range of keys on the accompaniment manual.

By storing data in registers in a memory for each available rhythm pattern and for each of the thirty-two sixteenth beats in each rhythm pattern, the present invention provides great flexibility in the automatic rhythm patterns which it provides. This is because trigger, damping and frequency deviation information for each beat of each rhythm pattern can be individually specified in the present invention.

In order to minimize the size of the memory needed to store the data for the rhythm patterns in the present invention, no data is stored for beats of each rhythm pattern during which no trigger or damping activity is required by the rhythm pattern. During each beat (except for a few special beats for which no data is required) all of the data for all the rhythm patterns (both plain and fancy variations) is loaded into PLAIN DATA and FANCY DATA registers and a set of Activity Now bits is loaded into an ACTIVITY NOW register. For each beat a set of Activity Now bits is used to point to the data to identify which rhythm patterns the data for each beat corresponds to. There is one Activity Now bit for each plain rhythm pattern and one Activity Now bit for each fancy rhythm pattern. The state of the Activity Now bit corresponding to each rhythm pattern indicates whether that rhythm pattern required trigger or damp activity during the current sixteenth beat. If a particular rhythm pattern requires no trigger or damp activity during the current beat, the corresponding Activity Now bit will be equal to zero; if a particular rhythm pattern requires trigger or damp activity during the current beat, the corresponding Activity Now bit will be equal to one. Thus, the Activity Now bits which are equal to one identify which rhythm patterns have activity during the current beat, and thus to which rhythm patterns the current data in the PLAIN DATA and FANCY DATA registers applies. If a rhythm pattern having activity during the current beat has been selected by actuation of the corresponding rhythm switch, its frequency deviation and damp information are utilized by the present invention as described above. However, if more than one rhythm pattern has been selected, the present invention selects one of the rhythm patterns as the "priority rhythm", and the frequency deviation information for all the rhythm patterns except for the priority rhythm pattern is ignored.

The automatic damp information is obtained by the present invention one beat in advance. This is because a damp signal is generated automatically by the present invention one beat in advance of trigger or special damp activity. Therefore, it is necessary to know in advance whether there will be trigger or special damp activity on the next beat in order to provide the automatic damping. The automatic damp information is obtained from Activity Next bits. The Activity Next bits are loaded into an ACTIVITY NEXT register. Activity Next bits correspond to the rhythm patterns in the same manner as described for the Activity Now bits. Thus, a rhythm pattern will require a trigger signal or special damp during the next beat if the corresponding Activity Next bit is equal to one. If at least one rhythm pattern having activity next is a selected rhythm pattern, then an automatic damp will be generated. The Activity Next bits are transferred to the ACTIVITY NOW register for the next beat; that is, the Activity Now bits for each beat are the Activity Next bits from the previous beat.

Thus, it is a principal object of the present invention to provide a system in which complex tonal bass rhythm accompaniment sequences are synchronized with the playing of a key to start on the downbeat and to stop when the key is released, and which provides a memory switch which allows the rhythm accompaniment to run continuously once started by the playing of a key and means for stopping the rhythm accompaniment by deactuating the memory switch.

It is another object of the present invention to provide a system in which such tonal bass rhythm accompaniment is started by actuation of a kick switch with the playing of a pedal and to provide means for stopping the rhythm accompaniment by re-actuating the kick switch.

It is another object of the present invention to provide an automatic rhythm accompaniment system for producing a tonal accompaniment rhythm pattern of bass tones in response to the selection of a root note by the instrumentalist.

It is another object of the present invention to provide trigger pulses to actuate a gate to pass pedal tones according to selected rhythm patterns.

It is another object of the present invention to provide means for actuating a programmable pedal signal generator to produce a pedal tone signal that is related to the frequency of the root note preselected by the instrumentalist by an amount of frequency deviation determined according to the preselected rhythm pattern.

It is another object of the present invention to provide damping to damp out the note being generated according to a preselected rhythm pattern just prior to changes in the frequency of the note in order to make the frequency shift less audible and to provide special damping at other times in order to produce desired musical effects.

It is another object of the present invention to provide a plurality of rhythm patterns by storing in a memory information as to the beats during which it is desired to trigger a pedal tone or to damp a pedal tone, and as to the desired frequency deviation values for selected beats of the rhythm patterns.

It is another object of the present invention to minimize the space in memory required to store the trigger, damping and frequency deviation information for the rhythm patterns by storing such information for each rhythm pattern only for the beats on which trigger or damping activity is desired for the rhythm pattern and by utilizing one bit pointers for each beat of each rhythm pattern to identify which rhythm patterns have trigger or damping activity on each beat, thus indicating to which rhythm patterns the trigger, damping and frequency deviation information stored for each beat corresponds.

It is another object of the present invention to provide both a plain and a fancy variation of each rhythm pattern, with either the plain or fancy variation being selectable by the instrumentalist.

It is another object of the present invention to provide an automatic rhythm system in which more than one rhythm can be selected and sounded simultaneously, with the frequency deviation of the rhythm tones being determined by only one of the selected rhythm patterns and with trigger and damping activity during each beat being determined according to all of the selected rhythm patterns.

It is another object of the present invention to provide an automatic chord feature for electronic organs in which a chord is sounded in response to playing a single key, with the key played corresponding to the root note of the chord sounded.

It is another object of the present invention to provide an automatic chord feature having a set of musical key selector switches which automatically provide major triad and seventh chords appropriate to the selected keys.

It is another object of the present invention to provide an automatic chord feature in which a major triad or seventh chord is normally sounded for each root note played and which has a minor touch strip feature for converting to a minor triad or minor seventh chord.

It is another object of the present invention to provide a mode of operation for the automatic chord feature in which a chord is sounded in response to playing a key and in which the chord continues to sound after letting up on that key until another key is played.

It is another object to provide an automatic rhythm system in which the initial pitch of the bass tone corresponds to the key or pedal played but, after some delay, frequency deviations are produced according to the selected rhythm pattern.

These and other objects, advantages, and features will hereinafter appear, and for purposes of illustration, but not for limitation, exemplary embodiments of the present invention are illustrated in the accompanying drawings.

BRIEF DESCRIPTION OF THE DRAWINGS

FIG. 7 is a truth table showing the logical outputs corresponding to various inputs for the decoder used in the rhythm switch multiplexer and the decoder used in the accompaniment keyswitch multiplexer of the present invention.

FIG. 8 is a truth table showing the logical outputs corresponding to various inputs for the rhythm switch multiplexer and the accompaniment keyswitch multiplexer of the present invention.

FIG. 12 shows a pedal signal detection chart for the present invention in the Easy Play mode.

DETAILED DESCRIPTION OF THE PREFERRED EMBODIMENT

Figure 1:
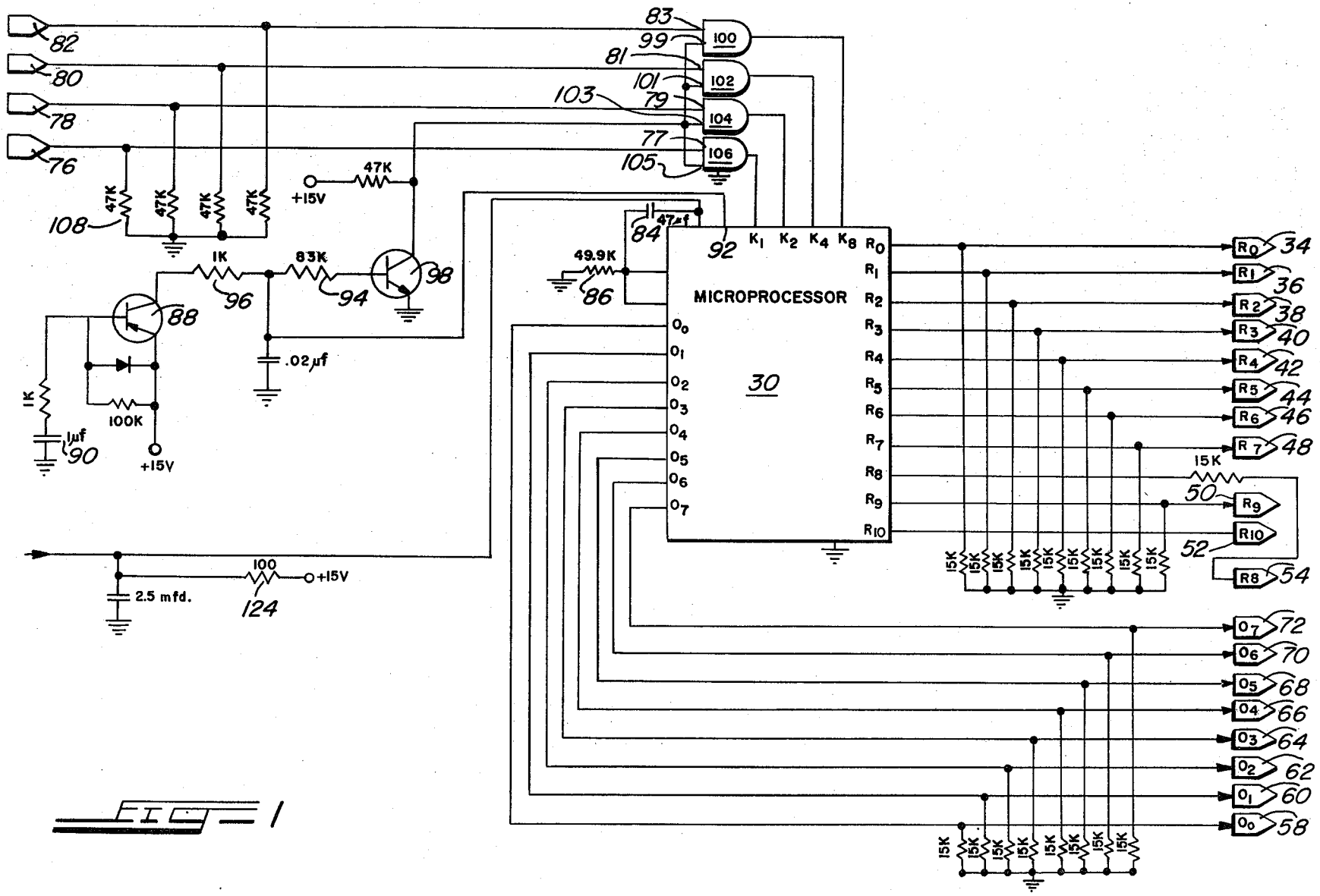
FIG. 1 is a circuit diagram showing the input and output connections to the microprocessor of the preferred embodiment of the present invention.

With reference to FIG. 1, in the preferred embodiment a microprocessor 30 is utilized to control pedal and accompaniment operations in an electronic organ. The present invention has two modes of operation: the "Easy Play" mode and the "Normal Organ" mode. As will be described in greater detail hereinafter, in the Normal Organ mode, the microprocessor 30 scans the pedal keyswitches 766 (see FIG. 3), provides 10 milliseconds pulses to a Pedal Trigger Bus 679 (see FIG. 6), operates a Pedal Note Played Bus 681 (see FIG. 6), provides detection for accompaniment manual playing for the E29 through C37 keyswitches (see FIG. 4) and gates (not shown), establishes the automatic bass rhythm accompaniment operation in synchronism with the rhythm patterns and operates a Rhythm Start/Stop Bus 54 (see FIG. 1). In the Easy Play mode, the microprocessor 30 also establishes the automatic bass rhythm accompaniment operation, provides for the generation of Easy Play chords, detects the key selector switches 418, 420, 422, 423, 424 and 425 (see FIG. 4), and controls the operation of a Major/Minor Touch Strip 408 (see FIG. 5), as will also be described in greater detail hereinafter.

The microprocessor 30 can be a commercially available TMS 1100 type, which is a P-channel MOS, 4-bit, single chip binary microprocessor with a Read Only Memory ("ROM"), Random Access Memory ("RAM"), and Arithmetic and Logic Unit ("ALU"). The ROM (not shown) stores a fixed pattern of $2048\times8$ bits, and the RAM (not shown) provides storage for $128\times4$ bits of data. The microprocessor 30 has eleven individually addressed output latches $R_0$, $R_1$, $R_2$, $R_3$, $R_4$, $R_5$, $R_6$, $R_7$, $R_8$, $R_9$ and $R_{10}$, eight parallel latched data outputs $O_0$, $O_1$, $O_2$, $O_3$, $O_4$, $O_5$, $O_6$ and $O_7$, and four inputs $K_1$, $K_2$, $K_4$ and $K_8$. The oscillator frequency for the microprocessor 30 is set to approximately 322 kHZ by the external timing circuit comprised of capacitor 84 and resistor 86. The outputs $R_0$ through $R_{10}$ control selection of incoming data through inputs $K_1$, $K_2$, $K_4$ and $K_8$ and also strobe outputs $O_0$ through $O_7$ to enable various organ circuits. In the preferred embodiment the outputs $R_0$ through $R_{10}$ and $O_0$ through $O_7$ are controlled by the internal programming of the microprocessor 30, as will be described in greater detail hereinafter. The inputs and outputs of microprocessor 30 operate between ground (0 volts or the "L" logic level) and +15 volts (the "H" logic level).

When the power switch (not shown) for the instrument (not shown) is switched on, transistor 88 turns on for the duration of the charging time of capacitor 90, which is about 0.5 second. A positive pulse is applied to an initialization input 92 of the microprocessor 30 causing the microprocessor 30 to reset and begin execution. This same initializing pulse is applied via resistors 94 and 96 to the base of transistor 98 to hold it saturated for 0.5 second. When transistor 98 is saturated, the collector of transistor 98 is essentially at ground potential, equivalent to the "L" logic level. This "L" logic level is applied to inputs 99, 101, 103 and 105 of AND gates 100, 102, 104 and 106, which disables AND-gates 100, 102, 104 and 106. Thus, input information is effectively blocked from inputs $K_1$, $K_2$, $K_4$ and $K_8$ of the microprocessor 30. After 0.5 second, transistor 98 is no longer saturated and the collector of transistor 98 goes high (+15 V) so that the positive pulse information from input lines 76, 78, 80 and 82, which is applied to second inputs 77, 79, 81 and 83 of AND-gates 100, 102, 104 and 106, will be applied without inversion to inputs $K_1$, $K_2$, $K_4$ and $K_8$ of the microprocessor 30.

Figure 2:
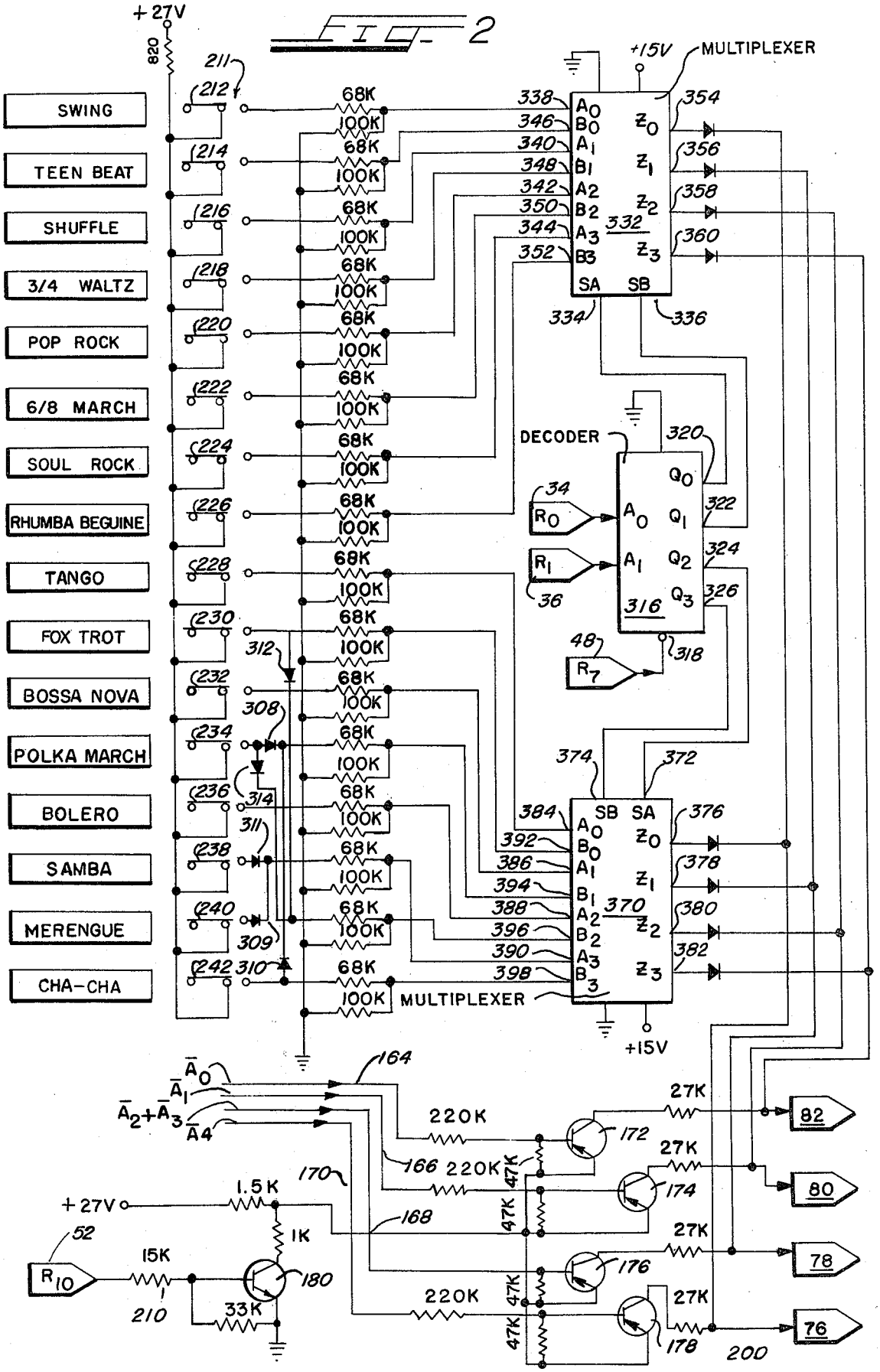
FIG. 2 is a circuit diagram showing the interface between the rhythm switches and the microprocessor of the preferred embodiment of the present invention.

With reference to FIG. 2, the rhythm address ($A_0$ $A_1$ $A_2$ $A_3$) from the rhythm counter 163 (see FIG. 13) is used to synchronize the internal count CN of the microprocessor 30. The circuits associated with transistors 172, 174, 176, 178 and 180 convert the negative logic of the rhythm counter 163 to positive logic to make it compatible with the requirements of input lines $K_1$, $K_2$, $K_4$ and $K_8$. Output $R_{10}$ of the microprocessor 30 enables the transfer of the rhythm address to input lines 76, 78, 80 and 82 to the microprocessor 30. As a negative pulse is applied from output $R_{10}$ via resistor 210 to the base of transistor 180, the collector of transistor 180 applies a positive pulse to the emitters of transistors 172, 174, 176 and 178. The rhythm counter lines 164, 166, 168 and 170 applied to the bases of transistors 172, 174, 176 and 178, respectively, change their levels between +12 V and +27 V, causing these transistors to saturate. In the collector circuit of transistor 178, for example, a resistive divider comprised of resistors 200 and 108 (see FIG. 1) provides a +15 V pulse to input 76 to the microprocessor 30. As will be discussed in greater detail hereafter, the rhythm address, comprised of bits $A_0$, $A_1$, $A_2$ and $A_3$, is used by the microprocessor 30 to indicate the beginning of each measure, to indicate whether the first or second measure of the two-measure rhythm pattern cycle is presently being played, to increment the internal count CN for each transition of $A_0$, and to provide synchronization between the rhythm address and the internal count CN by indicating when the internal count CN has fallen behind the rhythm address generated by the rhythm counter 163.

When microprocessor 30 provides a negative pulse to the $R_7$ latch line 48, rhythm switch information is interrogated by the microprocessor 30. The negative pulse from $R_7$ latch line decoder 48 is applied to an "E" input 318 of decoder 316, which enables decoder 316. Decoder 316 can be one half of a commercially available type 4555 CMOS dual one in four decoder. The logic levels of the $Q_0$ output 320, $Q_1$ output 322, $Q_2$ output 324, and $Q_3$ output 326 of decoder 316 are determined by the various combination of the inputs on E input 318, $A_0$ input 328, and $A_1$ input 330. The logic levels on the outputs 320 through 326 of decoder 316 are given in the truth table in FIG. 7. The outputs 320 and 322 of decoder 316 are connected to SA input 334 and SB input 336, respectively, of multiplexer 332. The logical outputs for outputs 354, 356, 358 and 360 of multiplexer 332 corresponding to the various combinations of logical inputs on selection inputs 334 and 336 and on $A_N$ inputs 338 through 344 and $B_N$ inputs 346 through 352 are given in the truth table in FIG. 8.

In the present invention any of sixteen automatic bass rhythm patterns (i.e., pedal patterns) can be selected by actuation of rhythm switches 212 through 226, as follows: the Swing rhythm is actuated by switch 212; the Teen Beat rhythm by switch 214; the Shuffle rhythm by switch 216; the ¾ Waltz rhythm by switch 218; the Pop Rock rhythm by switch 220; the 6/8 March rhythm by switch 222; the Soul Rock rhythm by switch 224; the Rhumba Beguine rhythm by switch 226; the Tango rhythm by switch 228; the Fox Trot rhythm by switch 230; the Bossa Nova rhythm by switch 232; the Polka March rhythm by switch 234; the Bolero rhythm by switch 236; the Samba rhythm by switch 238; the Merengue rhythm by switch 240; and the Cha-Cha rhythm by switch 242. Rhythm switch information (i.e., a logical "H" when the rhythm switch is on and a logical "L" when the rhythm switch is off) from rhythm switches 212 through 226 is applied to the eight inputs of multiplexer 332. Similarly, the logical outputs 324 asnd 326 of decoder 316 are applied to the SA input 372 and the SB input 374, respectively, of multiplexer 370. Multiplexers 332 and 370 can be commercially available type 4019 CMOS quad two-input multiplexers. The logical outputs for outputs 376, 378, 380 and 382 of multiplexer 370 corresponding to the various combinations of logical inputs on selection inputs 372 and 374 and on $A_N$ inputs 384 thrugh 390 and $B_N$ inputs 392 through 398 are also given in the truth table in FIG. 8. Rhythm switch information from rhythm switches 228 through 242 is applied to the eight inputs of multiplexer 370.

It shold be noted that each of the sixteen rhythm patterns has two variations, which are designated herein as plain and fancy. Since the Fox Trot and Polka March rhythms have the same fancy rhythm patterns, the corresponding rhythm switches 230 and 234 are connected via diodes 312 and 314 to a common input 396 of multiplexer 370. Thus, a logical "H" will be applied to input 388 if either, or both, of the Fox Trot and Polka March rhythms is selected. Similarly, the Polka March and Cha Cha rhythms have the same plain rhythm patterns; therefore, the corresponding rhythm switches 234 and 242 are connected via diodes 308 and 310 to a common input 394 of multiplexer 370. In addition, the Samba and Marengue rhythms have the same plain and fancy patterns; thus, the corresponding rhythm switches 238 and 240 are connected via diodes 309 and 311 to a common input 390 of multiplexer 370. Consequently, only fourteen plain patterns and fourteen fancy patterns are provided in the preferred embodiment of the present invention, and only twenty-eight bits of information are required to specify all possible rhythm selections.

When the negative pulse is provided on $R_7$ output latch 48, the rhythm switch information from the sixteen rhythm switches 212 through 242 is interrogated by the rhythm switch multiplexers 316 and 370 in four groups of four switches each: a first group of four rhythm switches connected to the $A_N$ inputs 338, 340, 342 and 344 of multiplexer 332; a second group of four rhythm switches connected to the $B_N$ inputs 346, 348, 350 and 352 of multiplexer 332; a third group of four rhythm switches connected to the $A_N$ inputs 384, 386, 388 and 390 of multiplexer 370; and a fourth group of four rhythm switches connected to the $B_N$ inputs 392, 394, 396 and 398 of multiplexer 370. The groups are selected by outputs $R_0$ and $R_1$ of the microprocessor 30 applied via latch lines 34 and 36, respectively, to inputs 328 and 330, respectively, of the decoder 316. These inputs to decoder 316 control the state of outputs 320 through 326, thereby, providing the SA and SB selection addresses 334 and 336, respectively, for multiplexer 332 and the SA and SB selection addresses 372 and 374, respectively, for multiplexer 370. The outputs from multiplexer 332 and 370 are connected to input lines 76, 78, 80 and 82 thereby supplying the rhythm switch information indicating which rhythms have been selected by the instrumentalist to the microprocessor 30.

Figures 3, 5:
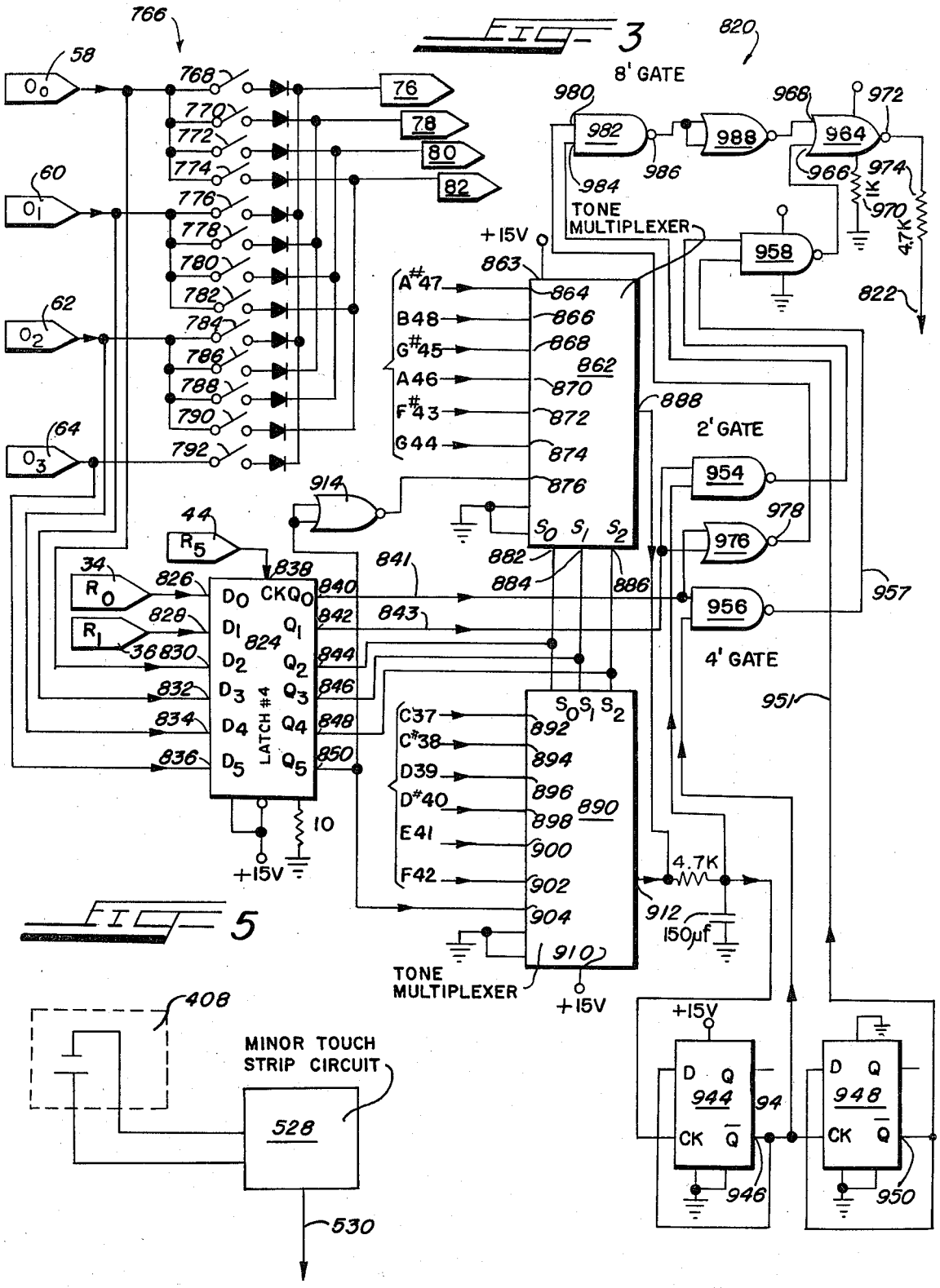
FIG. 3 is a circuit diagram showing the pedal keyboard switches, the programmable pedal signal generator and their interface with the microprocessor in the preferred embodiment of the present invention.
FIG. 5 is a circuit diagram showing the minor touch strip circuit in the preferred embodiment of the present invention.
Figure 4:
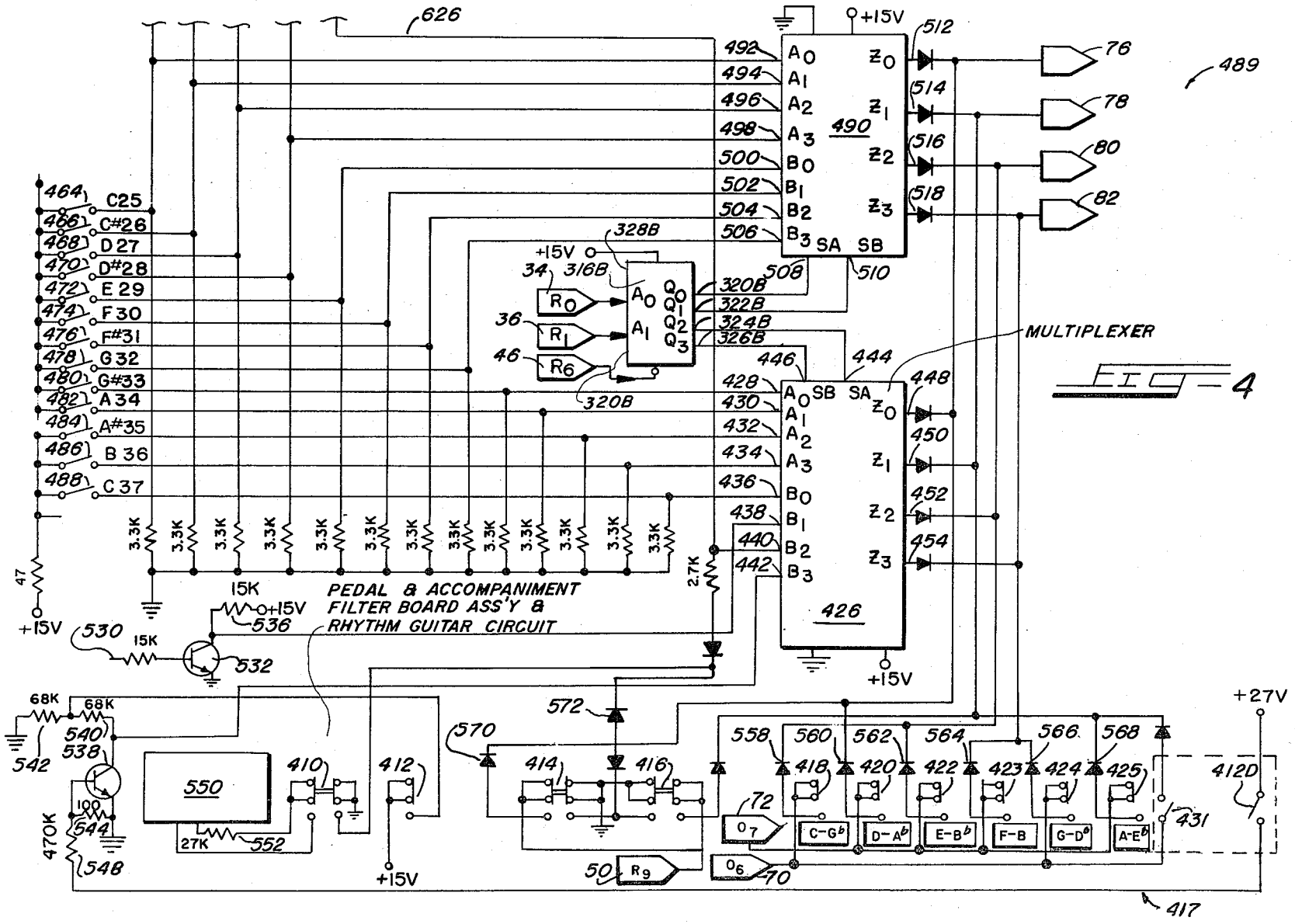
FIG. 4 is a circuit diagram showing those accompaniment keyswitches which provide input to the microprocessor, the accompaniment keyswitch multiplexer and their interface with the microprocessor in the preferred embodiment of the present invention.

With reference to the lower portion of FIG. 4, the circuitry is shown for detecting selection of automatic chords (i.e., the Easy Play mode), major/minor key, the memory function, and the C37 keyswitch. The Easy Play mode is selected by Easy Play switch 410; major/minor key is selected by minor touch strip 408; and the memory function is selected by memory switch 412 and defeated by a memory defeat switch 412D. Keyswitch 488 for key C37 is connected to $B_0$ input 436 of multiplexer 426. The logic level on output bus 530 from minor touch strip circuit 528 (see FIG. 5) (which is actuated by touching minor touch strip 408) is inverted by transistor 532, as hereinafter discussed in greater detail, and is applied to $B_1$ input 438 of multiplexer 426. The collector of transistor 538 is connected to $B_3$ input 442 of multiplexer 426; therefore, when memory switch 412 is closed, a positive voltage (logic level "H") from a +15 V source is applied to $B_3$ input 442 for as long as transistor 538 is not conducting. However, when memory defeat switch 412D is closed, the base of transistor 538 is biased by the +27 V source and the voltage divider comprised of resistors 544 and 548, thereby causing transistor 538 to be in the "on" state and the voltage at the collector of transistor 538 to be essentially at ground potential. This produces a logical "L" signal at the $B_3$ input 442. When Easy Play switch 410 is in the "on" position, a logical "L" signal provided by the "pedal & accompaniment filter board assembly and rhythm guitar circuit" 550 via resistor 552 is applied to the $B_2$ input 440 via diode 554 and resistor 556.

Decoder 316B is similar to decoder 316, and the logic levels of the $Q_{10}$ output 320B, $Q_1$ output 322B, $Q_2$ output 324B and $Q_3$ output 326B also are given in the truth table in FIG. 7 for the various combinations of inputs applied to E input 455, $A_0$ input 328B and $A_1$ input 330B. Multiplexers 426 and 490 can also be commercially available type 4019 CMOS quad two-input multiplexers. Therefore, a negative pulse supplied by the microprocessor 30 via $R_6$ latch line 46 to E input 455 enables decoder 316B and allows interrogation of the C37 keyswitch 488, the minor touch strip 408, the memory switch 412 and the memory defeat switch 412D, and the Easy Play switch 410 by multiplexer 426.

Referring again to FIG. 4, positive output pulses on $O_6$ output line 70 and $O_7$ output line 72 allow interrogation of the seventh key selector switches 418, 420, 422, 423, 424 and 425. Diodes 558, 560, 562, 564, 566 and 568 provide isolation between the lines 76, 78, 80 and 82 and the seventh key selector switch circuitry. Thus, a positive pulse on $O_6$ output line 70 is applied to input line 80 via diode 558 when seventh key selector switch 418 is closed, and is applied to input line 82 via diode 566 when seventh key selector switch 424 is closed. Similarly, a positive pulse on $0_7$ output line 72 is applied to $K_1$ input line 76 via diode 560, to input line 80 via diode 562, to input line 82 via diode 564, and to input line 78 via diode 568 when seventh key selector switches 420, 422, 423 or 425, respectively, are closed. A positive output pulse on $R_9$ latch line 50 permits the interrogation of a plain rhythm switch 414 and a fancy rhythm switch 416. A positive pulse on $R_9$ latch line 50 is applied to the input line 76 via diode 570 when plain rhythm switch 414 is closed, and to the input line 78 via diode 572 when the fancy rhythm switch 416 is closed.

When playing the musical instrument in the Normal Organ mode, keyswitch information (i.e., whether the keyswitch is on or off) for keyswitches 464, 466, 468 and 470, which are actuated by playing keys C25 through D#28 (see FIG. 4), is applied to their corresponding signal diode gates (not shown) via lines 604, 606, 608 and 610 (see FIG. 6), respectively, and AND gates 612, 614, 616 and 618, respectively. AND gates 612, 614, 616 and 618 are conditioned by the logic level on line 626, which is connected to a +15 V voltage source via a resistor 622. The +15 V voltage source provides a logical "H" signal to inputs 626A, 626B, 626C and 626D to condition AND gates 612 through 618 to pass the keyswitch information applied to inputs 611, 613, 615 and 617. However, when the organ is being played in the Easy Play mode, line 626 is grounded via a resistor 556, a diode 554 and the Easy Play switch 410, thus inhibiting the passage of keyswitch information by the AND gates 612 through 618 to lines 604 through 610 to the signal diode gates (not shown).

Referring to FIG. 4, the keyswitch information from keyswitches 464 through 470 is also applied to inputs 492, 494, 496 and 498, respectively, of multiplexer 490. The keyswitch information from keyswitches 472, 474, 476 and 478 is applied to inputs 500, 502, 504 and 506, respectively, of multiplexer 490. Similarly, the keyswitch information from keyswitches 480, 482, 484 and 486 is applied to inputs 428, 430, 432 and 434, respectively, of multiplexer 426. Thus, in the Easy Play mode, accompaniment keyswitches 464 through 488 are interrogated by multiplexers 426 and 490 when a negative pulse is supplied by the microprocessor 30 on the $R_6$ latch line 46. By application of the logic levels on $R_0$ latch line 34 and $R_1$ latch line 36 to decoder 316B, the accompaniment keyswitches 464 through 484 are interrogated in three groups of four keyswitches, and, as discussed above, keyswitch 488 (C37) is interrogated in a fourth group which includes the information from the minor touch strip 408, the Easy Play switch 410, and the memory switch 412 and memory defeat switch 412D. The information from the outputs 512, 514, 516 and 518 of multiplexer 490 and from the outputs 448, 450, 452 and 454 of multiplexer 426 is applied to input lines 76, 80 and 82 of the microprocessor 30. The utilization of this information by the microprocessor 30 will be described in greater detail hereinafter.

Figure 6:
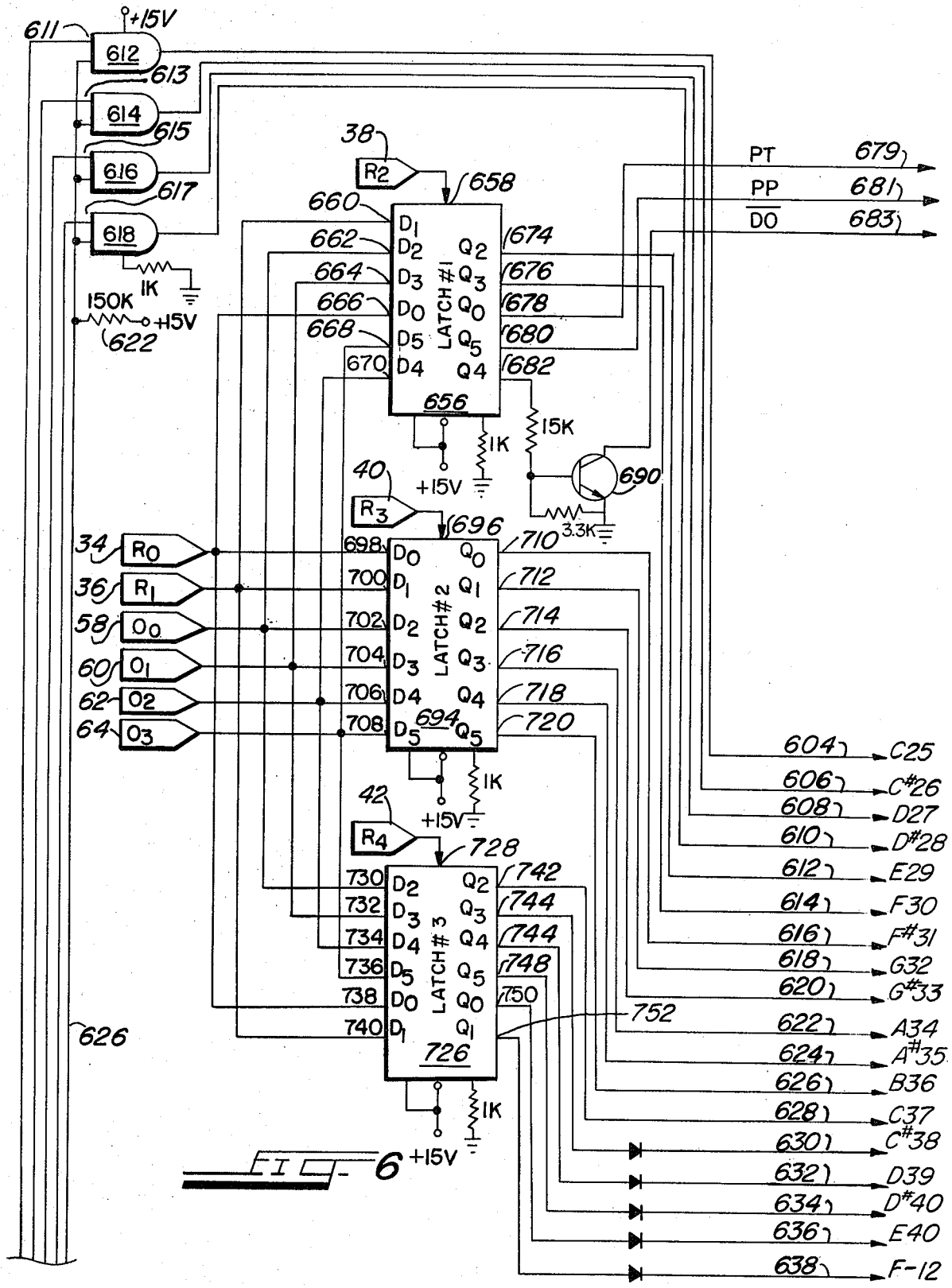
FIG. 6 is a circuit diagram of the accompaniment latches for the preferred embodiment of the present invention.

With reference to FIG. 6, lines 604, 606, 608 and 610 to the signal diode gates (not shown) receive on/off information from the accompaniment keyswitches 464, 466, 468 and 470 (which are actuated by playing keys C25 through D#28) via AND gates 612, 614, 616 and 618. The signal diode gates controlled by lines 628 through 654 (which are actuated by playing keys E29 through C37) are gated "on" by the latches 656, 694 and 726. The latches 656, 694 and 726 are set according to data supplied from $R_O$ latch line 34, $R_1$ latch line 36, $O_0$ output line 58, $O_1$ output line 60, $O_2$ output line 62 and $O_3$ output line 64, in both the Easy Play and Normal Organ modes. Latch outputs 674 and 676, which control signal diode gates (not shown) via lines 628 and 630, are gated at the time of each low to high transition of a pulse on $R_2$ latch line 38 which is applied to a clock input 658 of latch 656; latch outputs 710 through 720 of latch 694, which control signal diode gates (not shown) via lines 632 through 642, are gated at the time of each low to high transition of a pulse on the $R_3$ latch line 40 which is applied to a clock input 696 of latch 694; and latch outputs 742 through 752 of latch 726, which control signal diode gates (not shown) via lines 644 through 654, are gated at the time of each low to high transition of a pulse on the $R_4$ latch line 42 which is applied to a clock input 728 of latch 726. Latches 656, 694 and 726 can be commercially available CMOS 40174 D-type flip-flops. Since the signal diode gates (not shown) controlled by lines 646 through 654 (corresponding to notes C#38 through F42) are within the Easy Play output range, they are gated by the microprocessor 30 when in the Easy Play mode and can also be gated directly by associated keyswitches (not shown) whether in the Easy Play mode or the Normal Organ mode. The Easy Play output range is comprised of notes F30 through F42, as illustrated on the accompaniment keyboard in FIG. 10. Thus, keys played within the Easy Play key range of from C25 through C37 produce notes within the Easy Play output range of from F30 through F42, in this particular embodiment.

Automatic chords can be generated by the present invention when in the Easy Play mode. With reference to FIG. 4, when the Easy Play switch 410 is closed, automatic chords are generated by the playing of a single key within the Easy Play range of C25 (keyswitch 464) through C37 (keyswitch 488) on the accompaniment keyboard 463 (see FIG. 10). In the Easy Play mode, the latch outputs which control the signal diode gates (not shown) controlled by lines 632 through 654 (corresponding to notes F#31 through F42 in FIG. 10) are gated by signals provided by the microprocessor 30. As noted above, the signal diode gates (not shown) controlled by lines 646 through 654 (corresponding to keys C#38 through F42 in FIG. 10) can also be gated directly by the corresponding keyswitches (not shown). As also discussed above, the gating of outputs 710 through 720 of latch 694, which control signal diode gates (not shown) via lines 632 through 642, is accomplished at the time of each low to high transition of a signal on the $R_3$ latch line 40 from the microprocessor 30, and the gating of outputs 742 through 752 of latch 726, which control signal diode gates (not shown) via lines 644 through 654, is accomplished at the time of each low to high transition on the $R_4$ latch line 42 from the microprocessor 30. The table in FIG. 11 shows the chords generated by the present invention in response to the depressing of a key within the Easy Play range, that is, accompaniment keyswitches 464 through 488 in FIG. 4, which correspond to keys C25 through C37 in FIG. 10.

Figures 9, 11:
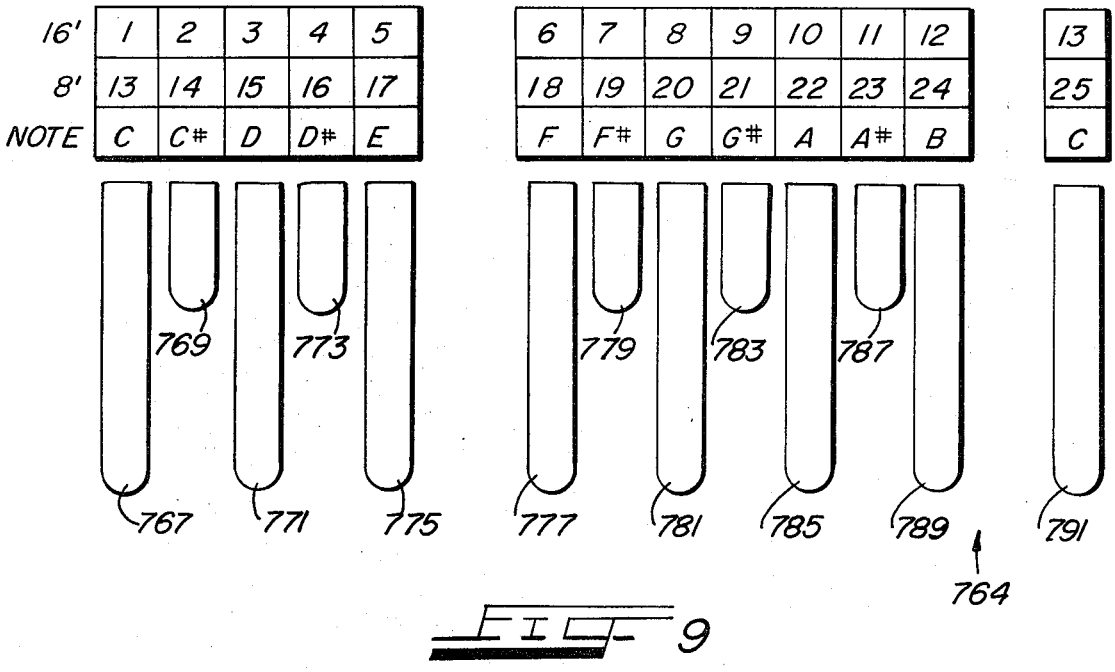
FIG. 9 is a diagram illustrating the pedal keyboard of the present invention.
FIG. 11 is a table showing the chords which are generated by the present invention in response to the playing of a key within the Easy Play range.

With reference to FIG. 3, illustrated are the pedal keyboard switches 766 corresponding to the pedals on pedalboard 764 shown in FIG. 9. Also shown in FIG. 3 is a programmable pedal signal generator 820 which controls the pedal signal output bus 822, which is connected to a pedal frequency divider (not shown) and to gates 1248 and 1252 (see FIG. 13).

In the Normal Organ mode, the outputs from the microprocessor 30 on output lines 58, 60, 62 and 64 interrogate the pedal keyswitches 766 in three groups of four and one group consisting of the keyswitch 792 (keyswitch 792 corresponds to the C25 key 791 in FIG. 9). The outputs from the microprocessor 30 control the sequence of interrogation of the pedal switches 766 starting with the lowest group, that is, with keyswitches 768, 770, 772 and 774. Thus, when a positive pulse is supplied from output line 58, a positive pulse will be applied to the K input line 76 if the pedal keyswitch 768 is closed by depressing pedal 767 (see FIG. 9). Similarly, positive pulses will be applied to input lines 78, 80 and 82 from output line 58 if the pedal keyswitches 770, 772 and 774, respectively, are closed by playing keys 769, 771 and 773, respectively (see FIG. 9). The rest of the pedal keyswitches 766 are similarly interrogated by outputs 60, 62 and 64 from the microprocessor 30. When a depressed pedal key 767 through 791 (see FIG. 9) is detected on one of the input lines 76, 78, 80 or 82, the microprocessor 30 skips the interrogation of the remaining keyswitches 766. Thus, the microprocessor 30 always selects the lowest pedal key being depressed in this embodiment.

Depending upon which pedal 767 through 791 is depressed, one of the outputs 58 through 64 from microprocessor 30 will be transferred to one of the inputs 76, 78, 80 or 82. The information supplied to inputs 76, 78, 80 or 82 is then interrogated by the microprocessor 30. The logic levels of outputs 58 through 60 are set by the microprocessor 30 to correspond to a specific address, which, at the time of the "L" to "H" transition of a signal on $R_5$ output 44 from the microprocessor 30, will be transferred via latch 824 as the four-bit address for tone multiplexers 862 and 890. Latch 824 can be a commercially available CMOS 40174 D-type flip-flop.

The microprocessor 30, in addition to determining the pedal played when in the Normal Organ mode, also generates a four-bit binary code corresponding to the pedal tone to be generated in response to the playing of a pedal when in the Normal Organ mode with no automatic rhythm pattern selected. If an automatic rhythm pattern is selected, the four-bit code corresponds to the frequency of the pedal tone called for by a selected rhythm pattern, whether in the Normal Organ or Easy Play mode. The binary code is applied to programmable pedal signal generator 820 via inputs 830, 832, 834 and 836 of latch 824. Tone multiplexers 862 and 890 can be commercially available CMOS 4512, eight-input multiplexers. Three output bits from latch 824 control the three select lines of tone multiplexers 862 and 890 and the fourth output bit from latch 824 controls the output enable of tone multiplexer 890 and the output enable of tone multiplexer 862 through an inverter 914. The four-bit address is provided by latch 824 on outputs 840, 842, 844 and 846. Output 850 selects the appropriate tone multiplexer 890 or 862, since when output 850 is at the logical "H" level, tone multiplexer 890 is enabled by applying the "H" signal to input 904, and when output 850 is at the logical "L" level, a logical "H" signal is applied to input 876 via the inverter comprised of NOR gate 914, which inverts the signal from output 850, thus enabling tone multiplexer 862. When tone multiplexer 862 is enabled, outputs 844, 846 and 848 of latch 824 gate one of the signal inputs 916 through 926 applied to terminals 864 through 874, respectively, of tone multiplexer 862 to the output 888 as a 2′ pedal pitch signal. When tone multiplexer 890 is enabled, outputs 844, 846 and 848 of latch 824 gate one of the signal inputs 928 through 938 applied to terminals 892 through 902, respectively, of tone multiplexer 890 to the output 912 as a 2′ pedal pitch signal. The 2′ pedal pitch signal is divided by flip flop 944 to provide a 4′ pedal pitch signal on output 946. The 4′ pedal pitch signal from output 946 is divided again by flip flop 948 to provide an 8′ pedal pitch signal at output 950. The signals on $R_0$ latch line 34 and $R_1$ latch line 36 from microprocessor 30 are transferred through latch 824 as outputs 840 and 842, respectively, and control the octave of the pedal tone to be generated by programmable pedal signal generator 820. Output 840 of latch 824 is applied via line 841 to one input to NAND gate 956 and a first input to NOR gate 976; output 842 is applied via line 843 to one input to NAND gate 954 and to a second input to NOR gate 976. The output of gate 954 is applied to input 960 of NAND gate 958 via line 955, and the output of gate 956 is applied to input 962 of NAND gate 958 via line 957. The output of gate 958 is applied to one input 966 of NOR gate 964. The signal on output 972 of gate 964 is applied to the pedal signal output bus 822 via resistor 974. When neither the 2′ pedal pitch gate 954 nor the 4′ pedal pitch gate 956 is enabled by outputs 840 and 842 from logic circuit 824, the 8′ pedal pitch gate 982 is enabled by applying the signal from the output 978 of NOR gate 976 to the input 980 of gate 982. The 8′ pedal pitch signal from output 950 is applied via line 951 to the other input 984 of NAND gate 982. The output 986 of gate 982 is then applied to the pedal signal output bus 822 via NOR gates 988 and 964 and resistor 974. Thus, the pedal signal and pitch selection is accomplished as illustrated in the pedal signal detection chart in FIG. 12.

After the microprocessor 30 has interrogated the pedal keyboard switches 766 to determine the lowest pedal note played and provided the proper frequency to the pedal signal output bus 822 as described above, a ten millisecond pedal trigger pulse is generated for the actuation of a tone generator (not shown). With reference to FIG. 6, at the time of a positive transition of a signal from the microprocessor 30 on $R_2$ latch line 38, which is applied to input 666 of latch 656, the output levels on $R_0$ latch line 34, $O_2$ output line 62 and $O_3$ *output line* 64 *are latched through latch* 656. *Thus, the output logic level on* $R_0$ latch line 34 provides a ten millisecond pedal trigger pulse at output 678 of latch 656, which is applied to a pedal trigger bus 679. The logic level on $O_3$ output line 64 provides a signal at output 676 of latch 656 at the "L" logic level when all the pedal keyboard switches 766 are off, and at the "H" logic level when a pedal keyboard switch 766 is on. The output 676 is connected to a pedal note played bus 681. A positive pulse supplied on $O_2$ output line 62 and appearing at output 682 of latch 656 is inverted by transistor 690 to provide the complement of the logic level on $O_2$ output line 62 on complement damp line bus 683.

Figure 10:
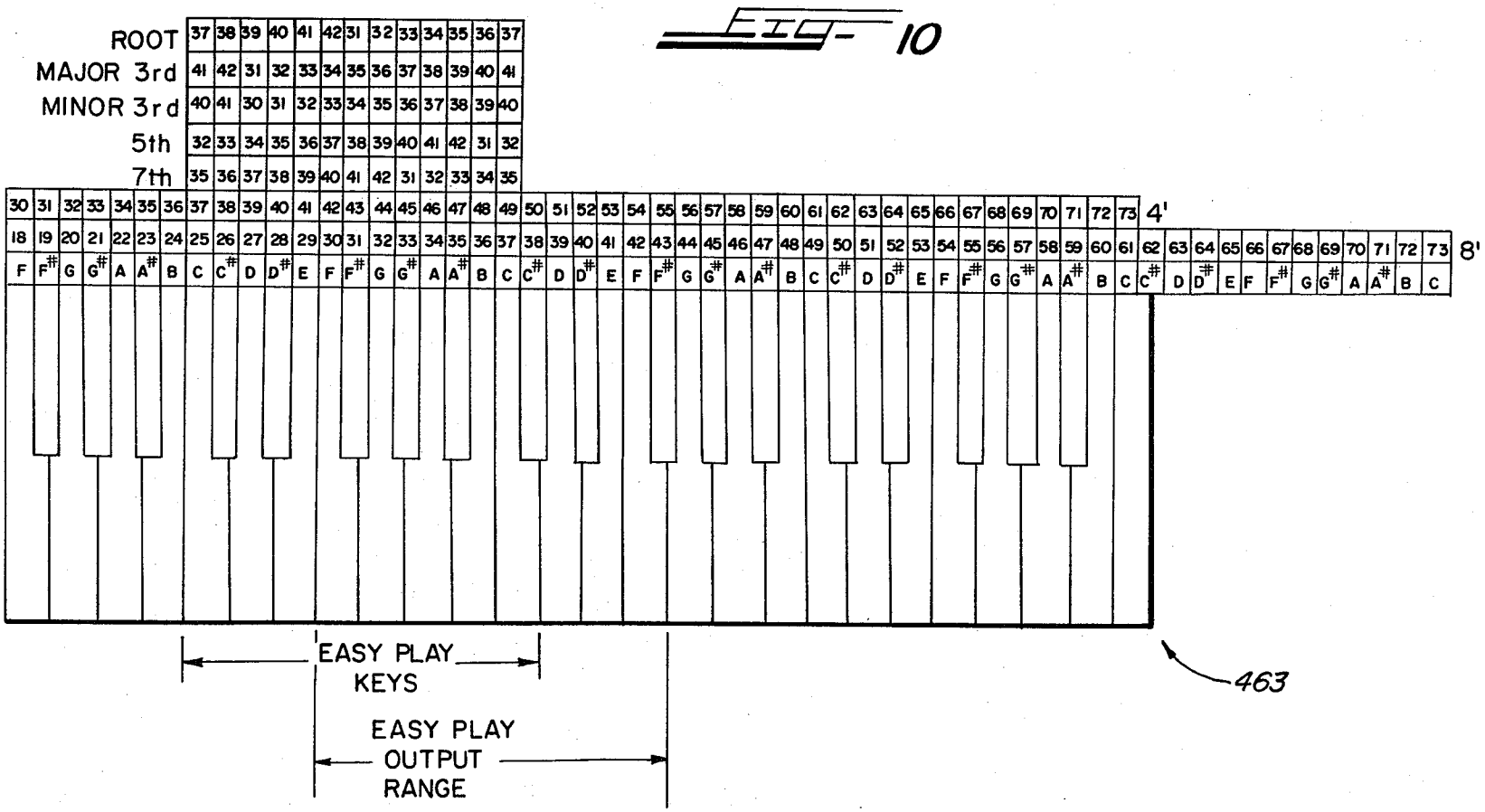
FIG. 10 is a diagram illustrating the accompaniment keyboard of the present invention.

The automatic bass rhythm feature of the present invention provides automatic bass rhythm accompaniment when the organ is in the Easy Play mode and a key within the Easy Play range (corresponding to notes C25 through C37 on the accompaniment keyboard 463 shown in FIG. 10) is depressed, or when the organ is in the Normal Organ mode and a pedal on the pedal keyboard 764 is depressed. Depending upon which key within the Easy Play range (when in the Easy Play mode) or which pedal (when in the Normal Organ mode) is being depressed and which rhythm pattern switches 212 through 242 are selected, as will hereinafter be discussed in greater detail, the microprocessor 30 selects pedal frequencies alternately by setting the four-bit address provided on output lines 58, 60, 62 and 64. This selection of pedal frequencies is similar to the selection made in the Normal Organ mode discussed above, and is given in the pedal signal detection chart in FIG. 13. The production of the pedal trigger pulse, pedal note played information, and damp information is accomplished in the same way for the Easy Play mode as for the Normal Organ mode.

The present invention provides the capability for remembering the pre-selected bass rhythm accompaniment and chords and repeating them until a different selection is encountered or until the memory defeat kick switch 412D mounted on the expression pedal of the organ is actuated. That is, in the Easy Play mode the automatic bass rhythm is started by playing a key within the Easy Play range and the rhythm continues until the memory defeat kick switch 412D is closed. Also, in the Easy Play mode the seventh chords are sounded until another note is played or memory defeat kick switch 412D is closed. In the Normal Organ mode, the memory feature causes a pedal played to continue to sound until another pedal is played or memory defeat kick switch 412D is closed. With reference to FIG. 4, when the memory mode is selected by closing switch 412, +15 V is applied from terminal 546 via switch 412 and resistor 540 to input 442 of multiplexer 426. The information that the memory mode has been selected is then passed to the microprocessor 30 as previously described. Utilization of this information by the microprocessor 30 or other equivalent logic control circuitry will be hereinafter described in greater detail.

If memory defeat switch 412D is actuated, +15 V is applied from terminal 431 via switch 412D and resistor 548 to the base of transistor 538, causing transistor 538 to saturate. This causes a low level voltage to appear at the collector of transistor 538 which is passed to input 442 of multiplexer 426, thereby signaling the microprocessor 30 to discontinue the memory function.

When a key in the Easy Play range (keys C25 through C37 as illustrated in FIG. 10) is depressed, the musical instrument must form either a major chord (e.g., C-E-G) or a minor chord (e.g., C-D#-G). This function is controlled by the minor touch strip 408 and the associated circuitry 528, which are known in the prior art, as shown in FIG. 5. When minor touch strip 408 is energized by being touched by the instrumentalist's body, the "H" logic level is applied via circuit 528, output bus 530 and transistor 532 (see FIG. 4) to input 438 of multiplexer 426. When minor touch strip 408 is not actuated, the "L" logic level is supplied via circuit 528, output bus 530 and transistor 532 to input 438 of multiplexer 426. Transistor 532 serves to invert the logic level applied to its base from output bus 530, since when the "L" logic level is applied to the base of transistor 532, transistor 532 is off and a +15 V signal is supplied via resistor 536 to input 438. When the "H" logic level is supplied to the base of transistor 532, transistor 532 saturates causing its collector to be at a low voltage level, thus supplying the "L" logic level to input 438.

The function of the automatic chord feature is to provide the desired distribution of root, third, fifth and seventh parts of a chord upon the actuation of only one key within the Easy Play range when the Easy Play mode has been selected by activation of switch 410. The table contained in FIG. 11 illustrates the chords sounded in response to the various keys within the Easy Play range. Seventh chords are available by actuation of key selection switches 418, 420, 422, 423, 424 and 425, illustrated in FIG. 4. The operation of the automatic chord feature will be described in greater detail hereinafter with reference to FIGS. 16A and 16B.

In the preferred embodiment of the present invention the microprocessor 30 is supplied information as to the on/off state of keyswitches 464 through 488, pedal keyboard switches 768 through 792, minor touch strip 408, Easy Play switch 410, memory switch 412, plain pattern switch 414, fancy pattern switch 416, seventh key selector switches 418 through 425, rhythm start/stop kick switch 431, memory defeat kick switch 412D and rhythm switches 212 through 242. As noted above, in the Normal Organ mode the microprocessor 30 processes this information to operate pedal circuitry, provide ten millisecond pedal trigger pulses on pedal trigger bus 679, provide logic signals on the pedal note played bus 681, provide detection for accompaniment manual 463 playing for keyswitches 472 (E29) through 488 (C37) and corresponding diode gates (not shown) controlled by lines 628 through 644, establish the automatic bass rhythm operation in synchronism with the rhythm patterns and operate the rhythm start/stop bus 54. In the Easy Play mode, the microprocessor 30 establishes the automatic bass rhythm operation and provides the generation of automatic chords.

Figure 13:
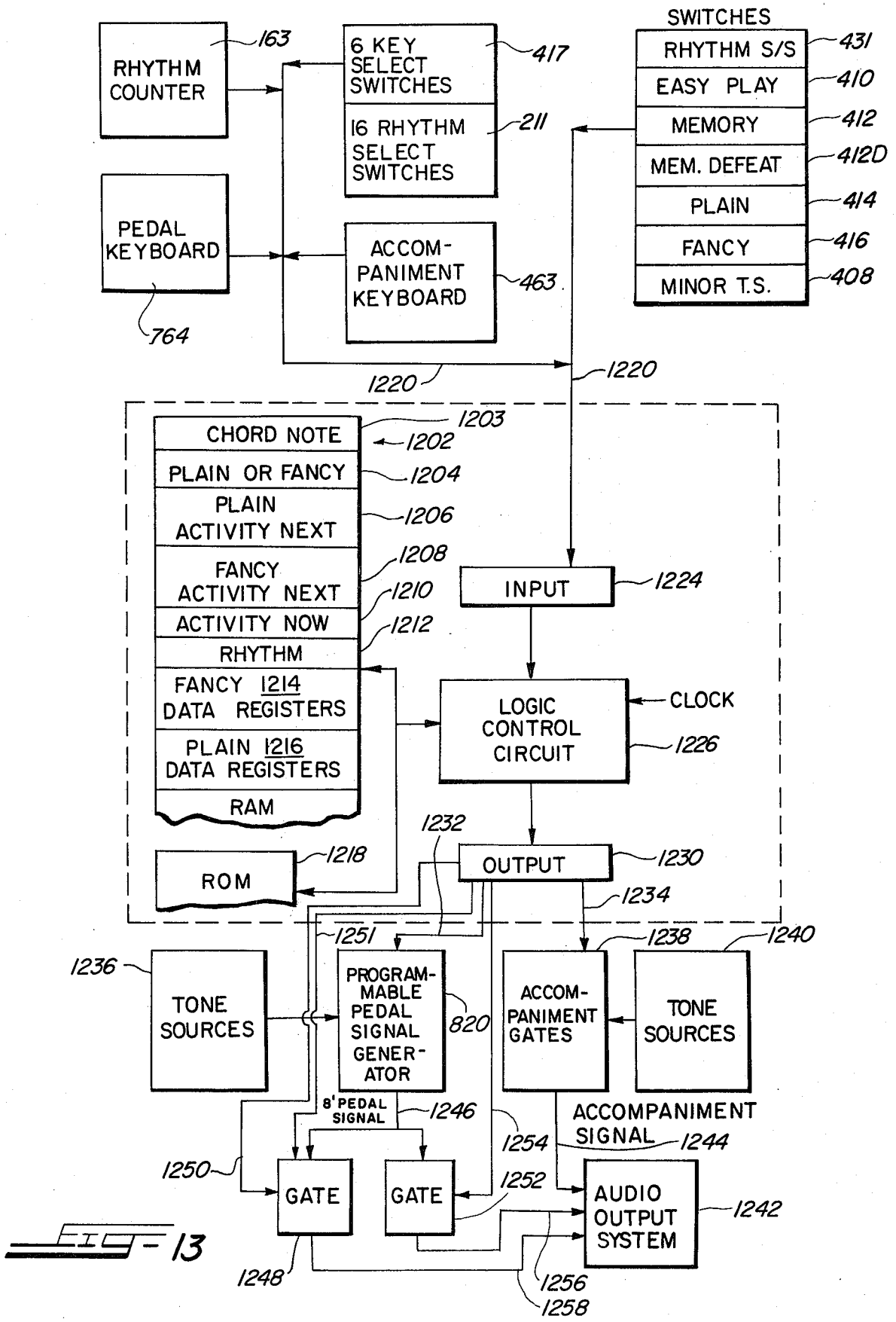
FIG. 13 is a block diagram illustrating the major components and data paths of the present invention.

With reference to FIG. 13, a basic block diagram of the preferred embodiment of the present invention showing the major components and data paths is illustrated. Information as to the on/off state of rhythm start/stop kick switch 431, Easy Play switch 410, memory switch 412, memory defeat switch 412D, plain pattern switch 414, fancy pattern switch 416 and minor touch strip 408 is provided to a logic control circuit 1226 via input data path 1220 and input data bus 1224. The count from rhythm counter 163, information as to which pedals on pedal keyboard 764 are being depressed, information as to which keys on accompaniment keyboard 463 are being depressed, information as to the on/off state of the sixteen rhythm switches 211 (i.e., rhythm switches 212 through 242) and information as to the on/off state of the six key selector switches 417 (i.e., switches 418 through 425) are supplied to logic control circuit 1226 via input data path 1220 and input data bus 1224. The data supplied to logic control circuit 1226 from plain switch 414 and fancy switch 416 is stored in a random access memory (RAM) 1202 in a PLAIN OR FANCY register 1204; and data supplied from the sixteen rhythm switches 211 is stored in a RHYTHM register 1212. In generating the various output signals which control a programmable pedal signal generator 820, gate 1248, gate 1252 and accompaniment gates 1238, for each sixteenth beat logic control circuit 1226 obtains from a read only memory (ROM) 1218 data used to produce the control outputs. The data obtained from ROM 1218 is stored in registers in RAM 1202 (e.g., PLAIN ACTIVITY NEXT register 1206, FANCY ACTIVITY NEXT register 1208, ACTIVITY NOW REGISTER 1210, FANCY DATA registers 1214, and PLAIN DATA registers 1216) during each sixteenth beat, as will hereinafter be described in greater detail. Six bits of data supplied via output data path 1232 to programmable pedal signal generator 820 control the note and octave of the 8′ pedal signal out generated by generator 820 from tone sources 1236. Bits of data supplied via output data path 1234 control the note and octave of the accompaniment signal to sound notes within the range of the accompaniment manual. The 8′ pedal signal from programmable pedal signal generator 820 is supplied to gates 1248 and 1252. Gate 1248 is controlled by pedal trigger pulses PT on line 1250, which initiate tones by charging a capacitor (not shown) in the circuitry of gate 1248 rapidly bringing the pedal tone up to volume by passing the 8′ pedal signal to the audio output system 1242 via line 1258. Tones produced by the output of gate 1248 are damped in response to DO signals applied to gate 1248 via line 1251. When DO is in the logical "H" state, the output from gate 1248 is caused to decay more rapidly than it normally does following each ten millisecond PT pulse. Gate 1252 is controlled by signal PP supplied via line 1254; PP is equal to one or a logical "H" when a pedal or key has been played or remembered. Gate 1252 provides an output tone signal to audio output system 1242 via line 1256 whenever PP is in the logical "H" state, which charges a capacitor (not shown) in the circuitry (not shown) of gate 1252. The 8′ pedal signals from gates 1248 and 1252 and the accompaniment signal from accompaniment gates 1238 are applied to audio output system 1242, which outputs audible tones and chords. In the preferred embodiment, the portion of the apparatus encompassed within the dashed lines can be a microprocessor 30, another type of processor, or conventional logic circuitry arranged to perform the logic functions illustrated by the flow diagrams in FIGS. 15A–H and 16A–B.

FIGS. 15A, 15B, 15C, 15D, 15E, 15F, 15G and 15H, taken together, contain a general flow diagram illustrating the control routine performed by the present invention for the automatic control of chords and sequences in an electronic musical instrument, such as an organ. In the preferred embodiment this control routine is implemented in the form of microprocessor 30; however, this control routine could also be implemented by using other conventional digital electronic circuitry.

When the power to the organ is first turned on, a number of parameters are initialized in block 1000 so that no sounds come from the instrument before the instrumentalist plays a key or operates rhythm start/stop kick switch 431. With reference to FIG. 1, when a positive pulse is applied to initializing input 92 of microprocessor 30, R outputs $R_0$ through $R_{10}$ and O outputs $O_0$ through $O_7$ are automatically set to zero by microprocessor 30. The negative pulse supplied by inverter 98, as discussed above, disables the input buffer comprised of AND gates 100, 102, 104 and 106 thereby applying logical zero or "L" to K inputs $K_1$, $K_2$, $K_4$ and $K_8$ during the initializing pulse. Thus, microprocessor 30 begins execution of the control routine at block 1000 at the proper predetermined location in the ROM.

Initializing block 1000 sets the parameters T (trigger signal desired), D (damping desired), PP (note confirmed or remembered), DO (damping signal), F3 (note F30), E3 (note E29), S (new note detected), AR (enable rhythm counter), PPN (note played just detected) and RKS (RKS corresponds to the on/off state of rhythm start/stop kick switch 431) to zero and sets outputs $R_2$ through $R_7$ to one. The foregoing parameters will be discussed in greater detail hereinafter. By setting outputs $R_2$ through $R_5$ to one, latches 656, 694, 726 and 824 are all set to zero. Setting $R_6$ and $R_7$ equal to one sets the outputs of decoders 316B and 316, respectively, to zero. The internal count CN maintained by the control routine is set to zero in block 1002. In block 1004, output $R_8$ to the rhythm start/stop bus 54 (see FIG. 1) is set equal to AR. Thus, the value of AR controls the rhythm counter 163 (see FIG. 13) AR is equal to one if the rhythm counter is to be enabled and is equal to zero if the rhythm counter is to be reset. AR normally has been changed by the instrumentalist operating the rhythm start/stop kick switch 431 when in the Normal Organ mode. In the Easy Play mode, when the memory mode has not been selected by actuating memory switch 412, AR is set equal to PP in blocks 1156 and 1154 (see FIG. 15H). This latter operating condition is referred to herein as the Touch Rhythm mode, in this mode the rhythm counter runs while a key within the Easy Play range (C25 through C37) is depressed. Block 1004 also sets NR equal to zero when all the conditions for playing pedal patterns have been met. Thus, NR is set to zero when the following conditions are met: (1) at least one of the rhythm switches 212 through 242 has been actuated; and (2) either the Easy Play mode has been selected (EP=1) by actuating Easy Play switch 410 and a manual note within the Easy Play range has been confirmed or remembered; or in the Normal Organ mode when the rhythm counter has been enabled (AR=1), either plain switch 414 or fancy switch 416 has been actuated and a pedal note has been confirmed or remembered. Thus, in the Easy Play mode, to cause a pedal pattern to be sounded it is only necessary for a rhythm switch 212 through 242 to be actuated and a note within the Easy Play range to be played or remembered, and the control routine will cause a plain pedal pattern to be sounded if plain pattern switch 414 is actuated or if neither plain switch 414 nor fancy switch 416 is actuated. If the foregoing conditions are not met, no pedal pattern rhythm is desired and NR is set equal zero. It can be seen that in the first cycle of the control routine following the switching on of power to the organ, block 1004 sets $R_8$ equal to zero since AR was set equal to zero in block 1000, and block 1004 sets NR equal to one since PP was set equal to zero in block 1000.

Figure 14:
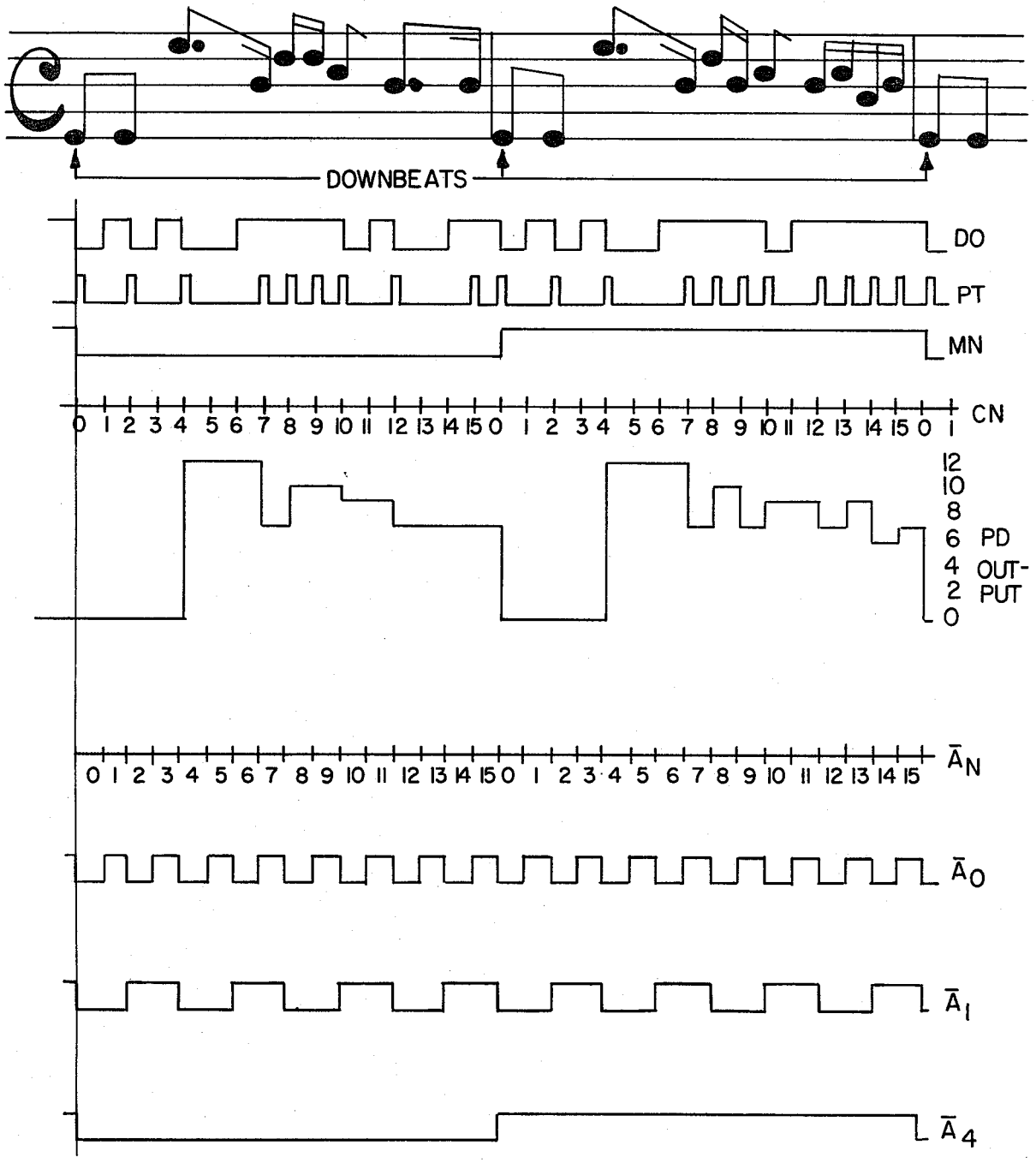
FIG. 14 illustrates the data provided by the preferred embodiment of the present invention for the Soul Rock Rhythm Fancy pedal pattern when the G20 pedal (Normal Organ mode) or the G32 key (Easy Play mode) is played.

From block 1004, the control routine branches to decision block 1006, which determines whether a new note has been played. If a new pedal note is played or (when in the Easy Play mode) a note within the Easy Play range on the accompaniment manual is played, S is set equal to one. If a new note is detected (S=1) the routine branches along path D to block 1042 (see FIG. 15C), which is discussed hereinafter. If no new note is detected (S=0), the routine branches along path A to block 1008 (see FIG. 15B). Block 1008 of the control routine reads the rhythm counter. The control routine keeps the internal count CN (CN=binary "$C_3C_2C_1C_0$") one ahead of the complement of the count of the rhythm counter ($\overline{A}_N=\overline{A}_4\overline{A}_3\overline{A}_2\overline{A}_1\overline{A}_0$) so that the control routine can prepare the data for each rhythm beat one beat in advance. The rhythm counter can be expected either to be reset ($\overline{A}_N=0$) or to be advanced by one every one-sixteenth of a measure (approximately every 15 milliseconds to 250 milliseconds). The relationship between CN and $\overline{A}_N$, as well as among various other parameters to be hereinafter discussed, is illustrated in FIG. 14 for the fancy variation of the Soul Rock rhythm pattern when the G20 pedal (Normal Organ mode) or the G32 key (Easy Play mode) is played.

From block 1008 the control routine branches to decision block 1010 which determines if $\overline{A}_3\overline{A}_2\overline{A}_1\overline{A}_0$ is equal to zero. If $\overline{A}_N$ is equal to zero, the control routine branches to decision block 1012, which determines if CN is equal to one. If $A_N$ is equal to zero and CN is not equal to one, then the rhythm counter has been reset since the interrogation by block 1008 in the previous cycle of the control routine and a downbeat is desired. During the initialization in block 1000, and when the rhythm counter is restarted by actuation of rhythm start/stop kick switch 431, CN is set to zero so that a downbeat occurs. When CN is not equal to one, the control routine branches to block 1014. Block 1014 sets CN equal to one and the measure number ("MN") equal to $\overline{A}_4$ (see FIG. 14). If rhythm is desired (NR=0), block 1014 sets D. D is set equal to one when damping is required on the next rhythm count or beat. Damping is provided before frequency changes so that the change will not be audible. Also, if rhythm is desired, block 1014 sets the pedal frequency deviation ("PD") according to which rhythm pattern selected by actuation of a rhythm switch 212 through 242 has priority, whether fancy switch 416 has been actuated, and the measure number (MN). The desired frequency deviation PD for the downbeat is looked up in a special table, as will hereinafter be described in greater detail. In the preferred embodiment, the frequency deviation PD is always zero for the downbeat of the first measure (MN=0), therefore, it is only necessary to look up the value of PD for the downbeat of the second measure (MN=1). Finally, if rhythm is desired, block 1014 sets T equal to one (T=1 indicates that a ten millisecond trigger pulse on pedal trigger bus 679 (see FIG. 6) is desired on the next rhythm count). From block 1014, the control routine branches along path C to block 1032 (see FIG. 15C), which is discussed hereinafter.

If CN is equal to one indicating that a downbeat is not desired, the control routine branches from block 1012 to decision block 1016 which determines if a new note has been played. S is set equal to one when a new note is confirmed and becomes zero after 10 milliseconds or when a change in the rhythm count is detected. If S is equal to zero, the control routine branches along path B to block 1076 (see FIG. 15E), which is discussed hereinafter.

In block 1010, if the rhythm counter is not reset (i.e., $\overline{A}_3\overline{A}_2\overline{A}_1\overline{A}_0$ does not equal zero), the control routine branches to decision block 1022 which determines if the least significant bit of $A_N$ matches the least significant bit of CN (i.e., $C_0=\overline{A}_0$). If the least significant bit of $\overline{A}_N$ matches the least significant bit CN and the rhythm counter has not been reset, the rhythm count has advanced by one and it is desirable to produce a tone or damp for the present value CN according to the rhythm pattern. The values of T, D and PD were stored in registers immediately after the previous sixteenth beat, therefore, CN can be incremented by one in block 1030 in preparation for the next look-up operation, which is described hereinafter. From block 1030, the control routine branches along path C to block 1032 (see FIG. 15C), which is described hereinafter. The downbeat look-up operation just described is performed at this point in the control routine because a downbeat can occur unexpectedly in either the Touch Rhythm mode by the playing of a key or in the $\frac{3}{4}$ time mode where the rhythm counter $\overline{A}_3\overline{A}_2\overline{A}_1\overline{A}_0$ skips the fourth quarter of the measure and jumps from eleven to zero.

When the rhythm counter is operating at maximum speed, it is possible that after a full cycle of the control routine (approximately 25 milliseconds) the rhythm counter may have advanced by two counts so that $\overline{A}_3\overline{A}_2\overline{A}_1\overline{A}_0$ is one count ahead of CN. This condition is detected in decision block 1024, which determines whether $\overline{A}_1\overline{A}_0$ is equal to $1+C_1C_0$. If block 1024 determines that $\overline{A}_1\overline{A}_0$ is not equal to $1+C_1C_0$, CN is still one count ahead of $\overline{A}_3\overline{A}_2\overline{A}_1\overline{A}_0$ and the control routine branches to decision block 1016 and proceeds as discussed. If $\overline{A}_3\overline{A}_2\overline{A}_1\overline{A}_0$ has advanced by two bringing it one ahead of CN, the control routine branches to decision block 1026 which determines whether $A_3A_2A_1A_0=1$ and $C_1C_0=0$. If the condition tested in block 1026 exists, the control routine branches to block 1014 and proceeds as discussed above, since for the CN equal to one count there is no data (as will be discussed in greater detail hereinafter) and it is possible to catch up without skipping any portion of the control routine. If the condition tested in block 1026 does not exist, the control routine branches to block 1028, which sets a flag U equal to one. CN is then incremented by one in block 1030. Later in the control routine the flat U equal to one causes a large portion of the control routine to be by-passed so that CN can eventually get ahead of the rhythm counter by one count again. The by-passed part of the control routine includes reading most of the keyswitches and other switches; however, the delay in reading these is not objectionable. Also, the one-sixteenth measure delay of the pedal pattern notes with respect to the drums and other rhythm voices is not noticeable at this fast rhythm speed.

The "nothing changed" condition (the "NO" condition in decision block 1024) causes the control routine to follow path B via blocks 1016, 1018 and 1020 thus bypassing the part of the routine which looks up new values of T, D and PD. This is the case for most operating cycles and the control routine branches along path B to block 1076 (see FIG. 15E), which will be discussed below. However, if a new pedal note or, when in the Easy Play mode, if a new accompaniment note in the Easy Play range has been played, S is set equal to one (see discussion infra concerning block 1134). As discussed above, when S is equal to one, the control routine loops from block 1016 through block 1018 to block 1008 enough times to cause a five millisecond delay, unless in the meantime a change in the rhythm count is detected by the block 1008.

Figures 15A, 15H:
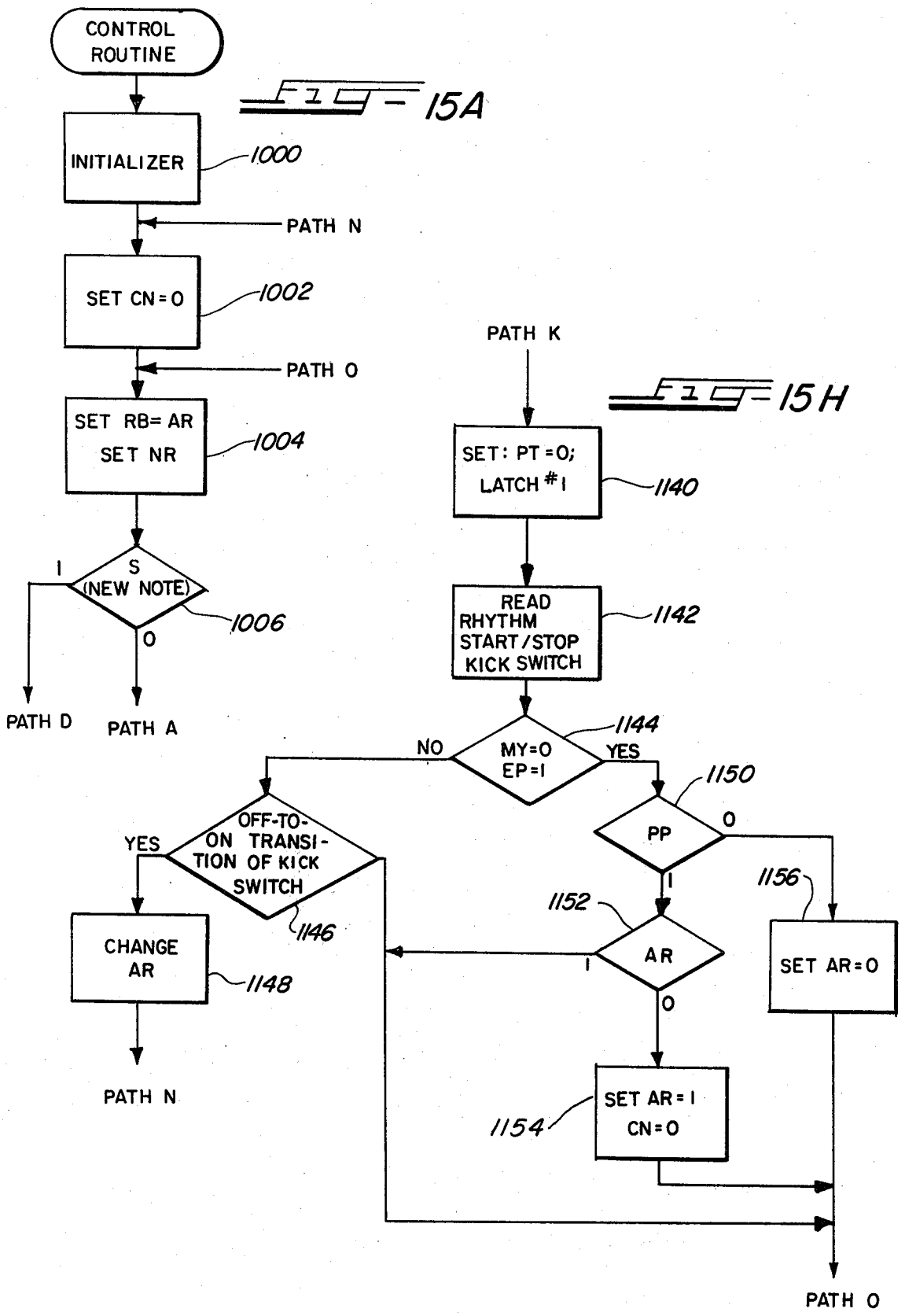
FIGS. 15A, 15B, 15C, 15D, 15E, 15F, 15G and 15H, taken together, are a a flow diagram illustrating the control routine performed by the preferred embodiment of the present invention.
Figure 15B:
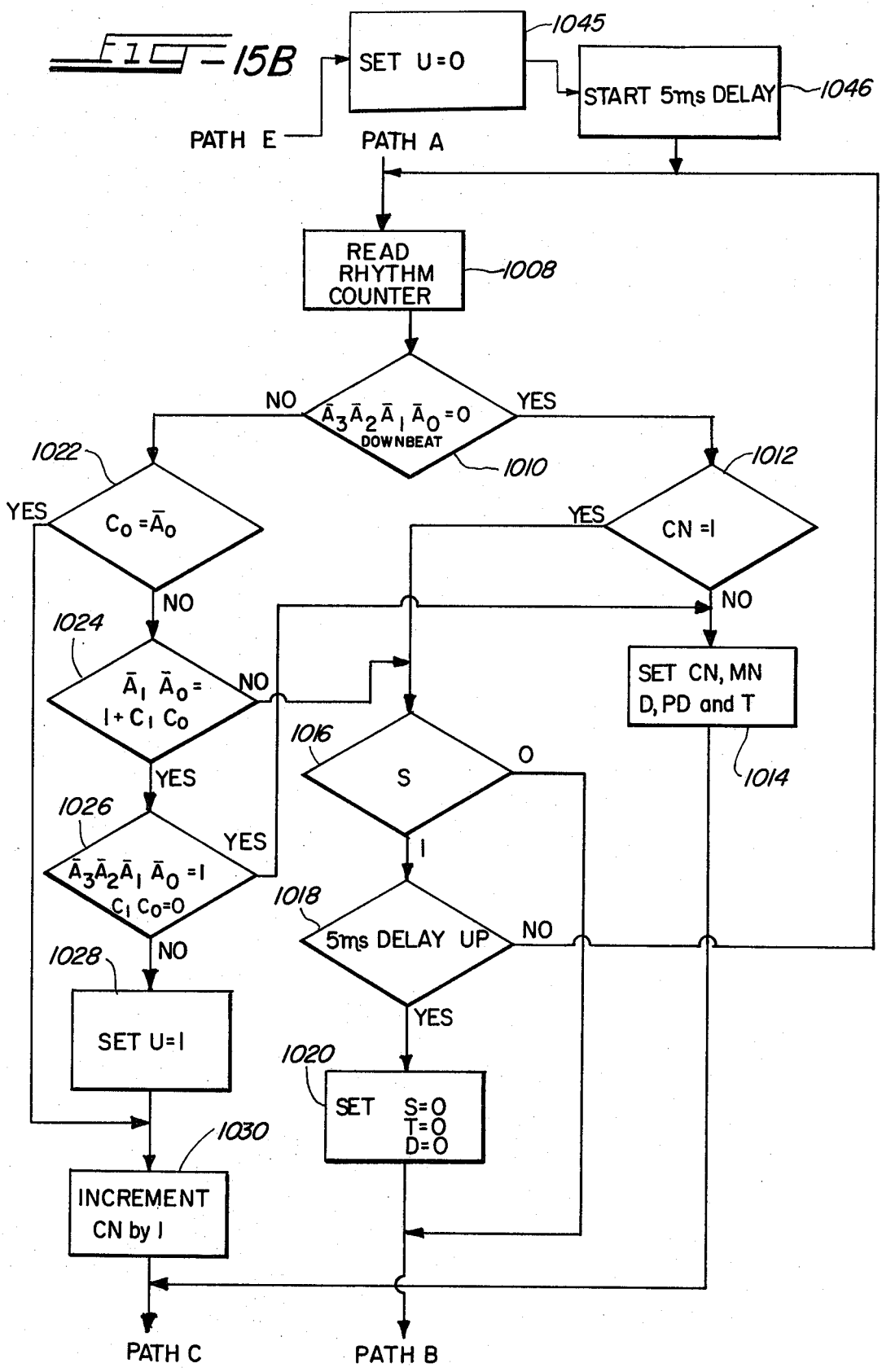
Figure 15C:
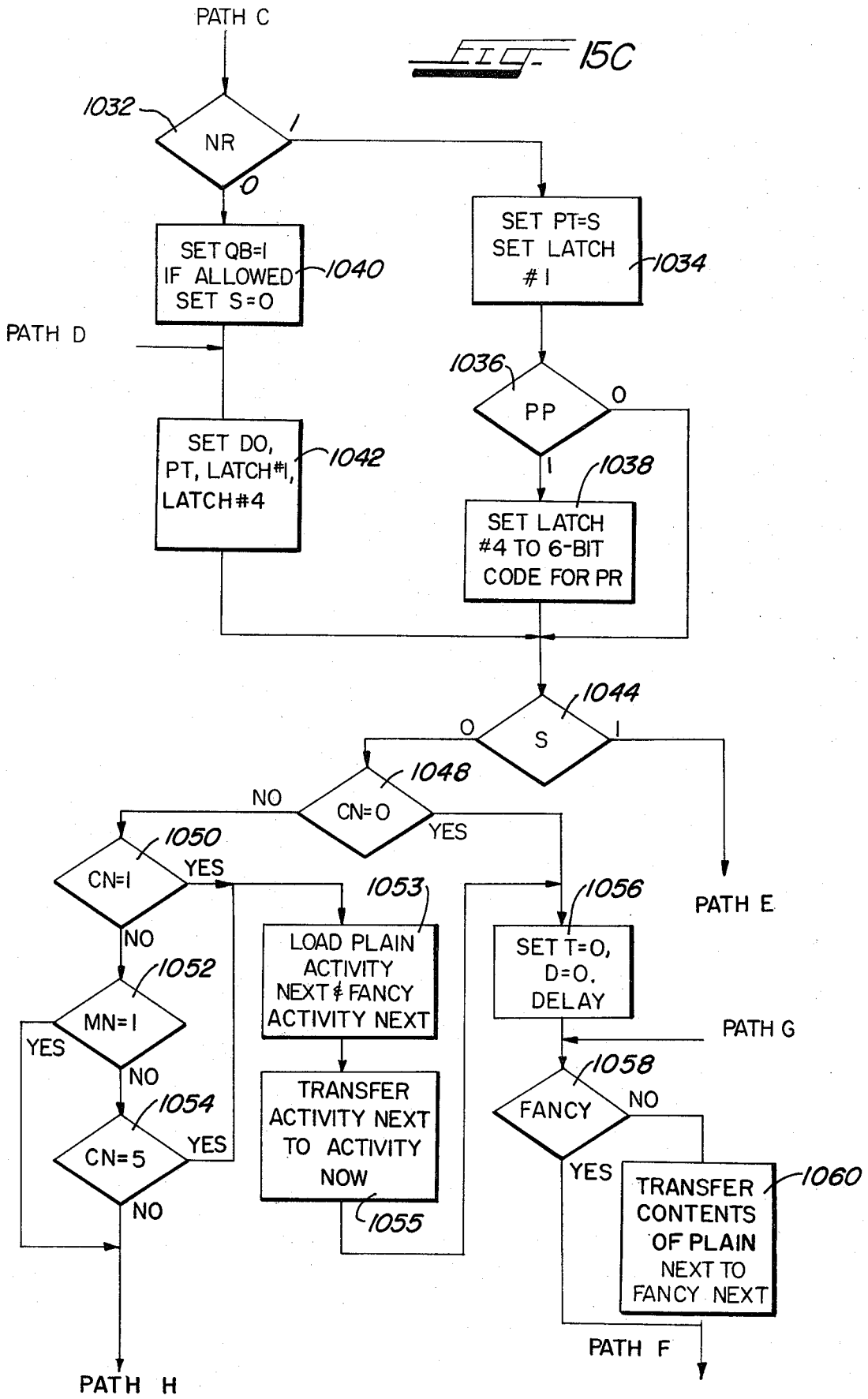

With reference to FIG. 15C, if the rhythm count has changed the control routine branches from block 1030 or block 1014 along path C to decision block 1032 which checks to determine whether a rhythm pattern is desired. If no rhythm pattern is desired, NR will be equal to one and the control routine branches to block 1034 and sets latch 656. Block 1034 will cause a pedal trigger pulse (PT=1 on line 679 in FIG. 6) only in the case where a new note has been played (S=1) since it sets PT equal to S. If a pedal note or a manual note within the Easy Play range is being held or remembered, PP is equal to one and the control routine branches from decision block 1036 to block 1038. Block 1038 sets latch 824 (see FIG. 3) according to the six-bit code for PR (i.e., the pedal frequency is set to normal). PR is the frequency of the confirmed note being played. If NR suddenly becomes equal to one by the instrumentalist turning off the rhythm (by means of Rhythm Start/Stop kick switch 431) or by switching off all the rhythm switches 212 through 242, then a pedal tone (decaying or steady) will have the normal frequency instead of the frequency required by the rhythm pattern. For example, if the rhythm were turned off in the middle of a measure in FIG. 14, the frequency would suddenly shift to low G. From block 1038 the control routine branches to block 1044, which will be discussed below. If PP is not equal to one, indicating that no manual note within the Easy Play range and no pedal note is being held or remembered, the control routine branches directly from block 1036 to block 1044.

In block 1032, if a rhythm pattern is desired (NR=0), then QB is set in block 1040. QB determines whether the frequency deviation PD previously computed is to be used. QB is set equal to zero in block 1134 (see FIG. 15G) when a new note is confirmed and remains zero for one-eighth to three-eighths of a measure at which time QB becomes one on a quarter note beat. That is, QB becomes one on the first quarter note ($C_1C_0=1$) after QA has been set to one on an in-between eighth note ($C_1C_0=3$). QA is also set to zero in block 1134 (see FIG. 15G); therefore QB will be zero and no pedal pattern pitches produced until the note has been played at least one-eighth measure. Sometimes the delay is up to three-eighths of a measure if the quarter note beat does not occur until then. This allows an instrumentalist to play his own rhythm patterns if he plays fast enough and, when he gets tired, to produce the automatic rhythm pattern by holding one key down. That is, the pedals can be played without effectuating the automatic rhythm by playing fast enough to keep QB equal to zero. In that case, block 1042 functions in the same manner as blocks 1034 and 1038 when PP is equal to one.

From block 1040 the control routine branches to block 1042; if a new note has just been played (S=1) the control routine can also branch to block 1042 from block 1006 (see FIG. 15A), as discussed above, without regard to whether a pattern is desired (NR=0) or to whether the rhythm count has changed. A number of parameters are determined in block 1042. The pedal note frequency ("PNF") is the desired frequency in semitones above the lowest C and is equal to PR+(QB) PD. The actual damping voltage DO on output 682 of latch 656 in FIG. 6 is equal to the product of D multiplied by QB. The trigger voltage PT (on pedal trigger bus 679 in FIG. 6) is equal to the result of performing a logical OR operation on T and S. PR is set in block 1134 (see FIG. 15G) and corresponds to the number of semitones the lowest pedal note, or accompaniment manual note within the Easy Play range, is above low C. These parameters are set in block 1042 based upon the previous computation of PD, D T, QB and PR. These values are outputted via latches 656 (see FIG. 6) and 824 (see FIG. 3); the values for E29, F30 and PP are also outputted at this time on outputs 674, 676 and 680 of latch 656. Outputs $Q_2$ through $Q_5$ of latch 824 provide a four-bit code which identifies the note within the octave, and the two bits $Q_0$ and $Q_1$ identify the octave. These codes are obtained by dividing PNF by twelve; the whole number quotient is the value for $Q_0$ and $Q_1$, and the remainder is used to obtain the four-bit code, i.e., the result is output on $Q_0$ and $Q_1$ of latch 824, and the remainder is used to obtain a four-bit code from a table (in ROM) which is outputted on $Q_5$, $Q_4$, $Q_3$ and $Q_2$. If a new note has just been played (S=1), there is no damp and PD is disregarded in block 1042 since QB is equal to zero.

The control routine branches from block 1042 to block 1044 which determines whether a new note has just been played (S=1). If a new note has just been played, the control routine branches along path E to block 1046 (see FIG. 15B). Block 1046 starts a five millisecond delay by setting a counter so that it loops through block 1008 and block 1018 a predetermined number of times providing that the rhythm count does not change. The purpose of the delay is to assure that PT will not be set to zero for at least ten milliseconds, thereby insuring that the trigger pulse is at least ten milliseconds long. After the five millisecond delay, S is set equal to zero in block 1020 (see FIG. 15B) and the control routine branches along path B to block 1076 (see FIG. 15E). If a change in the rhythm count is detected during the five millisecond delay and a rhythm pattern is desired (NR=0), then the control routine branches out of the loop via block 1014 or 1030 and follows path C to block 1032 (see FIG. 15C) which then causes the control routine to branch to blocks 1040 and 1042 where S is set equal to zero and the trigger pulse is stretched another ten milliseconds for a new sixteenth beat.

Figure 15D:
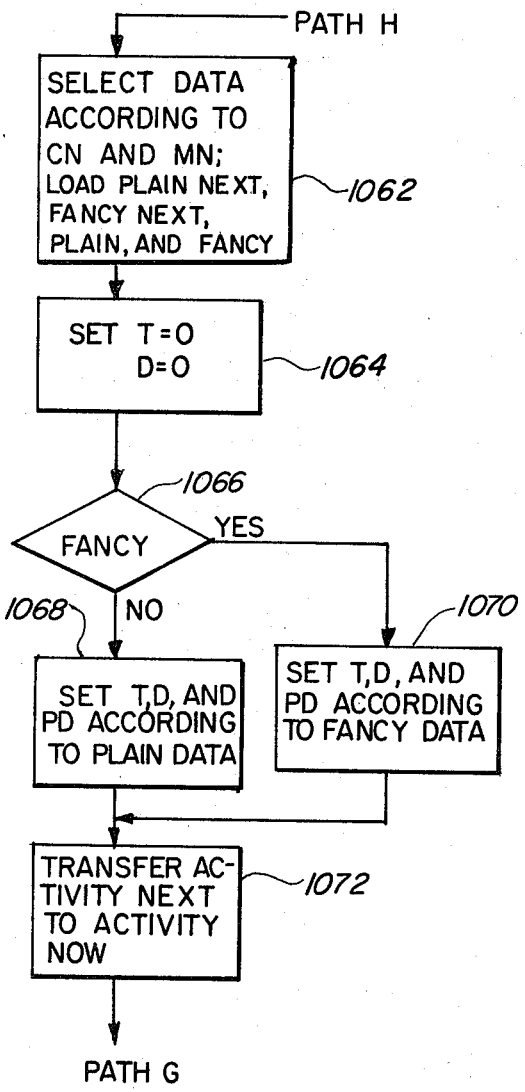

If a change in the rhythm count has been detected and the desired trigger, damp and frequency deviation have been outputted by block 1042, then the T, D and PD values for the next sixteenth beat are obtained via path H which branches to block 1062 (see FIG. 15D). When S is not equal to one the control routine branches from block 1044 to decision block 1048. In the preferred embodiment, it happens that no data is needed for the sixteenth beats corresponding to CN equal to zero (the first sixteenth beat of a measure) in either the first or second measure or for the sixteenth beats corresponding to CN equal to 1 or 5 (the second and sixth sixteenth beats) in the first measure of all the rhythm patterns (the rhythm patterns are two measures long, i.e., they repeat every two measures). Therefore, in these cases the control routine branches to path F rather than to path H. Thus, block 1048 determines whether CN is equal to zero and, if it is, branches to block 1056. If CN is not equal to zero, the control routine branches to block 1050 which determines whether the measure number MN is equal to zero. The measure number MN is equal to zero during the first measure of each rhythm pattern and is equal to one during the second measure of each rhythm pattern. If the measure number is not equal to zero, the control routine branches from block 1050 along path H. If the measure number is equal to zero, then the control routine determines whether CN is equal to one in block 1052 or to five in block 1054. If CN is equal to one or five, the control routine branches to Block 1053 which loads the PLAIN ACTIVITY NEXT and FANCY ACTIVITY NEXT register, and block 1055 transfers the contents from the PLAIN ACTIVITY NEXT or FANCY ACTIVITY NEXT register (depending upon whether plain or fancy rhythm patterns have been selected) to the ACTIVITY NOW register (see FIG. 13) from blocks 1052 and 1054, respectively, to block 1056 via blocks 1053 and 1055. Block 1053 loads the PLAIN ACTIVITY NEXT and FANCY ACTIVITY NEXT registers and block 1055 transfers the contents from the PLAIN ACTIVITY NEXT or FANCY ACTIVITY NEXT register (depending upon whether plain or fancy rhythm patterns have been selected) to the ACTIVITY NOW register (see FIG. 13). If CN is not equal to one or five, the control routine branches along path H, which will be discussed below. For these sixteenth beats for which there is no T, D or PD data, block 1056 sets T and D equal to zero. In the case where CN is equal to zero, there is a delay until $\overline{A}_3\overline{A}_2\overline{A}_1\overline{A}_0$ is equal to zero before T and D are actually set to zero. The control routine then branches to decision block 1058, which determines whether Fancy rhythm patterns have been selected by actuation of Fancy switch 416. If Fancy patterns have not been selected, the Plain Activity Next data will be transferred to the FANCY ACTIVITY NEXT register by block 1060 to facilitate handling of the data by microprocessor 30. It will be noted that the specific steps followed by microprocessor 30 in implementing the control routine do not form a part of the present invention and will not be described herein. From block 1060 the control routine branches along path F to block 1074 (see FIG. 15E).

Referring to FIG. 15D, path H of the control routine leads to block 1062 which obtains data for T, D and PD corresponding to the values of CN and MN from the program instructions which are stored in the ROM 1218 (see FIG. 13). In the preferred embodiment, the ROM is included in microprocessor 30. In the preferred embodiment also, these instructions are TCMIY instructions (TCMIY is an acronym for "transfer constant to memory and increment the Y register") since there is no direct access to information stored in the memory of the microprocessor 30. As illustrated in Table 4 infra at the end of this Specification, the TCMIY instructions are eight bit instructions that place four bits of information into the internal RAM of microprocessor 30 and then automatically increment the Y address in the RAM.

The data obtained from the ROM provides the information needed to provide the bass accompaniment in all of the sixteen rhythm patterns available in the preferred embodiment. The data for the rhythm patterns provided for bass rhythm accompaniment in the present invention is used to sequentialy supply trigger pulses and damp pulses, which are utilized to actuate tone sources and to damp-out tone sources, respectively. The rhythm pattern data also allows a frequency deviation PD to be calculated so that the frequency of each rhythm accompaniment note is tonically related to the frequency of the note played.

This data is stored in the ROM of microprocessor 30 in the form of TCMIY instructions for each rhythm pattern to be generated. As noted above, each rhythm pattern is two measures in length (i.e., the rhythm patterns repeat every other measure) with beats occurring as often as each one-sixteenth of a measure. Therefore, T, D and PD information is needed for thirty-two beats for each rhythm pattern. As noted above, however, in the preferred embodiment the first beat of each measure (CN=0) does not require any data, so that only thirty sets of data are actually required for each rhythm pattern. The four bits of the internal count CN plus the one bit for the measure number MN are used to identify the proper set of data from among the thirty-two possible sets or branches of the ROM.

The information stored in each of the branches corresponding to a sixteenth beat is the value of T, D and PD for each of the fourteen rhythms for both the plain and fancy cases. As discussed above with reference to FIG. 2, the sixteen rhythms available are condensed into only fourteen rhythm patterns. This would require a total of 168 bits of storage for each of the branches to store all the possible data. In order to minimize the amount of storage required, however, the preferred embodiment does not store 168 bits of data for each of the branches. This is possible because the rhythm patterns do not require a trigger or damp to occur on every beat. Also, it has been found to be satisfactory to provide a damp automatically one-sixteenth of a measure preceding each trigger; therefore, it is only necessary to specify the triggers and the "special damps" (i.e., damps which do not precede triggers). By using another set of bits called "Activity Next" bits to identify which of the rhythm patterns require trigger or damp activity on each particular sixteenth beat, no trigger and damp information need be stored in the ROM for the rhythm patterns in which no trigger or damp activity is to occur on a particular beat.

In the preferred embodiment, twenty-eight Activity Next bits are used for each of the twenty-seven branches; no data is stored for the five beats corresponding to CN=0 or CN=1 when MN equals 0 or 1, to CN=5 when MN=0 and to CN=15 when MN=1. The twenty-eight Activity Next bits (fourteen for fancy rhythm patterns and fourteen for plain rhythm patterns) show which of the rhythms have activity (a trigger or a special damp) during the next sixteenth beat.

The following Table 1 illustrates the TCMIY instructions containing the Activity Next bits for the sixteenth beat corresponding to MN equal to 1 and CN equal to 3:

TABLE 1

| Y Register | TCMIY Instruction | Activity Next Bits | | | |
|---|---|---|---|---|---|
| 2 | KKKK1011 | 1 (Soul Rock) | 0 (Pop Rock) | 1 (Shuffle) | 1 (Swing) |
| 3 | KKKK0001 | 0 (Rhumba) | 0 (March) | 0 (Waltz) | 1 (Teen Beat) |
| 4 | KKKK1000 | 1 (Samba) | 0 (Bolero) | 0 (Bossa Nova) | 0 (Tango) |
| 5 | KKKK0000 | 0 (Cha Cha) | 0 (Polka March & Fox Trot) | 0 (Cha Cha & Polka March) | 0 (Fox Trot) |
| 6 | KKKK1011 | 1 (Soul Rock) | 0 (Pop Rock) | 1 (Shuffle) | 1 (Swing) |
| 7 | KKKK0000 | 0 (Rhumba) | 0 (March) | 0 (Waltz) | 0 (Teen Beat) |
| 8 | KKKK1000 | 1 (Samba) | 0 (Bolero) | 0 (Bossa Nova) | 0 (Tango) |

This set of instructions and the associated Activity Next data is typical of that utilized in the preferred embodiment of the present invention for each of the twenty-seven branches for which Activity Next data is required to point to plain and fancy data for the sixteenth beat. The first four bits of each TCMIY instruction are "0110" and merely identify the instruction as being of the TCMIY type (these bits are identified as "KKKK" in Table 1 to indicate that they are constant for every TCMIY instruction). It will be noted that the seven instructions contain twenty-eight bits, which are the Activity Next bits for that count. The fourteen bits above the two horizontal lines are the Fancy Activity Next bits, and the fourteen bits below the two horizontal lines are the Plain Activity Next bits. The rhythm(s) to which each Activity Next bit corresponds is shown immediately below each bit. The relative location of the bits corresponding to the various rhythms remains constant for every count; thus, for example, the least significant bit of the third TCMIY instruction is always the Activity Next bit for the Fancy Tango rhythm pattern. The "Y-Register" column in Table 1 identifies the y coordinate in the RAM into which the associated TCMIY instruction for the present count has been loaded from the ROM.

The Activity Next bits are transferred from the Activity Next register to another register in the RAM called the "Activity Now" register where they are used during the next sixteenth beat to determine which rhythms the rest of the data in the RAM applies to.

The rest of the data placed into the RAM by the TCMIY instructions is the actual frequency deviation PD and special damp information for each rhythm pattern having activity next for the corresponding sixteenth beat. Table 2 illustrates the TCMIY instruction which supplies the plain data for the same count as the corresponding Activity Next bits in Table 1, and Table 3 illustrates the TCMIY instructions which supply the fancy data for the same count as the corresponding Activity Next bits in Table 1. The plain and fancy data for each sixteenth beat corresponds to the Activity Now bits, which are the Activity Next bits from the previous beat.

TABLE 2

| Y Register | TCMIY Instruction | Plain Data |
|---|---|---|
| 9 | KKKK1111 | 1 1 1 1 |

TABLE 3

| Y Register | TCMIY Instruction | Fancy Data | | | |
|---|---|---|---|---|---|
| | | Damp | | Coded PD | |
| 0 | KKKK1101 | 1 | 1 | 0 | 1 |
| 1 | KKKK1110 | 1 | 1 | 1 | 0 |
| 2 | KKKK0111 | 0 | 1 | 1 | 1 |
| 3 | KKKK1110 | 1 | 1 | 1 | 0 |

The number of bits required for this portion of the information varies from beat to beat. On the average only slightly more than twenty-two bits are filled up with this information from the TCMIY instructions because 73 percent of the beats for the various rhythm patterns have no triggers or special damps, and the frequency deviation does not have to be specified in such cases since it remains constant between triggers. In the preferred embodiment, the plain rhythm patterns require only two bits of data because the frequency deviation PD can take on only one of three values (0, 7 or 12) and a special damp is never present on top of a trigger. It will be noted that Table 2 contains four bits of plain data providing information for two rhythms. The two rhythm patterns to which the four bits correspond are identified by two Activity Now bits equal to one, as will be described in greater detail hereinafter. A damp by itself does not require a frequency deviation value. No T, D or PD information is required if neither a trigger nor a special damp is required. The fancy rhythm patterns require three bits to specify the triggers and the frequency deviation PD, which can take on one of the seven values (0, 5, 6, 7, 9, 10 or 12). A fourth bit is used for the fancy rhythm patterns to show the presence of a special damp, which in the fancy rhythm case can be on top of a trigger (to simulate a guitar string being damped while being played). In Table 3 the sixteen bits of fancy data correspond to four rhythm patterns identified by the four Activity Now bits equal to one, as will hereinafter be described in greater detail. In the preferred embodiment, the most significant bit of data determines whether there is a special damp (i.e., a damp that does not preceed a trigger pulse by one beat). Thus, in Table 3 a special damp is specified for the first, second and fourth rhythm patterns having activity on the sixteenth beat to which the data corresponds. In this embodiment, PD is determined from the three least significant bits of data: if the three bits are equal to six, there is no trigger and no value for PD; if the three bits are equal to three, PD is equal to zero; and otherwise PD is equal to the decimal equivalent of the three bits plus five. In Table 3, therefore, for the first rhythm pattern PD is equal to ten, for the third rhythm pattern PD is equal to twelve and there is no PD value for the second and fourth rhythm patterns having activity on the sixteenth beat to which the data corresponds. The twenty-seven branches of data for T, D and PD require an average of 11.5 TCMIY instructions each, or an average of 46 bits of information to be stored.

FIG. 14 illustrates PT, DO and PD for a typical rhythm pattern (fancy Soul Rock rhythm) and the time relationships among these values and the CN count. As noted above, PT is the actual ten millisecond trigger pulse at output 678 of latch 656 generated by T, and DO is the actual logic level at output 682 of latch 656 generated by D (see FIG. 6).

Referring to FIG. 15D, path H of the control routine branches to block 1062. Block 1062 selects data from the ROM according to the values of CN and MN for the frequency deviation PD, the triggers T and the damps D required for the next sixteenth beat. Block 1062 loads this data into four registers: BASIC ACTIVITY NEXT; BASIC DATA; FANCY ACTIVITY NEXT; and FANCY DATA.

From block 1062 the control routine branches to block 1064, which sets both T and D equal to zero. Next, decision block 1066 determines whether Fancy rhythm patterns have been selected by actuation of fancy pattern switch 416 (see FIG. 4) by the instrumentalist. If fancy rhythm patterns have been selected, the control routine branches from block 1066 to block 1070 which sets T, D and PD according to the data in the FANCY DATA register. Block 1070 then compares each of the fourteen Activity Now bits corresponding to the fancy rhythm patterns to one. For each Activity Now bit equal to one the control routine steps to the next four bits of fancy data and, if the corresponding rhythm switch information bit is equal to one (indicating the the rhythm pattern has been selected), sets T or D to one according to the four bits of fancy data. Also, if the rhythm has priority (i.e., if the rhythm corresponds to the priority rhythm number PRNO) the frequency deviation PD is set according to the four bits of fancy data. The PD values for both the plain and fancy rhythm patterns not corresponding to the priority rhythm number PRNO are ignored, since the value of the frequency deviation PD is controlled by the priority rhythm when more than one rhythm pattern has been selected simultaneously by actuation of rhythm switches 212 through 242.

If the fancy rhythm patterns have not been selected by the instrumentalist by actuation of switch 416, the control routine branches from block 1066 to block 1068. Block 1068 compares the fourteen Activity Now bits corresponding to the plain rhythm patterns to one. For each Activity Now bit equal to one the routine steps to the next two bits of plain data and, if the corresponding rhythm switch information bit in the RHYTHM register is equal to one (indicating that the rhythm pattern has been selected), sets T or D equal to one according to the two bits of plain data. Also, if the rhythm has priority (i.e., if the rhythm corresponds to the priority rhythm number PRNO) PD is set according to the two bits of plain data. From blocks 1070 and 1068 the control routine branches to block 1072, which transfers the data in the PLAIN ACTIVITY NEXT register and the FANCY ACTIVITY NEXT register to the PLAIN ACTIVITY NOW register and the FANCY ACTIVITY NOW register, respectively. From block 1072 the control routine follows path G to block 1058 (see FIG. 15C).

Figure 15E:
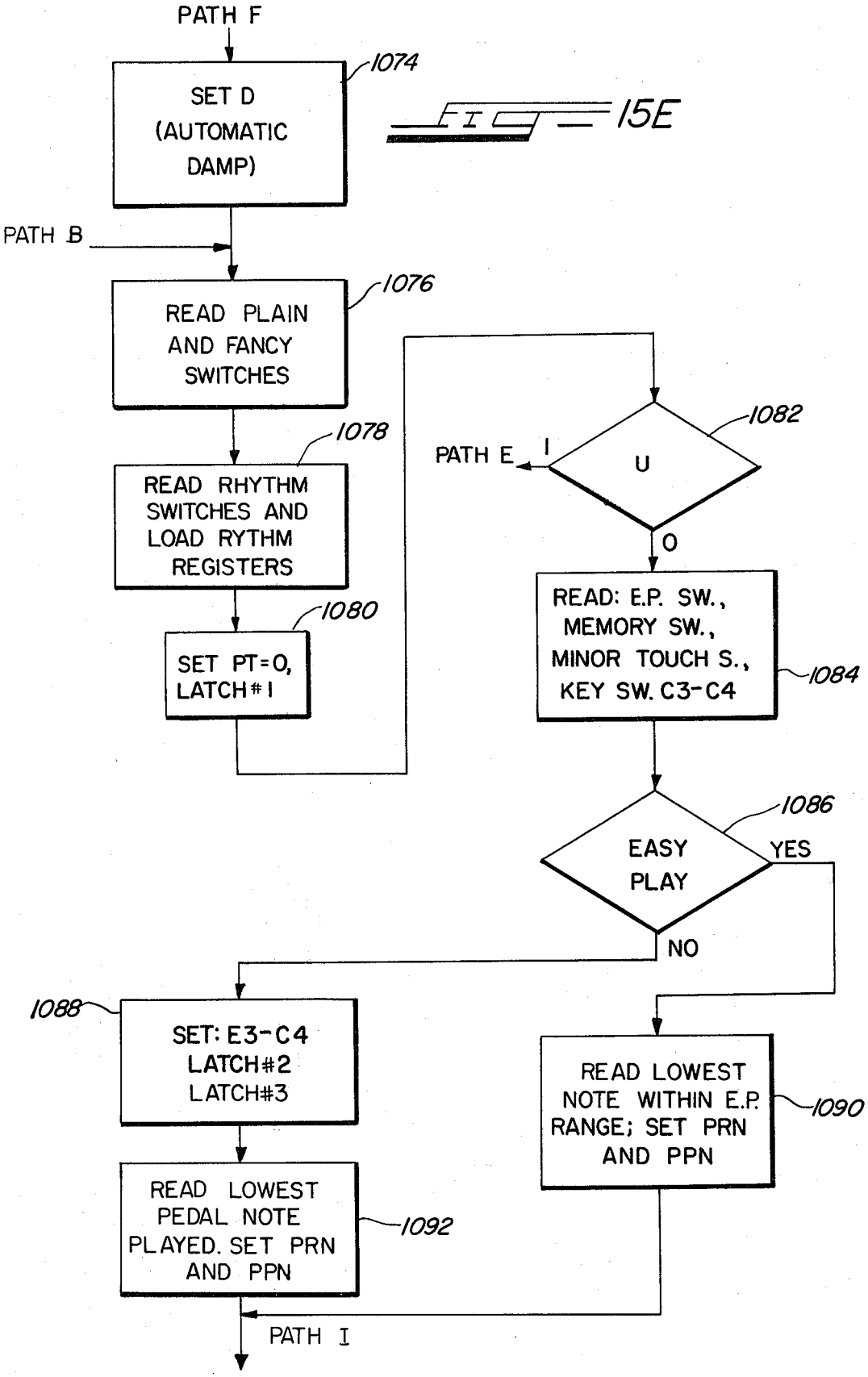

Referring to FIG. 15E, path F of the control routine branches to block 1074. Block 1074 sets D equal to one if CN is equal to fifteen or if Activity Next bit (Activity Next bits are in the FANCY ACTIVITY NEXT register whether Plain or Fancy because of the transfer by block 1060; this was done only for convenience in accessing the data based on the use of the particular instruction set illustrated in Table 4 infra, which does not form a part of the present invention) is equal to one with a corresponding one in the RHYTHM register; that is, a logical AND operation is performed on the data in the FANCY ACTIVITY NEXT register and the data in the RHYTHM register. The RHYTHM register contains a bit corresponding to each of the rhythm switches 212 through 242, the corresponding bit for each rhythm switch being set to one if the rhythm switch is actuated, and to zero if the rhythm switch is not actuated. From block 1074 the control routine branches to block 1076. Path B from block 1020 (see FIG. 15B) also branches to block 1076. Block 1076 reads plain pattern switch 414 and fancy pattern switch 416. The two bits of information corresponding to whether these two switches are in the on or off state is loaded into a PLAIN OR FANCY register 1204 in the RAM (see FIG. 13).

From block 1076 the control routine branches to block 1078 where it reads rhythm switches 212 through 242 and loads the on/off information from these switches into the RHYTHM register 1212 (see FIG. 13). In addition, block 1078 determines the priority rhythm number (PRNO), which determines which rhythm pattern will determine the value for PD. The priority rhythm number PRNO corresponds to the first rhythm switch 212 through 242, which is actuated, to be detected; however, it is not critical which of the selected rhythm patterns is assigned priority as long as only one rhythm pattern is selected. This is because only one PD value must be used on each beat to produce the desired musical effect. From block 1078 the control routine branches to block 1080, which sets PT equal to zero and sets latch 656 (i.e., latch #1).

Block 1082 of the control routine then determines whether the flag U is equal to one, indicating that the internal count CN has fallen behind the rhythm count AN, as discussed above. If the flag U is equal to one, the control routine branches along path E to block 1045 (see FIG. 15B), which sets the flag U equal to zero, and then to block 1046, which starts a five millisecond delay as discussed above. When the flag U is not equal to one, the control routine branches to block 1084 and reads Easy Play switch 410, minor touch strip 408, memory switch 412, and the keyswitches 464 through 488 within the Easy Play range (corresponding to notes C25 through C37).

The control routine then branches to decision block 1086, which determines whether the Easy Play mode has been selected by actuation of Easy Play switch 410.

If the Easy Play mode has been selected by actuation of switch 410, EP is equal to one and block 1086 branches to block 1090, which reads the lowest manual accompaniment note played within the Easy Play range (keyswitches 464 through 488). The keyswitches are interrogated by block 1084 (in groups of four at a time, as discussed above with reference to FIG. 4) by the control routine beginning with the lowest note and proceeding to the highest note until a note being played is found. If a note within the Easy Play range is being played (i.e., is depressed), PPN is set equal to one to indicate that a "pedal played now" has been found, and PRN is set equal to the number of semitones that the lowest note played is above the lowest note. PRN is a five-bit binary code which indicates the frequency of the pedal note played when in the Normal Organ mode or the frequency of the manual note played within the Easy Play range when in the Easy Play mode. If no note being played is found, PPN is set equal to zero. In the Easy Play mode, the accompaniment notes within the Easy Play range that were read in block 1084 and recorded in the RAM are examined in block 1090 to find the lowest note played. In the Normal Organ mode, block 1086 branches to block 1088 which sets latches 694 and 726 (see FIG. 6) to correspond to the notes played. Block 1088 sets the latches for the keyswitches (not shown) corresponding to keys C#38 to F42 (see FIG. 10) to zero; however, these notes can be played directly by the keys. As noted above, the signal diode gates (not shown) for E29 and F30 are set by latch 656 outputs 674 and 676, respectively; and keys C25 through D#28 are played through AND circuits 612, 614, 616 and 618. From block 1088 the control routine branches to block 1092, which reads the lowest pedal note played, as discussed above with respect to FIG. 3, and sets PRN and PPN as discussed with respect to the Easy Play mode.

With the temporary data for the lowest key or pedal played recorded as PRN and PPN, the control routine next confirms the value of PR. PRP is equal to the value of PRN during the previous interrogation, PR is equal to the confirmed frequency, and PP is equal to one when a pedal note (when in the Normal Organ mode) or a manual note within the Easy Play range (when in the Easy Play mode) has been confirmed or remembered.

Figure 15F:
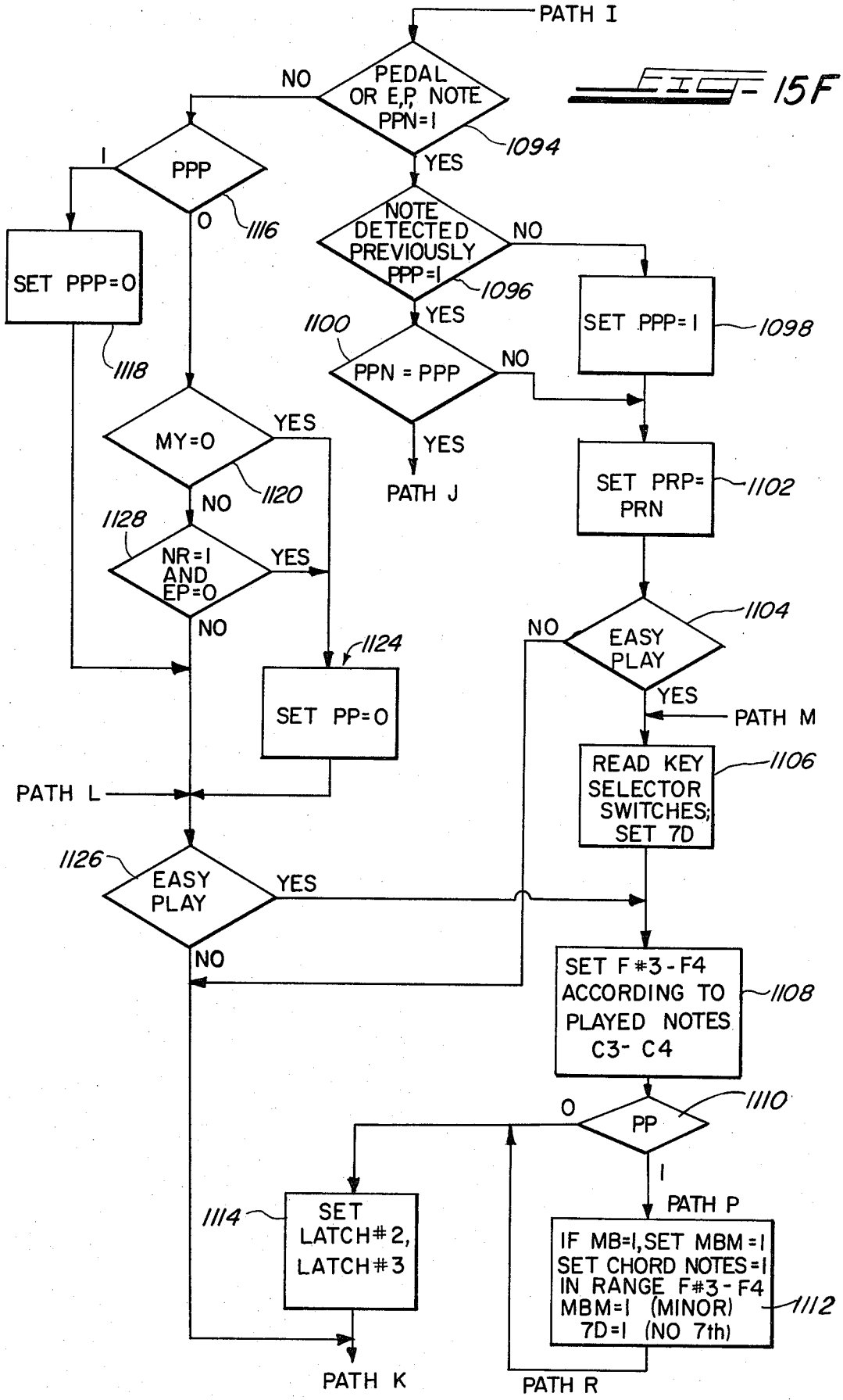

From blocks 1090 and 1092 the control routine branches along path I to decision block 1094 (see FIG. 15F). Referring to FIG. 15F, if a new note has just been detected, PPN is equal to one and the control routine branches from decision block 1094 to decision block 1096. Decision block 1096 determines whether there was a previously detected note, in which case PPP is equal to one and the control routine branches to decision block 1100. Decision block 1100 determines whether the note just detected is the same note as the one previously detected (i.e., whether PRN is equal to PRP). If PRN is equal to PRP the control routine follows path J to block 1128 (see FIG. 15G). If no note was detected previously, PPP is equal to zero and the control routine branches from decision block 1096 to block 1098 which sets PPP equal to one. From block 1098 the control routine branches to block 1102. The control routine also branches to block 1102 from decision block 1100 if PRN was not equal to PRP, i.e., if the note just detected was not the same note as the one detected previously. Block 1102 of the control routine sets PRP equal to PRN in preparation for the succeeding interrogation of the lowest note played during the next cycle of the control routine. From block 1102 the control routine branches to decision block 1104 which checks to determine whether the Easy Play mode has been selected. If the Easy Play mode has not been selected, the control routine branches from decision block 1104 along path K to block 1140 (see FIG. 15H), which is discussed below. If the Easy Play mode has been selected, decision block 1104 branches to block 1106. Block 1106 reads key selector switches 418 through 425 (see FIG. 4) and sets the seventh defeat 7D accordingly. If either of the two keys specified on a key selector switch 418, 420, 422, 423, 424 and 425 (i.e., C-$G^b$, D-$A^b$, E-$B^b$, F-B, G-$D^b$ and A-$E^b$) which has been actuated is the same as the key being played, as specified by PR, or is one semitone higher, then the seventh defeat 7D is set equal to one by block 1106, thereby causing the seventh note to be eliminated from the chord. If no key selector switch is selected, 7D is automatically set equal to one. From block 1106 the control routine branches to block 1108 and sets the bits in the CHORD NOTE register 1203 (FIG. 13) which are later outputted to latches in block 1114 to sound the notes of the chord determined by the lowest key played within the Easy Play range. Thus, the automatic chords are sounded in the range from F#31 through F42 in response to keys played within the range from C25 through C37. (see FIG. 11) The notes for each chord are set in block 1112 by means of a chord generator routine which is a part of the present invention and which will be described in greater detail hereinafter.

From block 1108 the control routine branches to decision block 1110 which determines whether a pedal note (when in the Normal Organ mode) or a manual note within the Easy Play range (when in the Easy Play mode) has been confirmed or remembered. When a note has been confirmed or remembered, PP is equal to one and the routine branches via path P to chord generator block 1112, which adds the chord notes (see FIGS. 11 and 16 for details). The root note of the chord corresponds to the lowest confirmed note played, as specified by PR. The third note is three notes higher or nine notes lower for minor (MBM=1), or four notes note higher or eight notes lower for major (MBM=0). The fifth is seven notes higher or five notes lower. The seventh note (if allowed by 7D being equal to zero) is ten notes higher or two notes lower, than the root of the chord. The chord notes are always chosen to be in the range F#31 through F42, except for a D minor chord which uses F30. MBM in general corresponds to the minor touch strip MB (the value of which depends on the state of minor touch strip 408), but it does not follow MB to zero if a note is not being played (PPP=0) but is being remembered (PP=1). Thus, in the memory mode the minor touch strip can be released shortly after a note is released and the chord will continue to play in minor. In chord generator block 1112 if MB is equal to one, MBM is set equal to one (i.e., if the minor bar has been touched, MBM is set equal to one so that minor chords will be sounded). In chord generator block 1112 Chord Note bits are set equal to one in a CHORD NOTE register 1203 in RAM 1202 (see FIG. 13) in the range F#31 through F42. From chord generator block 1112 the control routine branches to block 1114 on path R. If no note was confirmed or remembered decision block 1110 also branches to block 1114. In block 1114 latch 694 (latch #2) and latch 726 (latch #3) are set according to the bits in the CHORD NOTE register 1203. From block 1114 the control routine follows path K to block 1140 (see FIG. 15H).

Referring again to decision block 1094, if no note has been detected the control routine branches to decision block 1116 which determines whether a pedal note has been previously detected. If a pedal note was not previously detected (PPP=0), the control routine branches to decision block 1120 to determine whether the memory mode was selected by actuation of switch 412. If the memory mode has been selected, the control routine branches from block 1120 to block 1124 and sets PP equal to zero. If the memory mode has not been selected, decision block 1120 branches to decision block 1122, which determines whether rhythm is desired and whether the Easy Play mode has been selected. If no rhythm is desired (NR=1) and the Easy Play mode has not been selected (EP=0), the control routine branches from block 1122 to block 1124, which functions as described above. If a rhythm is desired or if the Easy Play mode has been selected the control routine branches from block 1122 to decision block 1126, which determines whether the Easy Play mode has been selected. If the Easy Play mode has been selected the control routine branches to decision block 1108, which functions as described above. If the Easy Play mode has not been selected, decision block 1126 follows path K to block 1140 (FIG. 15H). If a note was previously played, PPP will be equal to one and the control routine will branch from decision block 1116 to block 1118, which sets PPP equal to zero. From block 1118 the control routine branches to decision block 1126, which functions as described above.

Figure 15G:
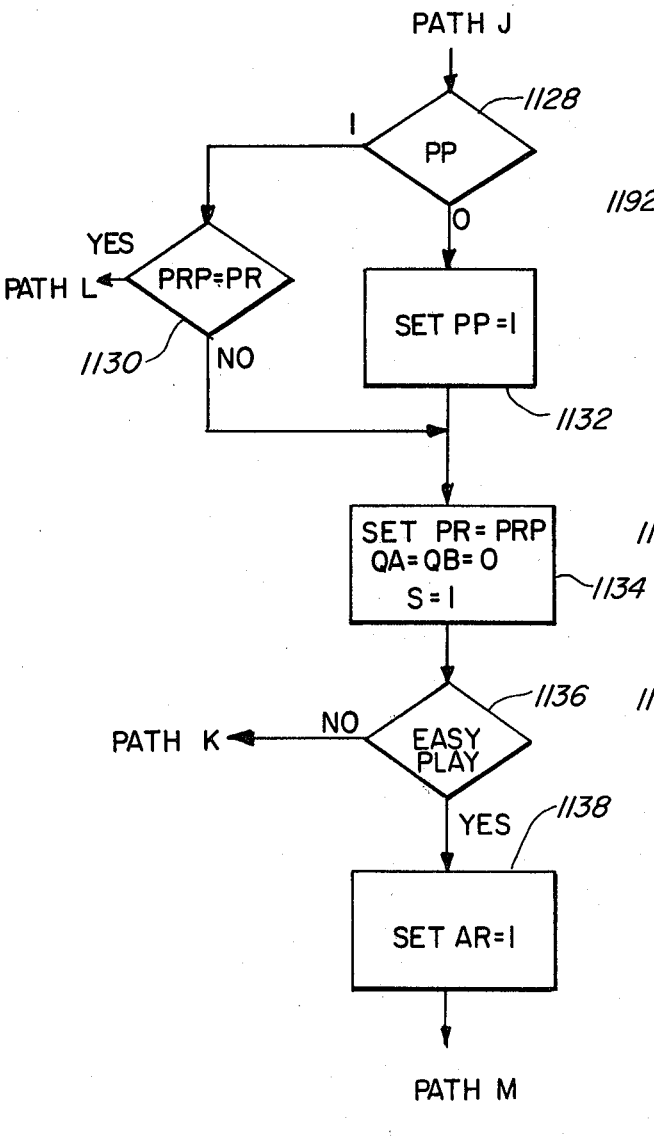

Referring to FIG. 15G, path J of the control routine branches to decision block 1128, which determines whether a pedal note (when in the Normal Organ mode) or a manual note within the easy play range (when in the Easy Play mode) has been confirmed or remembered. If a note is confirmed or remembered PP is equal to one and the control routine branches from decision block 1128 to decision block 1130. Decision block 1130 determines whether the frequency of the just confirmed note is equal to the frequency of the note confirmed during the previous interrogation, that is, whether PRP is equal to PR. If the frequency of the just confirmed note is the same as the frequency of the previously confirmed note, decision block 1130 branches along path L to block 1126 (see FIG. 15F), which functions as described above. If the frequencies are not the same, decision block 1130 branches to block 1134. When no pedal note (when in the Normal Organ mode) or manual note within the Easy Play range (when in the Easy Play mode) has been confirmed or remembered the control routine branches from decision block 1128 to block 1132, which sets PP equal to one to indicate that a note has been confirmed or remembered. From block 1132 the control routine branches to block 1134, which sets PR equal to PRP, QA equal to zero, QB equal to zero, and S equal to one. Thus, the confirmed values for the note to be played do not respond to the vagaries of switch bounce. PP is not set equal to one and PR is not changed until a second reading of PPN is equal to one, a second reading of PRN agrees with the first reading, and PPN or PRN is different from the present values of PP and PR. When these conditions are met, PR is changed and the new note flag S is set equal to one in block 1134. The previous readings of PRN and PPN are stored in the PRP and PPP registers in the RAM so that the comparison of two successive readings can be made. From block 1134 the control routine branches to block 1136, which determines whether the Easy Play mode has been selected. If the Easy Play mode has been selected, block 1138 sets AR equal to one thereby enabling the rhythm counter. From block 1138 the control routine follows path M to block 1106 (see FIG. 15F), which functions as described above. If the Easy Play mode has not been selected, the control routine branches from decision block 1136 along path K to block 1140 (see FIG. 15H).

Referring to FIG. 15H, after chord generation or production of output signals for Seventh Defeat or directly from the note confirmation tests in the Normal Organ mode, latch 656 is set in block 1140. Output control signals for signal diode gates E 29 and F 30 are provided, having been set in block 1088 (see FIG. 15E) or block 1108 (see FIG. 15F) or in block 1112 in the D minor case. The value of DO at output 682 of latch 656 in FIG. 6 is left as set by block 1042 (see FIG. 15C). PT is left at zero as it was set by block 1080 (see FIG. 15E).

From block 1140 the control routine branches to block 1142, which reads rhythm start/stop kick switch 431. The kick switch bounce, which can be rather severe during normal operation by one's foot, is eliminated by a counter in the RAM which is required to perceive eight passes through block 1146 with kick switch 431 being "off" before an "on" position is recognized and the AR value toggled, that is, the rhythm counter turned "on" or "off". From block 1142 the control routine branches to block 1144 which determines whether the memory mode has been selected and whether the Easy Play mode has been selected. If the memory mode has not been selected and the Easy Play mode has been selected, the control routine branches from decision block 1144 to decision block 1150, which determines whether a note has been confirmed or remembered. If a note has not been confirmed or remembered, the control routine branches from block 1150 to block 1156, which sets AR equal to zero, thereby disabling the rhythm counter. From block 1156 the control routine proceeds along path O to block 1004 (see FIG. 15A) near the beginning of the control routine. If a note has been confirmed or remembered the control routine branches from block 1150 to decision block 1152, which determines whether the rhythm counter has been enabled. If the rhythm counter has been enabled, the control routine branches from block 1152 along path O to block 1004 (see FIG. 15A). If the rhythm counter has not been enabled, the control routine branches from block 1152 to block 1154, which sets AR equal to one thereby enabling the rhythm counter, and which also sets CN equal to zero. From block 1154 the control routine proceeds along path O to block 1004 (see FIG. 15A). If the Memory mode has been selected or if the Easy Play mode has not been selected the control routine branches from decision block 1144 to decision block 1146, which determines whether there has been an off-to-on transition of rhythm start/stop kick switch 431. If there has not been a transition, the control routine branches along path O to block 1004 (see FIG. 15A). If there has been a transition of the rhythm start/stop kick switch 431, the control routine branches to block 1148 and changes AR. From block 1148 the control routine follows path N to block 1002 (see FIG. 15A) near the beginning of the control routine. The control routine repeats the foregoing sequence continuously during operation of the musical instrument.

Figure 16A:
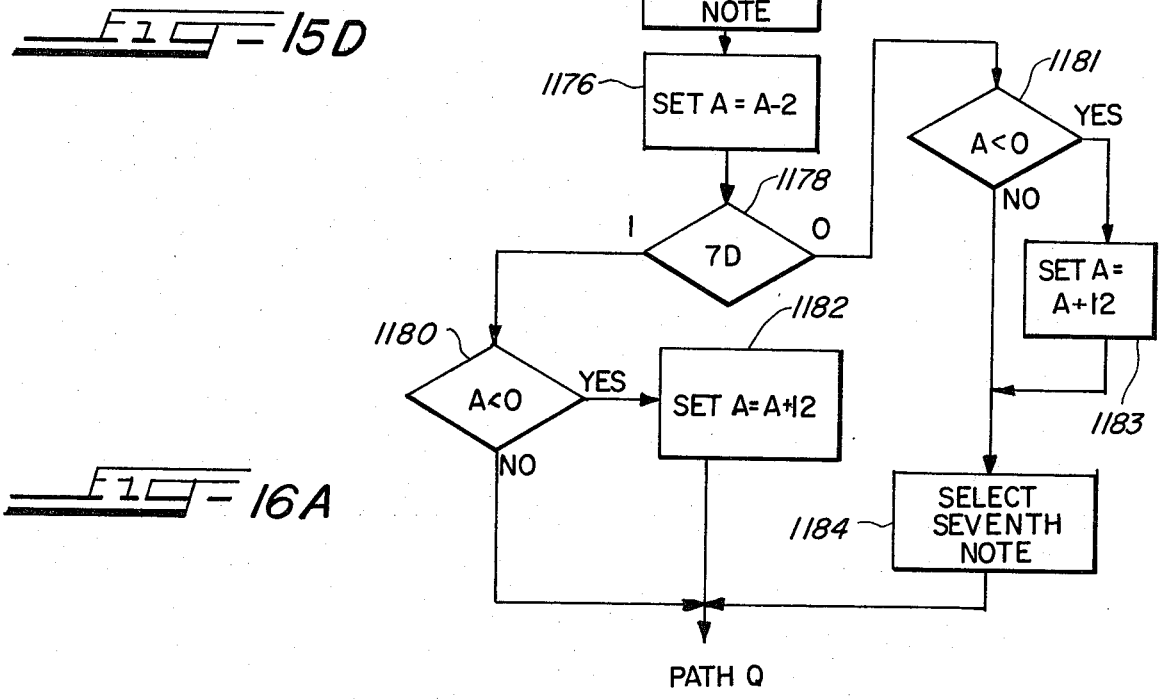
FIGS. 16A and 16B, taken together, are a flow diagram illustrating the automatic chord generator routine performed by the preferred embodiment of the present invention.
Figure 16B:
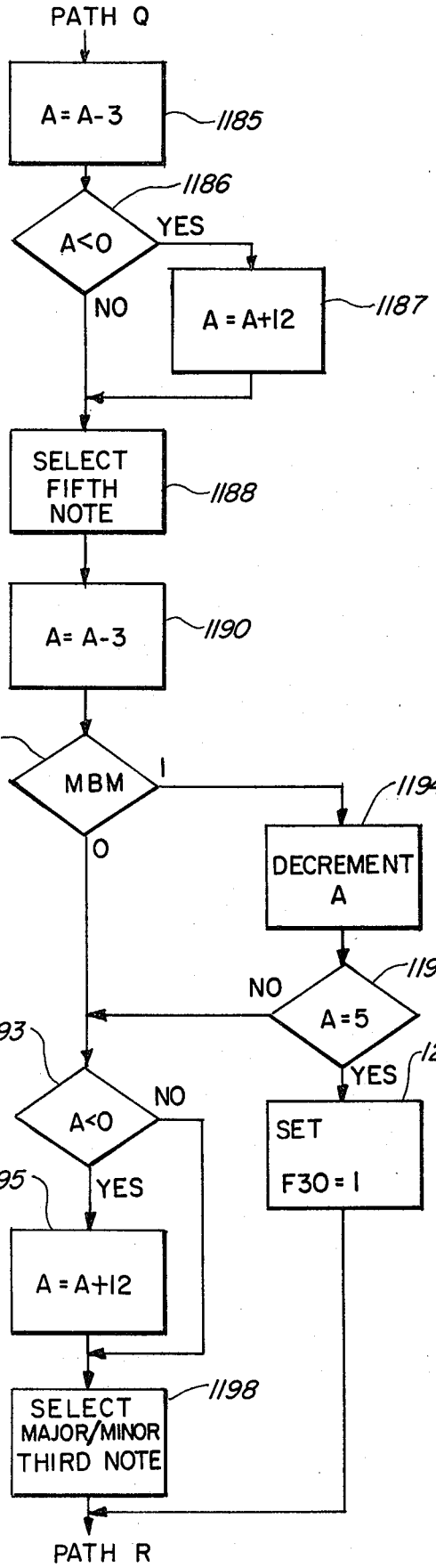

The automatic chord generator routine referred to in block 1112 (see FIG. 15F) is illustrated by the flow diagram shown in FIGS. 16A and 16B. The automatic chord generator routine illustrates the logic circuitry employed to set bits in CHORD NOTE register 1203 in RAM 1202 from which the appropriate output latches are set in block 1114 (and also in blocks 1034 and 1042) of the control routine to sound notes F30 through F42 and to thereby provide automatic chord generator means. The notes comprising the chords generated by the automatic chord feature of the present invention when in the Easy Play mode in response to the playing of a key within the Easy Play range are illustrated in FIG. 11. Designating each note F#31 through F42 as being "A" semitones above C37 where A is equal to zero through five, or A semitones above C25 where A is equal to six through eleven, then the note is sounded (when in the Easy Play mode) under the conditions described by the following equations:

A=PR or PR−12, for the root;

A=PR+3 or PR−9, for the third if the minor touch strip 408 is touched;

A=PR+4 or PR−8, for the third if the minor touch strip 408 is not touched;

A=PR+7 or PR−5, for the fifth;

A=PR+10 or PR−2, for the seventh if the seventh defeat is not activated. (PR is equal to the number of semitones that the note played—the root note—is above low C). In addition to the notes sounded according to the foregoing equations, note F30 is sounded if PR is equal to two (D is the root note) and the minor touch strip 408 is touched.

The automatic chord generator routine is entered from block 1110 (see FIG. 15F) along path P which branches to decision block 1160, which determines whether MB is equal to zero or one. MB is equal to one when minor touch strip 408 (see FIG. 5) has been touched by the instrumentalist thereby indicating that minor chords are desired. If minor touch strip 408 has not been touched, in which case MB is equal to zero, the routine branches from decision block 1160 to decision block 1162, which determines whether PPP is equal to zero or to one. PPP will be equal to one when a note within the Easy Play range was played on the immediately previous interrogation of the switches. The routine branches to decision block 1168 if a note within the Easy Play range was not played. If a note within the Easy Play Range was detected, PPP is equal to one and the routine branches from decision block 1162 to decision block 1164, which sets a flag MBM equal to zero. From block 1164 the routine branches to block 1168. If in decision block 1160 it is determined that MB is equal to one, indicating that minor touch strip 408 has been touched, the routine branches to block 1166, which sets flag MBM equal to one. From block 1166 the routine branches to block 1168. Block 1168 of the routine sets a parameter "A" equal to the four least significant bits of the frequency of the confirmed note ("PR"). In determining which output latches to set, in the above-described equation PF corresponds to A when the value of A is less than 12, and PF corresponds to A minus 4 when A is greater than or equal to 12. From block 1168 the routine branches to decision block 1170, which determines whether A is greater than 11. If A is greater than 11, the routine branches to block 1172 and subtracts twelve from A. From block 1172 the routine branches to block 1174. If A is not greater than 11, the routine branches to block 1174 from decision block 1170. In block 1174 the routine causes the bit in CHORD NOTE register 1203 which corresponds to the root note to be set to one. (As already noted, a note is chosen from the range C37 through F42 when A is equal to zero through five, or F#31 through B36 when A is equal to six through eleven). From block 1174 the routine branches to block 1176, which sets A equal to A minus two. From block 1176 the chord generator routine branches to decision block 1178, which determines from the 7D bit previously stored in memory in block 1106 (see FIG. 15F) whether the seventh defeat mode has been selected. If the seventh defeat mode has been selected (that is, if 7D is equal to one), then the routine branches from decision block 1178 to decision block 1180. Decision block 1180 determines whether A is negative. If A is negative, the chord generator routine branches from decision block 1180 to block 1182 and sets A equal A plus twelve. From block 1182 the routine branches along path Q to block 1186 (see FIG. 16B). If A is positive, the control routine branches directly from decision block 1180 along path Q to block 1186. If 7D is determined to be equal to zero in decision block 1178, indicating that a seventh note is desired, the chord generator routine branches from decision block 1178 to blocks 1181 and 1183 which performs the same functions as blocks 1180 and 1182, except the branching is to block 1184. Block 1184 sets a bit in the CHORD NOTE register 1203 according to A, which corresponds to the seventh note at that point in the chord generator routine. As in the previous case, a note is chosen from the range C37 through F42 when A is equal to zero through five, or F#31 through B36 when A is equal to six through eleven. From block 1184 the routine branches along path Q to block 1185. With reference to FIG. 16B, in block 1185 A is set equal to A minus three. Again if the result is negative A is increased by twelve by blocks 1186 and 1187. Next, the chord generator routine sets a bit in the CHORD NOTE register 1203 according to the value of A at that point in the routine, which corresponds to the fifth note in block 1188. The routine then branches to block 1190, which sets A equal to A minus three. The routine next branches to decision block 1192 which determines whether flag MBM is equal to one, indicating that the minor touch strip 408 has been touched. If MBM is equal to one, the routine branches to block 1194, which decrements A by one to provide the minor third note. From block 1194 the routine branches to decision block 1196, which determines whether A is equal to five. If A is not equal to five, the routine branches to decision block 1193. If the flag MBM was not set equal to one, the routine branches directly to block 1193 from decision block 1192. Decision block 1186 determines whether A is less than zero, and if it is, the routine branches to block 1195, which sets A equal to A plus twelve. From block 1195 the routine branches to block 1198. If A is not less than zero, the routine branches directly to block 1198 from decision block 1193. In block 1198 the chord generator routine again sets to one a bit in the CHORD NOTE register 1203 according to the value of A at that point in the routine, which corresponds to the major or minor third note. If it is determined in block 1196 that A is equal to five, the routine branches from decision block 1196 to block 1200, which sets to one the F30 bit in memory. Latch output 676 controls via line 630 the signal diode gate corresponding to the note F30. The latch output 676 for note F30 is set separately in block 1034 or 1040 in the preferred embodiment because latch output 676 is controlled by latch 656 (latch #1) whereas all of the other notes sounded by the automatic chord feature are controlled either by latch 694 (latch #2) or latch 726 (latch #3), which are set in block 1114. It should be recognized that in alternative embodiments, depending upon the number of outputs on the latches used, all notes sounded by the automatic chord feature could be controlled by latch outputs from various combinations of latches without departing from the spirit of the present invention. From either block 1200 or 1198 the control routine branches via path R to block 1114 (see FIG. 15F).

While the preferred embodiment of the invention has been illustrated and described, it is to be understood that the invention is not limited to the precise construction herein disclosed, and the right is reserved to all changes and modifications coming within the scope of the invention as defined in the appended claims.

TABLE 4

| FUNCTION | MNEMONIC | DESCRIPTION OF INSTRUCTION | HEX CODE |
|---|---|---|---|
| Register to Register Transfer | TAY | Transfer accumulator to Y register. | 20 |
| | TYA | Transfer Y register to accumulator. | 23 |
| | CLA | Clear accumulator. | 7F |
| Register to Memory | TAM | Transfer accumulator to memory. | 27 |
| | TAMIYC | Transfer accumulator to memory and increment Y register. If carry, one to status. | 25 |
| | TAMDYN | Transfer accumulator to memory and decrement Y register. If no borrow, one to status. | 24 |
| | TAMZA | Transfer accumulator to memory and zero accumulator. | 26 |
| Memory to Register | TMY | Transfer memory to Y register. | 22 |
| | TMA | Transfer memory to accmulator. | 21 |
| | XMA | Exchange memory and accumulator. | 03 |
| Arithmetic | AMAAC | Add memory to accumulator, results to accumulator. If carry, one to status. | 06 |
| | SAMAN | Subtract accumulator from memory, results to accumulator. If no borrow, one to status. | 3C |
| | IMAC | Increment memory and load into accumulator. If carry, one to status. | 3E |
| | DMAN | Decrement memory and load into accumulator. If no borrow, one to status. | 07 |
| | IAC | Increment accumulator. If no carry, one to status.* | 70 |
| | DAN | Decrement accumulator. If no borrow, one to status.* | 77 |
| | A2AAC | Add 2 to accumulator. Results to accumulator. If carry, one to status.* | 78 |
| | A3AAC | Add 3 to accumulator. Results to accumulator. If carry, one to status.* | 74 |
| | A4AAC | Add 4 to accumulator. Results to accumulator. If carry one to status.* | 7C |
| | A5AAC | Add 5 to accumulator. Results to accumulator. If carry one to status.* | 72 |
| | A6AAC | Add 6 to accumulator. Results to accumulator. If carry one to status.* | 7A |
| | A7AAC | Add 7 to accumulator. Results to accumulator. If carry one to status.* | 76 |
| | A8AAC | Add 8 to accumulator. Results to accumulator. If carry one to status.* | 7E |
| | A9AAC | Add 9 to accumulator. Results to accumulator. If carry one to status.* | 71 |
| | A10AAC | Add 10 to accumulator. Results to accumulator. If carry one to status.* | 79 |
| | A11AAC | Add 11 to accumulator. Results to accumulator. If carry one to status.* | 75 |
| | A12AAC | Add 12 to accumulator. Results to accumulator. If carry one to status.* | 7D |
| | A13AAC | Add 13 to accumulator. Results | 73 |

TABLE 4-continued

| FUNCTION | MNEMONIC | DESCRIPTION OF INSTRUCTION | HEX CODE |
|---|---|---|---|
| | | to accumulator. If carry one to status.* | |
| | A14AAC | Add 14 to accumulator. Results to accumulator. If carry one to status.* | 78 |
| | IYC | Increment & register. If carry, one to status. | 05 |
| | DYN | Decrement & register. If no borrow, one to status. | 04 |
| | CPAIZ | Complement accumulator and increment. If then zero, one to status. | 3D |
| Arithmetic Compare | ALEM | If accumulator less than or equal to memory, one to status. | 01 |
| Logical Compare | MNEA | If memory is not equal to accumulator, one to status. | 00 |
| | MNEZ | If Y register not equal to accumulator, one to status. | 3F |
| | YNEA | If Y register not equal to accumulator, one to status and status latch. | 02 |
| | YNEC | If Y register not equal to a constant, one to status. | 5– |
| Bits in Memory | SBIT | Set memory bit. | 30 |
| | RBIT | Reset memory bit. | 34 |
| | TBIT1 | Test memory bit. If equal to one, one to status. | 38 |
| Constants | TCY | Transfer constant to Y register. | 4– |
| | TCMIY | Transfer constant to memory and increment Y. | 6– |
| Input | KNEZ | If K inputs not equal to zero, one to status. | 0E |
| | TKA | Transfer K inputs to accumulator. | 08 |
| Output | SETR | Set R output addressed by Y. | 0D |
| | RSTR | Reset R output addressed by Y. | 0C |
| | TDO | Transfer data from accumulator and status latch to 0 outputs. | 0A |
| RAM X Addressing | LDX | Load X with file address. | 2– |
| | COMX | Complement the MSB of X. | 09 |
| ROM Addressing | BR | Branch on status = one. | — |
| | CALL | Call subroutine on status = one. | — |
| | RETN | Return from subroutine. | 0F |
| | LDP | Load page buffer with constant. | 1– |
| | COMC | Complement chapter buffer. | OB |

*Add Immediate Value to Accumulator

We claim:

1. In an electronic musical instrument, an automatic rhythm generating device for generating selectable rhythm patterns of musical tones comprising:

an array of playing keys;

a plurality of rhythm switches for selecting rhythm patterns of tones, each rhythm switch in said plurality of rhythm switches corresponding to a rhythm pattern of tones and being operable to select the corresponding rhythm pattern;

rhythm counter means for providing timing signals to control the timing of the beats of the rhythm patterns generated by the automatic rhythm generating device;

memory storage means in which is stored binary data for each beat of each rhythm pattern, said binary data for each beat including trigger signal data indicating whether a trigger signal is required by each rhythm pattern and frequency deviation data indicating the value of the frequency deviation for the tone specified by each selectable rhythm pattern;

logic control circuit means responsive to the timing signals from said rhythm counter means for selecting said trigger signal data from said memory storage means in accordance with a rhythm pattern selected by operation of a rhythm switch in said plurality of rhythm switches and for providing a trigger signal during the depression of a playing key during each beat on which a tone is specified by a selected rhythm pattern, and for selecting from said memory storage means in accordance with a selected rhythm pattern the frequency deviation data corresponding to each beat on which a tone is specified by a selected rhythm pattern;

programmable signal generator means responsive to the actuation of a playing key in said array of playing keys and to said frequency deviation data selected by said logic control circuit means for generating a tone signal of a frequency related to the frequency of the actuated playing key by the frequency deviation value selected by said logic control circuit means for a selected rhythm pattern;

gating means for receiving said tone signal from said programmable signal generator means and for receiving said trigger signal from said logic control circuit means, said gating means passing said tone signal in response to the receipt of said trigger signal; and audio output means for receiving said tone signal passed by said gating means, said audio output means converting said tone signal into an audible tone.

2. A device as claimed in claim 1 wherein said binary data stored in said memory storage means also includes damp signal data indicating whether a damp signal is required by each selectable rhythm pattern, and wherein responsive to the timing signals from said rhythm counter means said logic control circuit means selects said damp signal data from said memory storage means and provides a damp signal during the depression of a playing key in said array of playing keys during each beat on which damping is required by a selected rhythm pattern, and wherein also said gating means receives said damp signal from said logic control circuit means and damps said tone signal passed by said gating means in response to the receipt of said damp signal.

3. A device as claimed in claim 1 further comprising automatic chord generator means for generating a chord which is sounded by said audio output means in response to the actuation of a playing key in said array of playing keys.

4. A device as claimed in claim 3 wherein said automatic chord generation means further comprises:

musical key selector means for selecting seventh chords in response to actuation of predetermined ones of the playing keys in said array of playing keys;

tone source means for generating tone signals corresponding to the notes of the chords sounded in response to the playing of the keys within said array of playing keys; and accompaniment gating means for receiving gating signals generated by said logic control circuit means in response to the playing of a key within said array of playing keys, said gating signals corresponding to the notes of the chord to be sounded in response to the key played, said accompaniment gating means passing to said audio output means said tone signals generated by said tone source means which correspond to said gating signals, whereby the chord is sounded.

5. A device as claimed in claim 4 wherein said chords are selectively major triad and dominant seventh chords and further comprising:

switch means for converting said major triad and dominant seventh chords to minor triad and diminished seventh chords.

6. A device as claimed in claim 1 wherein said array of playing keys includes an array of pedals.

7. A device as claimed in claim 6 wherein said logic control circuit means causes the automatic rhythm generating device to not begin sounding automatic rhythm patterns in response to the playing of a key in said array of playing keys until after a predetermined delay, thereby allowing the keys in said array of playing keys to be plated without initiating automatic rhythm patterns when the keys are depressed for less than the predetermined delay period.

8. A device as claimed in claim 2 wherein said memory storage means further comprises:

first register means in which is stored data which includes said frequency deviation data, said trigger signal data and said damp signal for each beat of each selectable rhythm pattern corresponding to one of the rhythm switches in said plurality of rhythm switches;

second register means for storing activity now data for the current beat, which includes one bit of data for each selectable rhythm pattern;

third register means for storing one bit of data for each of said rhythm switches;

fourth register means for storing frequency deviation data said damp signal data for the current beat of each of the rhythm patterns; and fifth register means for storing activity next data for the current beat, which includes one bit of data for each rhythm pattern; and wherein said logic control circuit means transfers activity next data for the preceding beat, which is the activity now data for the current beat, from said fifth register means to said second register means and then transfers activity next data for the current beat from said first register means to said fifth register means, and wherein responsive to each rhythm pattern selected by actuation of one of said plurality of rhythm switches said logic control circuit means sets a corresponding bit in said third register means to a predetermined state, and wherein said logic control circuit means transfers frequency deviation data and damp signal data for the current beat of each of the selectable rhythm patterns from said first register means to said fourth register means, and wherein said logic control circuit means performs a first logical AND operation on the bits stored in said fifth register means and the corresponding bits stored in said third register means followed by a logical OR operation on the result obtained from the logical AND operation, said logic control circuit means generating a damp signal when the result of said logical OR operation is in a predetermined state, and wherein said logic control circuit means selects from said fourth register means according to the result of said first logical AND operation said damp signal data required by the selected rhythm patterns on the current beat, and wherein said logic control circuit means selects from said fourth register means according to the result of said first logical AND operation said frequency deviation data required by a selected rhythm pattern on the current beat.

9. A device as claimed in claim 1 wherein until after a predetermined delay said logic control circuit means causes the automatic rhythm generating device to not begin sounding automatic rhythm patterns in response to the playing of a key in said array of playing keys, said programmable signal generator means generates a tone signal of the frequency of the actuated playing key, and said gating means receives said tone signal from said programmable signal generator means and passes said tone signal to said audio output means, whereby tones corresponding to rapidly played keys are inserted into the rhythm pattern selected by operation of a rhythm switch in said plurality of rhythm switches thereby breaking into the selected rhythm pattern temporarily while keys are rapidly played and resuming automatic rhythm generating responsive to the playing of a key which is played longer than the predetermined delay.

10. In an electronic musical instrument, an automatic rhythm device for generating a rhythm pattern of pedal tones comprising:

an array of pedals;

a plurality of rhythm switches for selecting rhythm patterns of pedal tones, each of said rhytm switches being operable to select a corresponding rhythm pattern of pedal tones;

trigger signal generator means responsive during the actuation of a pedal in said array of pedals for generating a trigger signal during each beat in which a pedal tone is required by a rhythm pattern selected by operation of one of said plurality of rhythm switches;

damp signal generator means responsive during the actuation of a pedal in said array of pedals for generating a damp signal during each beat in which damping of a pedal tone is required by a rhythm pattern selected by actuation of one of said plurality of rhythm switches;

code generator means responsive to the actuation of a pedal in said array of pedals for generating a binary code corresponding to the frequency of a pedal tone related to the frequency of the actuated pedal by a frequency deviation governed by the rhythm pattern selected by actuation of one of said plurality of rhythm switches, the frequency deviation being variable from beat to beat according to the rhythm pattern selected by actuation of one of said plurality of rhythm switches;

programmable pedal signal generator means for receiving the binary code from said code generator means and for generating a pedal tone signal of a fequency corresponding to the binary code;

gating means for receiving the pedal tone signal generated by said programmable pedal signal generator means, for receiving the trigger signal from said trigger signal generator means, and for receiving the damp signal from said damp signal generator means, said gating means passing the pedal tone signal in response to the receipt of a trigger signal, and said gating means damping the pedal tone signal passed by said gating means in response to the receipt of a damp signal; and audio means for receiving the pedal tone signal passed by said gating means and for converting the pedal tone signal received to an audible pedal tone, whereby during each beat for which a pedal tone is required by a selected rhythm pattern a pedal tone determined by a selected rhythm pattern and related in frequency to the tone corresponding to an actuated pedal is sounded and damped according to the selected rhythm pattern.

11. A device as claimed in claim 10 further comprising:

an array of manual playing keys; and mode switch means having two states for allowing the selection of either a first or second mode, said mode switch means deactuating said array of pedals when said mode switch means is in a first state and said mode switch means not affecting the operation of said array of pedals when said mode switch means is in the second state; and wherein when said mode switch means is in the first state said code generator means is responsive to the actuation of a key in said array of playing keys and generates a binary code corresponding to the frequency of a pedal tone related to the frequency of the actuated key by a frequency deviation governed by the selected rhythm pattern, and wherein said trigger signal generator means and said damp signal generator means are responsive during the actuation of a key in said array of playing keys, whereby during each beat a pedal tone determined by a selected rhythm pattern and related in frequency to the tone corresponding to a key played in said array of manual playing keys is sounded and damped according to the selected rhythm pattern.

12. A device as claimed in claim 11 further comprising:

note played generator means for generating a note played signal in response to the actuation of a pedal when said mode switch means is in the second state, and for generating a note played signal in response to the actuation of a playing key when said mode switch means is in the first state;

second gating means for receiving the pedal tone signal generated by said programmable pedal signal generator means and for receiving the note played signal generated by said note played generator means, said second gating means passing the pedal tone signal to said audio output means in response to the receipt of a note played signal; and wherein said audio output means receives the pedal tone signals passed by said second gating means and converts the pedal tone signal received to an audible pedal tone.

13. A device as claimed in claim 11 further comprising automatic chord generation means for generating chords in response to the actuation of a playing key when said mode selector means is in the first state.

14. A device as claimed in claim 11 further comprising:

memory means for causing the automatic rhythm device to continue generating a rhythm pattern of pedal tones once a playing key has been actuated when said mode switch means is in the first state; and memory defeat switch means for stopping the generation of the rhythm pattern of pedal tones.

15. A device as claimed in claim 10 further comprising:

data register means for storing data for the rhythm patterns of pedal tones corresponding to said plurality of rhythm switches, said data register means containing data for each rhythm pattern and said data indicating whether a trigger signal or a damp signal is required for each beat of the rhythm pattern, said data register means also containing data indicating a frequency deviation value for each beat of each rhythm pattern; and control means for causing said trigger signal generator means to generate a trigger signal during the actuation of a pedal in said array of pedals during each beat in which a pedal tone is required according to said data stored in said data register means for a selected rhythm pattern, said control means also causing said damp signal generator means to generate a damp signal during the actuation of a pedal in said array of pedals during each beat in which damping of a pedal tone is required according to said data stored in said data register means for a selected rhythm pattern, said control means also causing said code generator means to generate a binary code corresponding to the frequency of a pedal tone related to the frequency of the actuated pedal in said array of pedals by a frequency deviation of a value obtained from said data stored in said data register means.

16. A device as claimed in claim 15 wherein said data register means further comprises:

activity register means for storing one bit of data for each rhythm pattern on a particular beat, said bit for each rhythm pattern being in a first state when a trigger signal or damp signal is required by the rhythm pattern on that beat and said bit being in a second state when no trigger signal or damp signal is required for the rhythm pattern on that beat;

a rhythm register means for storing one bit of data for each of said rhythm switches, each of said bits being in a first state when the corresponding said rhythm switch has been actuated and said bit being in a second state when the corresponding said rhythm switch has not been actuated;

logic circuit means for performing during each beat a logical AND operation on the contents of said rhythm register means and the contents of said activity register means, thereby providing a set of bits corresponding to which of the selected rhythm patterns require a trigger signal or a damp signal on that particular beat; and wherein said control means selects data from said data register means according to said set of bits to control whether to cause said trigger signal generator to generate a trigger signal, whether to cause said damp signal generator means to generate a damp signal, and selects data from said data register means indicating the frequency deviation value to be utilized by said code generator means to generate the binary code.

17. A device as claimed in claim 10 further comprising:

data register means for storing data for the rhythm patterns corresponding to said plurality of rhythm switches and data corresponding to which of said plurality of rhythm switches have been selected, said data register means containing data for each rhythm pattern indicating whether a trigger signal or a damp signal is required and the frequency deviation value for each beat of each rhythm pattern;

rhythm counter means for generating signals corresponding to each beat of the rhythmic pattern of pedal tones;

logic circuit means for receiving the signals generated by said rhythm counter means, said logic circuit means generating a first output signal when a trigger signal is specified by the data in said data register means for a selected rhythm pattern and a second output signal when a damp signal is specified by the data in said data register means for a selected rhythm pattern, said logic circuit means also generating frequency deviation output signals corresponding to the value of the frequency deviation specified by the data in said data register means for a selected rhythm pattern for the current beat; and whereby, when a pedal in said array of pedals has been actuated, said trigger signal generator means generates a trigger signal in response to said first output signal from said logic circuit means, said damp signal generator means generates a damp signal in response to said second output signal from said logic circuit means, and said code generator means generates a binary code corresponding to the frequency of a pedal tone related to the frequency of the actuated pedal by a frequency deviation value corresponding to said frequency deviation output signals.

18. A device as claimed in claim 17 wherein said data register means further comprises:

instruction register means in which is stored data corresponding to whether a trigger or special damp signal is required for each beat of each rhythm pattern, data corresponding to the value of the frequency deviation and activity next data corresponding to whether a damp signal is required for the next beat of each rhythm pattern;

activity now register means for storing one bit of data for each of the rhythm patterns;

rhythm register means for storing one bit of data for each of said rhythm switches;

activity next register means for storing one bit of data for each of the rhythm patterns;

wherein during each beat said logic circuit means transfers activity now data for the current beat from said activity next register means to said activity now register means, and then transfers activity next data for the current beat from said instruction register means to said activity next register means, and interrogates said plurality of rhythm switches and for each of said rhythm switches which has been actuated to select the corresponding rhythm pattern sets a corresponding bit in said rhythm register means to a first state and for each of said rhythm switches which has not been actuated sets a corresponding bit in said rhythm register means to a second state; and wherein said first output signal of said logic circuit means is the result obtained by said logic circuit means performing a logical AND operation on the bits stored in said activity now register means and said rhythm register means followed by a logical OR operation on the result of the logical AND operation.

19. A device as claimed in claim 10 wherein each rhythm pattern has a first variation and a second variation and further comprising means for selecting either said first variation or said second variation to be generated by the automatic rhythm generating device.

20. In an electronic musical instrument, an automatic chord and rhythm generating device for generating chords and rhythm patterns of bass tones comprising:

an array of playing keys;

a plurality of rhythm switches for selecting rhythm patterns of tones, each of said rhythm switches corresponding to a rhythm pattern of tones;

musical key selector means for selecting seventh chords in response to actuation of a playing key from predetermined groups of said playing keys, each predetermined group of playing keys being selectable by said musical key selector means and the particular seventh chords corresponding to each group of playing keys thereby being selectable;

trigger signal generator means reponsive to the actuation of a playing key and to the selection of a rhythm pattern by actuation of one of said rhythm switches for generating a trigger signal during each beat in which a tone is required by a selected rhythm pattern;

damp signal generator means reponsive to the actuation of a playing key and to the selection of a rhythm pattern by actuation of one of said rhythm switches for generating a damp signal during each beat in which damping of a tone is required by a selected rhythm pattern;

code generator means responsive to the actuation of a playing key and to the selection of a rhythm pattern by actuation of one of said rhythm switches for generating a binary code corresponding to the frequency of a tone related to the frequency of the actuated playing key by a frequency deviation value governed by the selected rhythm pattern, the frequency deviation being variable from beat to beat according to the selected rhythm pattern;

chord generator means responsive to said musical key selector means for generating a plurality of gate signals in response to the actuation of a playing key, each of said gate signals corresponding to a note of a chord, whereby the chord generated by said chord generator means is a seventh chord when the playing key actuated is one of a predetermined group of playing keys selected on said musical key selector means;

programmable signal generator means for receiving the binary code from said code generator means for generating a first tone signal of a frequency corresponding to the binary code;

note played generator means for generating a note played signal in response to the actuation of a playing key;

tone source means for generating tone signals corresponding to the notes of the chords generated by said chord generator means in response to the playing of a playing key;

first gating means for receiving said first tone signal generated by said programmable signal generator means and for receiving the damp signal from said damp signal generator means, said first gating means passing said first tone signal in response to the receipt of a trigger signal, and said first gating means damping said first tone signal passed by said first gating means in response to the receipt of a damp signal;

second gating means for receiving said first tone signal generated by said programmable signal generator means and for receiving the note played signal generated by said note played generator means, said second gating means passing said first tone signal in response to the receipt of a note played signal;

third gating means for receiving said tone signals generated by said tone source means and for receiving the gate signals generated by said chord generator means, said third gating means passing said tone signals received from said tone source corresponding to said gate signals received from said chord generator means; and audio output means for receiving said first tone signal passed by said first gating means, said first tone signal passed by said second gating means and said tone signals passed by said third gating means, said audio output means converting said first tone signal received from said first gating means, said first tone signal received from said second gating means, and said tone signals received from said third gating means into audible tones.

21. The device as claimed in claim 20 wherein said chords are selectively major triad and dominant seventh chords and further comprising switch means for converting said major triad and dominant seventh chords to minor triad and diminished seventh chords.

22. In an electronic musical instrument having an array of playing keys, an automatic rhythm generating apparatus for generating selectable rhythm patterns of musical tones, said apparatus comprising:

a plurality of rhythm switches for selecting rhythm patterns of notes, each of said rhythm switches being operable to select a corresponding rhythm pattern to be sounded;

activity next register means for storing activity next data, the activity next data including binary data for each of the selectable rhythm patterns;

activity now register means for storing activity now data, the activity now data including binary data for each of the selectable rhythm patterns;

data register means in which is stored binary data for each of the selectable rhythm patterns, the binary data corresponding to activity next data for each beat of each selectable rhythm pattern and to a frequency deviation value for at least one beat of each selectable rhythm pattern;

logic circuit means for transferring the activity next data for the preceding beat from said activity next register means to said activity now register means and for transferring the binary data corresponding to whether trigger activity will be required during the next succeeding beat after the current beat from said data register means to said activity next register means;

trigger signal generating means for generating a trigger signal when the activity now data corresponding to a rhythm pattern selected by operation of one of said plurality of rhythm switches are in a predetermined state;

damp signal generating means for generating a damp signal when the activity next data corresponding to a rhythm pattern selected by operation of one of said plurality of rhythm switches are in a predetermined state;

binary code generating means responsive to the playing of a key in the array of playing keys for generating a binary code corresponding to the frequency of a tone related to the frequency of the key played by the frequency deviation value corresponding to the binary data stored in said data register means for the current beat for a rhythm pattern selected by operation of one of said plurality of rhythm switches; and audio means for sounding a note corresponding to the binary code generated by said binary code generating means in response to a trigger signal generated by said trigger signal generating means and for damping the note being sounded in response to a damp signal generated by said damp signal generating means, whereby a note determined by a selected rhythm pattern and related in frequency to the note corresponding to a key played in the array of playing keys is sounded and damped by said audio means during each beat according to the selected rhythm pattern.

23. The apparatus as claimed in claim 22 wherein the binary data stored in said data register means also corresponds to whether special damp activity is required during each beat of each selectable rhythm pattern and wherein said damp signal generating means also generates a damp signal when the binary data stored in said data register means corresponding to whether special damp activity is required during the current beat of a rhythm pattern selected by operation of one of said plurality of rhythm switches are in a predetermined state, whereby a note is damped by said audio means during each beat for which special damp activity is required by a selected rhythm pattern.

24. An apparatus as claimed in claim 22 wherein for each beat of each selectable rhythm pattern for which trigger activity is indicated by the activity next data, the binary data stored in said data register means corresponds to a frequency deviation value.

25. An apparatus as claimed in claim 22 wherein the binary data stored in said data register means further corresponds to special damp activity for at least one beat of at least one selectable rhythm pattern and wherein said damp signal generating means also generates a damp signal when the binary data stored in said data register means corresponding to special damp activity during the current beat of a rhythm pattern selected by operation of one of said plurality of rhythm switches are in a predetermined state, whereby a note is damped by said audio means during each beat for which special damp activity is required by a selected rhythm pattern.

26. An apparatus as claimed in claim 22 wherein the size of said data register means is minimized by storing in said data register means binary data corresponding to tonal activity only for those beats of each selectable rhythm pattern for which tonal activity is required in accordance with the activity next data.

27. An apparatus as claimed in claim 26 wherein the binary data corresponding to tonal activity indicates the frequency deviation values and special damp activity required for each selectable rhythm pattern and wherein said damp signal generating means also generates a damp signal when the binary data stored in said data register means corresponding to special damp activity during the current beat of a rhythm pattern selected by operation of one of said plurality of rhythm switches are in a predetermined state, whereby a note is damped by said audio means during each beat for which special damp activity is required by a selected rhythm pattern.

28. An apparatus as claimed in claim 22 wherein for a predetermined period of time after the playing of a key in said array of playing keys said binary code generating means generates a binary code corresponding to the frequency of the key played and said audio means sounds the note corresponding to the binary code generated by said binary code generating means, whereby tones corresponding to rapidly played keys are inserted into the rhythm pattern selected by operation of one of said plurality of rhythm switches thereby breaking into the rhythm pattern temporarily while keys are rapidly played and resuming automatic rhythm generating responsive to the playing of a key which is played longer than the predetermined period of time.

29. An apparatus as claimed in claim 28 wherein said array of playing keys includes an array of pedals.

30. In an electronic musical instrument having an array of playing keys, an automatic rhythm generating apparatus for generating selectable rhythm patterns of musical tones, said apparatus comprising:

a plurality of rhythm switches for selecting rhythm patterns of notes, each of said rhythm switches being operable to select a corresponding rhythm pattern to be sounded;

logic control circuit means for providing frequency deviation data corresponding to each beat on which a tone is specified by a rhythm pattern selected by operation of a rhythm switch in said plurality of rhythm switches and for providing a trigger signal when a key in the array of playing keys is played during each beat on which a tone is specified by a selected rhythm pattern;

programmable signal generator means responsive to the playing of a playing key in the array of playing keys for generating a tone signal of the frequency of the playing key played during a predetermined delay period and, after said predetermined delay period, for generating a tone signal of a frequency related to the frequency of the playing key played by the frequency deviation corresponding to the frequency deviation data provided by said logic control circuit means;

gating means for receiving said tone signal from said programmable signal generator means and for receiving said trigger signal from said logic control circuit means, said gating means passing said tone signal in response to the receipt of said trigger signal; and audio output means for receiving said tone signal passed by said gating means and for converting said tone signal into an audible tone.

31. In an electronic musical instrument, an automatic rhythm generating apparatus for generating selectable rhythm patterns of musical tones, said apparatus comprising:

an array of playing keys;

a plurality of rhythm switches for selecting rhythm patterns of tones, each of said rhythm switches being operable to select a corresponding rhythm pattern to be sounded;

activity now register means for storing activity now data, the activity now data including one bit of data for each rhythm pattern selectable by operation of said plurality of rhythm switches;

rhythm register means for storing a bit of data corresponding to each of said plurality of rhythm switches;

data register means in which is stored binary data for each beat, for each of the selectable rhythm patterns for which the activity now bit indicates activity, the binary data corresponding to a frequency deviation value and to whether trigger activity and special damp activity is required;

activity next register means for storing activity next data, the activity next data including a bit of data for each of the selectable rhythm patterns;

logic circuit means for transferring the activity next data for the preceding beat from said activity next register means to said activity now register means, for transferring the binary data corresponding to whether trigger or special damp activity will be required during the next succeeding beat after the current beat from said data register means to said activity next register means, and for setting to a predetermined state a bit in said rhythm register means corresponding to each rhythm pattern selected by operation of a corresponding one of said plurality of rhythm switches;

trigger signal generating means for generating a trigger signal when a bit stored in said activity now register means and a bit stored in said rhythm register means, both corresponding to the same rhythm pattern, are in predetermined states;

damp signal generating means for generating a damp signal when a bit stored in said activity next register means and a bit stored in said rhythm register means, both corresponding to the same rhythm pattern, are in predetermined states and for generating a damp signal when a bit from the special damp data for the current beat stored in said data register means and a bit stored in said rhythm register means, both corresponding to the same rhythm pattern, are in predetermined states;

binary code generating means responsive to the playing of a key in said array of playing keys for generating a binary code corresponding to the frequency of a tone related to the frequency of the key played by the frequency deviation value for the current beat stored in said data register means, the frequency deviation value corresponding to a bit stored in said rhythm register means which is in a predetermined state; and audio generating means for sounding a rhythmic tone determined by the binary code from said binary code generating means in response to a trigger signal from said trigger signal generating means and for damping the rhythmic note being sounded in response to a damp signal from said damp signal generating means, whereby a rhythmic note determined by a selected rhythm pattern and related in frequency to the note corresponding to the key played in said array of playing keys is sounded and damped during each beat according to the selected rhythm pattern.

32. In an electronic musical instrument having an array of playing keys, an automatic chord generator apparatus for generating musical chords, said apparatus comprising:

chord note register means having a bit position for each of a predetermined group of notes;

logic circuit means for detecting the playing of a key in the array of playing keys and for assigning a binary number corresponding to the key in the array which is detected as being played;

arithmetic means for performing arithmetic operations on the binary number to derive additional binary numbers corresponding to additional notes musically related to the note of the key detected by said logic circuit means;

selector means for setting bits in said chord note register means, the bits which are set by said selector means corresponding to the binary number assigned by said logic circuit means and the additional binary numbers derived by said arithmetic means; and audio output means for generating and sounding the musical chord comprised of notes corresponding to the bits in said chord note register means which have been set to the predetermined state by said selector means, whereby musical chords are generated comprised of notes automatically selected from a predetermined range of notes in response to the playing of a key.

33. The apparatus as claimed in claim 32 further comprising:

musical key selector means for selecting which chords to be sounded in response to actuation of predetermined keys in said array of playing keys are to contain seventh notes, whereby when the playing of one of the predetermined keys is detected by said logic circuit means, said arithmetic means performs an arithmetic operation on the binary number assigned by said logic circuit means to derive a binary number corresponding to a seventh note and said selector means sets to a predetermined state a bit in said chord note register means corresponding to a seventh note, whereby one of the notes in the musical chord sounded by said output means is a seventh note.

34. The apparatus as claimed in claim 32 further comprising:

switch means for selecting minor chords, whereby when minor chords have been selected by operating said switch means and when the playing of a key in said array of playing keys is detected by said logic circuit means, said arithmetic means performs an arithmetic operation on the binary number assigned by said logic circuit means to derive a binary number corresponding to a minor note and said selector means sets to a predetermined state a bit in said chord note register means corresponding to a minor note so that one of the notes in the musical chord sounded by said audio output means is a minor note.

35. The apparatus as claimed in claim 32 wherein said arithmetic means further comprises:

adder means for subtracting two from the binary number assigned by said logic circuit means, whereby a binary number corresponding to the seventh note is obtained.

36. The apparatus as claimed in claim 35 wherein said adder means subtracts three from the result obtained by the subtracting two operation, whereby a binary number corresponding to the fifth note is obtained.

37. The apparatus as claimed in claim 36 further comprising:

switch means for selecting minor chords, wherein when minor chords have been selected by operating said switch means said adder means subtracts four from the result obtained by the subtracting three operation, whereby a binary number corresponding to a minor third note is obtained, and wherein when minor chords have not been selected by operating said switch means said adder means subtracts three from the result obtained by the subtracting three operation, whereby a binary number corresponding to a major third note is obtained.

38. The apparatus as claimed in claim 35 further comprising:

overflow adding means for adding twelve to a result obtained by a subtracting operation performed by said adder means if the result is outside of a predetermined range of values.

39. The apparatus as claimed in claim 32 wherein said arithmetic means further comprises:

switch means for selecting minor chords;

adder means for adding three to the binary number assigned by said logic circuit means when minor chords have been selected by operating said switch means, whereby a binary number corresponding to the minor third note is obtained, and for adding four to the binary number assigned by said logic circuit means when minor chords have not been selected by operating said switch means, whereby a binary number corresponding to the major third note is obtained.

40. The apparatus as claimed in claim 39 further comprising:

overflow adding means for subtracting twelve from a result obtained by an adding operation performed by said adder means if the result is outside of a predetermined range.

* * * * *

UNITED STATES PATENT AND TRADEMARK OFFICE

CERTIFICATE OF CORRECTION

PATENT NO. : 4,292,874

DATED : October 6, 1981

INVENTOR(S) : Edward M. Jones and Carlton J. Simmons, Jr.

It is certified that error appears in the above-identified patent and that said Letters Patent are hereby corrected as shown below:

Column 1, line 40, "voide" should read --voice--.

Column 7, line 68, delete "a" (second occurence).

Column 8, line 18, "seconds" should read --second--.

Column 10, line 12, "asnd" should read --and--.

Column 10, line 20, "thrugh" should read --through--.

Column 10, line 25, "shold" should read --should--.

Column 10, line 46, "the" should read --a--.

Column 11, line 34, "$Q_{10}$" should read --$Q_0$--.

Column 16, line 19, "+15V" should read --+27V--.

Column 21, line 4, "flat" should read --flag--.

Column 22, line 33, "DT" should read --D, T--.

UNITED STATES PATENT AND TRADEMARK OFFICE

CERTIFICATE OF CORRECTION

PATENT NO. : 4,292,874

DATED : October 6, 1981

INVENTOR(S) : Edward M. Jones and Carlton J. Simmons, Jr.

It is certified that error appears in the above-identified patent and that said Letters Patent are hereby corrected as shown below:

Column 27, line 48, "the the" should read --that the--.

Column 28, line 20, "infra" should read --infra--.

Column 30, line 42, delete "note".

Column 39, line 22, "generator" should read --generation--.

Column 39, line 60, "plated" should read --played--.

Column 41, line 2, "rhytm" should read --rhythm--.

Column 41, line 30, "fequency" should read --frequency--.

Signed and Sealed this

*Second* Day of *February 1982*

[SEAL]

*Attest:*

GERALD J. MOSSINGHOFF

*Attesting Officer* *Commissioner of Patents and Trademarks*